US009604489B2

(12) United States Patent
Nakagawa et al.

(10) Patent No.: US 9,604,489 B2
(45) Date of Patent: Mar. 28, 2017

(54) CARD ENCLOSED UNITS, SERVICE PROVIDING SHEETS AND INFORMATION CONCEALMENT SHEET

(71) Applicant: TOPPAN FORMS CO., LTD., Tokyo (JP)

(72) Inventors: Shogo Nakagawa, Tokyo (JP); Norifumi Aizawa, Tokyo (JP); Nobuyuki Saitou, Tokyo (JP)

(73) Assignee: TOPPAN FORMS CO., LTD, Tokyo (JP)

( * ) Notice: Subject to any disclaimer, the term of this patent is extended or adjusted under 35 U.S.C. 154(b) by 513 days.

(21) Appl. No.: 14/091,911

(22) Filed: Nov. 27, 2013

(65) Prior Publication Data

US 2014/0299493 A1 Oct. 9, 2014

(30) Foreign Application Priority Data

Nov. 29, 2012 (JP) ..... 2012-260864
Mar. 27, 2013 (JP) ..... 2013-066149
(Continued)

(51) Int. Cl.
*B65D 85/48* (2006.01)
*B42D 15/02* (2006.01)
(Continued)

(52) U.S. Cl.
CPC ..... *B42D 15/025* (2013.01); *A45C 11/182* (2013.01); *B42D 15/085* (2013.01); *B65D 73/0078* (2013.01)

(58) Field of Classification Search
CPC ..... B65D 73/0078; B65D 73/0085; A45C 11/182; B42D 15/025; B42D 15/085
(Continued)

(56) References Cited

U.S. PATENT DOCUMENTS 5,791,474 A * 8/1998 Hansen ..... A45C 11/182 206/38
6,145,665 A * 11/2000 Krahn ..... B65D 5/4208 206/449
(Continued)

FOREIGN PATENT DOCUMENTS

JP 3001234 U 6/1994
JP 08-183277 A 7/1996
(Continued)

OTHER PUBLICATIONS

Office Action issued Dec. 20, 2016 in corresponding TW Application No. 102143453.
(Continued)

*Primary Examiner* — Luan K Bui
(74) *Attorney, Agent, or Firm* — Knobbe Martens Olson & Bear LLP

(57) ABSTRACT

A card enclosed unit has a card mount paper and a support mount paper adhered to each other. The card mount paper includes an upper paper and a lower paper. The card mount paper has a card. The card is separably enclosed in the card mount paper. The card is peelably adhered to support mount paper. A PIN code is indicated on the support mount paper side adhesion surface of the card, and a POS code is indicated on the support mount paper side adhesion surface of the card mount paper. The card mount paper has a hole such that the hole is facing the POS code.

6 Claims, 34 Drawing Sheets

(30) Foreign Application Priority Data

May 9, 2013 (JP) ..... 2013-099191
May 9, 2013 (JP) ..... 2013-099196
Jul. 10, 2013 (JP) ..... 2013-144993

(51) Int. Cl.
*B65D 73/00* (2006.01)
*A45C 11/18* (2006.01)
*B42D 15/08* (2006.01)

(58) Field of Classification Search
USPC .... 206/37–39, 449, 461, 467; 235/375, 380, 235/486
See application file for complete search history.

(56) References Cited

U.S. PATENT DOCUMENTS 6,328,341 B2 * 12/2001 Klure ..... B65D 73/0078 206/454
6,715,795 B2 * 4/2004 Klure ..... B42D 15/025 206/38
8,403,229 B2 * 3/2013 McGrane ..... G06Q 20/20 235/380
8,807,332 B1 * 8/2014 Pascua ..... A45C 11/182 206/39
2007/0063021 A1 * 3/2007 Chakiris ..... B42D 15/045 235/380
2009/0038968 A1 * 2/2009 Smith ..... B65D 73/0078 206/307
2009/0091123 A1 4/2009 Conley et al.
2011/0175707 A1 7/2011 Chen et al.
2014/0116908 A1 * 5/2014 Beyer ..... B65D 1/00 206/449

FOREIGN PATENT DOCUMENTS

JP 11-110494 A 4/1999
JP 11-203560 A 7/1999
JP 2000-062355 A 2/2000
JP 2001-018557 A 1/2001
JP 2001-039062 A 2/2001
JP 2001-205963 A 7/2001
JP 2003-312167 A 11/2003
JP 2005-149289 A 6/2005
JP 2005-169983 A 6/2005
JP 2007-015172 A 1/2007
JP 2010-082949 A 4/2010
JP 2010-531021 A 9/2010
JP 2010-535675 A 11/2010
JP 2014-097814 A 5/2014
JP 2014-117816 A 6/2014
TW M383785 U1 7/2010

OTHER PUBLICATIONS

Office Action issued Jan. 10, 2017 in corresponding JP Application No. 2013-066149.
Asami Diary, Oct. 2, 2012, http://d.hatena.ne.jp/asami-1120/20121002.

* cited by examiner 401
411
414
PRECAUTIONS
413a
441
413b-1
423a
424
TF CARD
1000
443
422
423b
PIN 12345678
421
413b-2
442
413c
432a
431
410
420a
420
420b
430

411
412
PLEASE PULL THE SHEET APART FROM HERE
TOPPAN FORMS
TF CARD
1000
413a
441
413b-1
423a
424
443
423b
413b-2
442
413c
432b
431
410
420a
420b
430

410
413a
TOPPAN FORMS
TF CARD
1000
PLEASE PULL THE SHEET APART FROM HERE
412
411

430
413c
16e
431
422
432b
16e 452
442
420b
430
431
451
441
420a
410
443
451

501
TOPPAN FORMS
TF CARD
1000
PIN 12345678
510
513a
541
513b
523
524
521
522
542
531
532a
533
520
530

514
TF CARD
1000
532b

TOPPAN FORMS
TF CARD
1000

17e 551
552

1001
TF CARD
PIN 12345678

TF CARD

PIN 12345678

TF CARD

TF CARD
PIN 12345678
1101
1110
1110a
1110b
1111
1112
1113
1113a
1113b
1113c
1114a
1114b
1115
1116
1120
1126
1127
1128
1130
1141
1142
28e
28h

CARD ENCLOSED UNITS, SERVICE PROVIDING SHEETS AND INFORMATION CONCEALMENT SHEET

CROSS-REFERENCE TO RELATED APPLICATIONS

This application claims priority to Japanese Patent Application No. 2012-260864 filed on Nov. 29, 2012, Japanese Patent Application No. 2013-066149 filed on Mar. 27, 2013, Japanese Patent Application No. 2013-099191 filed on May 9, 2013, Japanese Patent Application No. 2013-099196 filed on May 9, 2013, and Japanese Patent Application No. 2013-144993 filed on Jul. 10, 2013, the disclosure of which including the specification, the drawings, and the claims is hereby incorporated by reference in their entirety.

BACKGROUND OF THE INVENTION

Field of the Invention

The present invention relates to card enclosed units, service providing sheets, and information concealment sheets for electronic transaction prepaid card systems to make payment for service charges of online stores over computer networks.

Description of Related Art

In recent years, a system that allows a user to use a prepaid card to pay a service charge of an online store over a computer network has been practically used and is disclosed, for example, in JP1999-203560A (Patent Literature 1). In such a system, a prepaid card has an ID and a POS code that are indicated thereon and that have been correlated with each other. When a prepaid card is purchased, the POS code that is indicated thereon is read by a POS register and then the prepaid card can be used. Thereafter, the user who purchased the prepaid card can shop at online shops using the ID that is indicated on the prepaid card.

In the system using the foregoing prepaid cards, there are concerns about fraudulent use of ID. To prevent fraudulent use of the ID of the prepaid card, a technique that forms a scratch layer on a PIN code that is indicated on a prepaid card has been contemplated as disclosed, for example, in JP2010-531021A (translation version) (Patent Literature 2). By using this technique, before a prepaid card is purchased, since the PIN code has been concealed, the fraudulent use of ID can be prevented.

When the foregoing prepaid card is sold at a real store, it is preferred that the card be separably enclosed in a mount paper. A technique that peelably adheres a card to a mount paper and that causes a card number to be indicated on the mount paper has been disclosed for example in JP1999-110494A (Patent Literature 3). Applying this technique, a card can be separably enclosed in a mount paper on which information corresponding to the card is indicated.

CITED PATENT LITERATURE

Patent Literature 1: JP1999-203560A, Publication

Patent Literature 2: JP2010-531021A, Publication (translation version)

Patent Literature 3: JP1999-110494A, Publication

SUMMARY

As disclosed in Patent Literature 3, if the card is peelably adhered to the mount paper on which information corresponding to the card is indicated, an identification code such as a PIN code will not have been concealed. Thus, to conceal the identification code, it is necessary to form a scratch layer on the identification code as disclosed in Patent Literature 2 or cause the identification code to be indicated on the mount paper side adhesion surface of the card. However, if the identification code that is indicated on the card and the code corresponding thereto that is indicated on the mount paper are separately printed, it is likely that these codes that are printed will become incompatible.

The present invention is made from a view point of the problems involved in the related art. An object of the present invention is to provide card enclosed units, service providing sheets, and information concealment sheets on which a first and second code that have been correlated with each other are indicated, in which before being used, while the first code becomes invisible, the second code becomes visible and in which the first code and the second code that are printed are prevented from becoming incompatible.

To accomplish the foregoing object, an aspect of the present invention is a card enclosed unit that has a first sheet and a second sheet adhered to each other, on which a first code and a second code are indicated, the first code and the second code having been correlated with each other, the first sheet enclosing a card, wherein the first sheet encloses in the card separably, the first sheet is peelably adhered to the second sheet, the first code is indicated on the second sheet side adhesion surface of the card, the second code is indicated on the second sheet side adhesion surface of the first sheet, and wherein the second sheet has a hole such that the hole is opposite to the second code.

According to an aspect of the present invention, when the card has not been separated from the first sheet, since the card has been adhered to the second sheet, the first code that is indicated on the second sheet side adhesion surface of the card is invisible. The second code is indicated on the second sheet side adhesion surface of the first sheet. However, since the hole is formed in the second sheet such that the hole is opposite to the second code, the second code is visible through the hole. Thereafter, when the card is separated from the first sheet, the first code that is indicated on the second sheet side adhesion surface of the card becomes visible. Since the first code and the second code are indicated on the second sheet side adhesion surface of the first sheet, these codes are simultaneously printed and they are prevented from becoming incompatible.

When the outer shapes of the first sheet and the second sheet are nearly the same, unless the card has not been separated from the first sheet, since the second code becomes visible through the hole formed in the second sheet, the overall flatness of the card enclosed unit is not affected.

Another aspect of the present invention is a card enclosed unit that has a first sheet, a second sheet, and a third sheet successively connected, folded such that the second sheet is sandwiched between the first sheet and the third sheet, and the first sheet is adhered to the second sheet, the second sheet is adhered to the third sheet each other, and on which a first code and a second code that have been correlated with each other are indicated, wherein the second sheet encloses a card, the first code and the second code being indicated on the third sheet side adhesion surface of the card, wherein the third sheet has a hole such that, when the third sheet is adhered to the second sheet, the hole will be opposite to the second code, wherein one of sheets among the first sheet and the third sheet has an unsealing structure that allows the card to be exposed, and wherein the card is separable both from the other sheet of the first sheet and the third sheet and from the second sheet.

According to the foregoing aspect of the present invention, since the first sheet and the third sheet have been adhered on the front surface and the rear surface of the second sheet having the card, respectively, the card can be prevented from being illegally separated from the second sheet and the first code that is indicated on the third sheet side adhesion surface of the card is invisible. Although the second code is indicated on the third sheet side adhesion surface of the second sheet, since the hole is formed in the third region such that the hole is opposite to the second code, the second code is visible through the hole. When the card enclosed unit is unsealed by the unsealing structure located on one of the first sheet and the third sheet, the card is exposed. When the exposed card is separated from the other sheet of the first sheet and the third sheet and from the second sheet, the first code that is indicated on the third sheet side adhesion surface of the card becomes visible. Since the first code and the second code are indicated on the third sheet side adhesion surface of the second sheet, they can be simultaneously printed and thereby they can be prevented from becoming incompatible.

The unsealing structure may be realized by peelably adhering the one of sheets and die second sheet to each other.

One of the sheets may be adhered to a region opposite to the connection side of the second sheet. The unsealing structure may be a separation line formed in a region where one of sheets and the second sheet are not adhered to each other.

Another aspect of the present invention is a service providing sheet having a first sheet and a second sheet that are foldably connected, wherein a first code and a second code that have been correlated with each other are indicated on a folded inner side of the first sheet, and wherein when the second sheet has been folded, the second sheet has a shape that allows the first code to become invisible and the second code to become visible.

According to the foregoing aspect of the present invention, when the first sheet and the second sheet have been folded, the second sheet allows the first code of the first code and the second code that are indicated on the first sheet to become invisible and the second code to become visible. Thereafter, when the first sheet is unfolded from the second sheet or the region on which the first code is indicated is separated from the first sheet, the first code becomes visible. Since the first code and the second code are indicated on the folded inner side surface of the first sheet, they can be simultaneously printed and thereby they can be prevented from becoming incompatible.

In such a structure, the length of the second sheet in the connection direction of the first sheet and the second sheet may be shorter than that of the first sheet. When the first sheet has been folded, the first code may be indicated such that it is overlaid with the second sheet and the second code may be indicated such that it is not overlaid with the second sheet.

When the second sheet has been folded, the second sheet may have a hole such that it is opposite to the second code.

The first code and the second code may be indicted on the first sheet such that the first code is adjacent to the connection side of the second sheet. When the second sheet has been folded, a first region around the hole is unpeelably adhered to the first sheet, a second region opposite to the first code may be peelably adhered to the first sheet, and the first region and the second region may be separable along a perforation. As a result, when the perforation is broken, the first code becomes visible. Thus, if the first code is caused to become illegally visible, a fraud alert still can be seen.

The first sheet may encloses a card separably on which the first code and the second code are indicated. At least a region other than the card enclosed in the first sheet may be adhered to the second sheet.

Another aspect of the present invention is an information concealment sheet that conceals predetermined information and causes it to become visible later, including:

a sheet member on which a first code and a second code that have been correlated with each other are formed;

a concealment member that is peelably adhered to the sheet member such that the concealment member conceals the first code and allows the second code to become visible; and a carbon concealment layer that is formed on the sheet member or the concealment member such that the position in the overlay direction of the carbon concealment layer matches that of the sheet or the concealment member.

According to the present invention, the first code is indicated on the card and the second code is indicated on the first sheet that separably encloses the card. And both the first code and the second code are indicated on the second sheet side adhesion surface of the first sheet. When the card has not been separated from the first sheet, the second code is visible through the hole formed in the second sheet. Thus, before the card is separated from the sheet, while the first code that is indicated on the card becomes invisible, the second code that is indicated on the sheet becomes visible. In addition, the first code and the second code can be prevented from becoming incompatible.

The first code and the second code that have been correlated with each other are indicated on the third sheet side adhesion surface of the second sheet. When the card enclosed unit has not been unsealed, the first code is invisible and the second code is visible through the hole formed in the third sheet. Thus, before the card is separated from the first sheet, while the first code that is indicated on the card is invisible, the second code is visible. In addition, the first code and the second code can be prevented from becoming incompatible. Moreover, unless the card enclosed unit is unsealed by the unsealing structure located on one of the first sheet and the third sheet, the card will not become exposed. Thus, it is difficult to illegally separate the card from the first sheet.

Before the service providing sheet is used, since the first sheet and the second sheet have been folded, the second sheet causes the first code of the first and second codes that are indicated on the first sheet to be invisible and the second code to be visible. Thereafter, when the service providing sheet is used, the first sheet and the second sheet are unfolded or the first code region of the first sheet is separated from the first sheet. As a result, the first code becomes visible. Thus, before the service providing sheet is used, while the first code becomes invisible, the second code becomes visible. In addition, since the first code and the second code are indicated on the folded inner side surface of the first sheet, the first code and the second code can be simultaneously printed and thereby they can be printed from becoming incompatible.

In the structure where when the second sheet has been folded, the hole formed therein is opposite to the second code, the first code and the second code are indicted on the first sheet such that the first code is adjacent to the connection side of the second sheet. When the second sheet has been folded, the first region around the hole formed in the second sheet is unpeelably adhered to the first sheet. The second region opposite to the first code is peelably adhered to the first sheet. In the structure where the first region is separated from the second region by a perforation, when the perforation is broken, the first code becomes visible. Thus, if the first code is caused to become illegally visible, a fraud alert still can be seen.

The first code and the second code that have been correlated with each other are formed on the sheet. The concealment member is adhered to the sheet such that the first code is concealed and the second code is exposed and becomes visible. The carbon concealment layer is formed on the sheet member or the concealment layer such that the position in the overlay direction of the concealment layer formed thereon matches that of the first code formed on the sheet. Therefore, the carbon concealment can prevent the first code from being seen through LED light. As a result, the first code can be prevented from being illegally obtained.

Figure 30A:
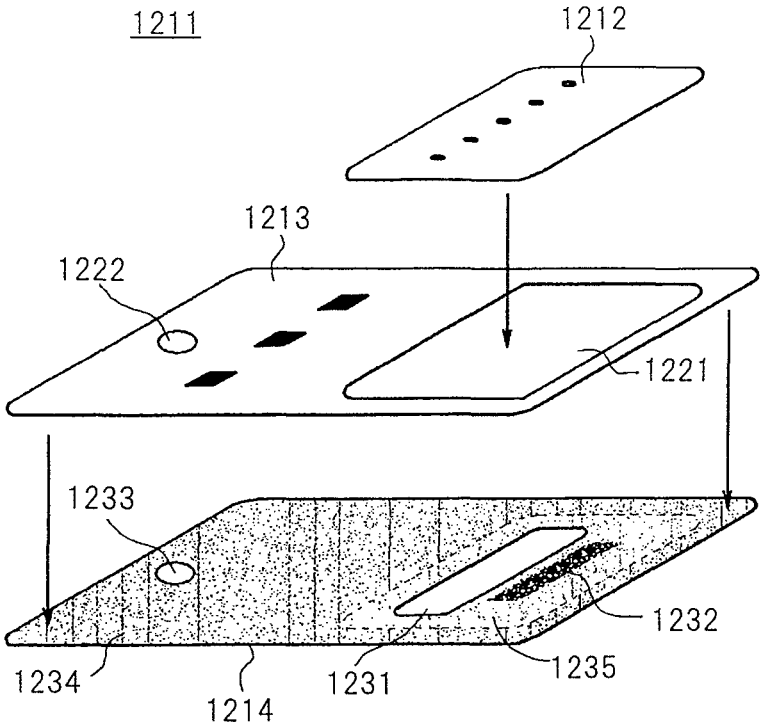
FIG. 30*a* is a schematic diagram showing a laminated state of a thirteenth embodiment of the present invention.
Figure 30B:
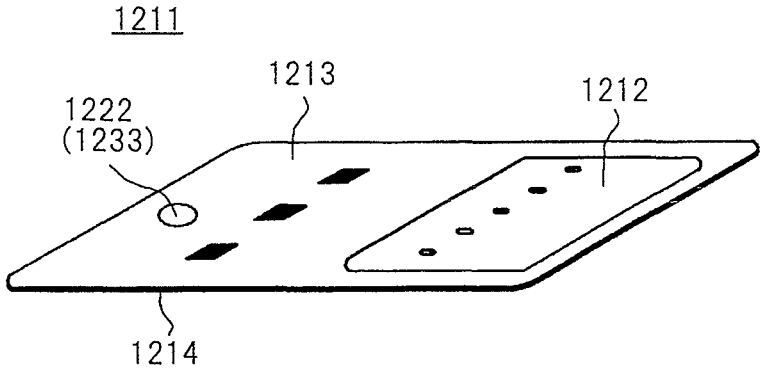
Figure 31A:
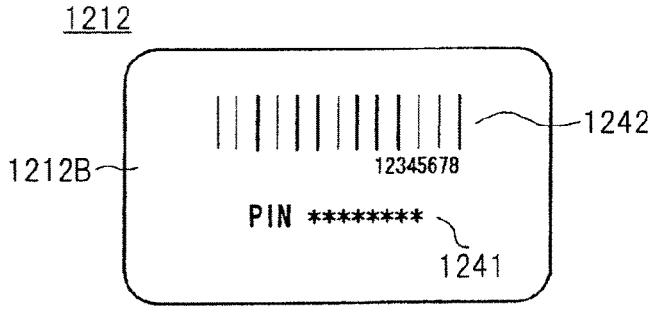

FIG. 30*b* is an external perspective view showing the thirteenth embodiment of the present invention;

FIG. 31*a* is a schematic diagram showing an example of the structure of a rear surface of a sheet shown in FIG. 30*a* and FIG. 30*b;*

Figure 31B:
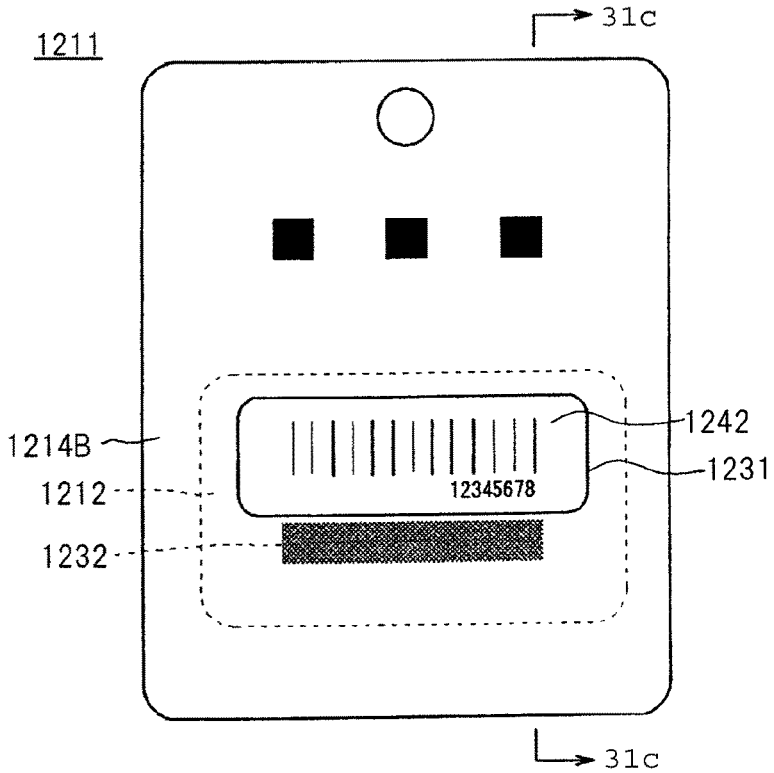

FIG. 31*b* is a schematic diagram showing an example of the structure of the rear surface of the information concealment sheet shown in FIG. 30*a* and FIG. 30*b;*

Figure 31C:
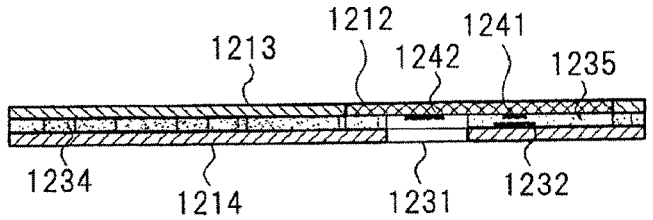

FIG. 31*c* is a sectional view taken along line 31*c*-31*c* of FIG. 31*b;*

Figure 32:
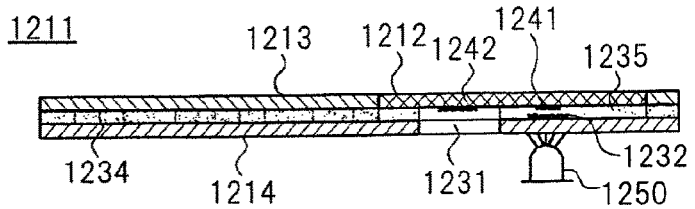
Figure 33A:
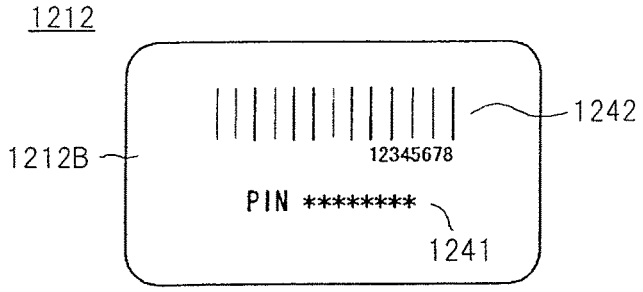
Figure 33B:
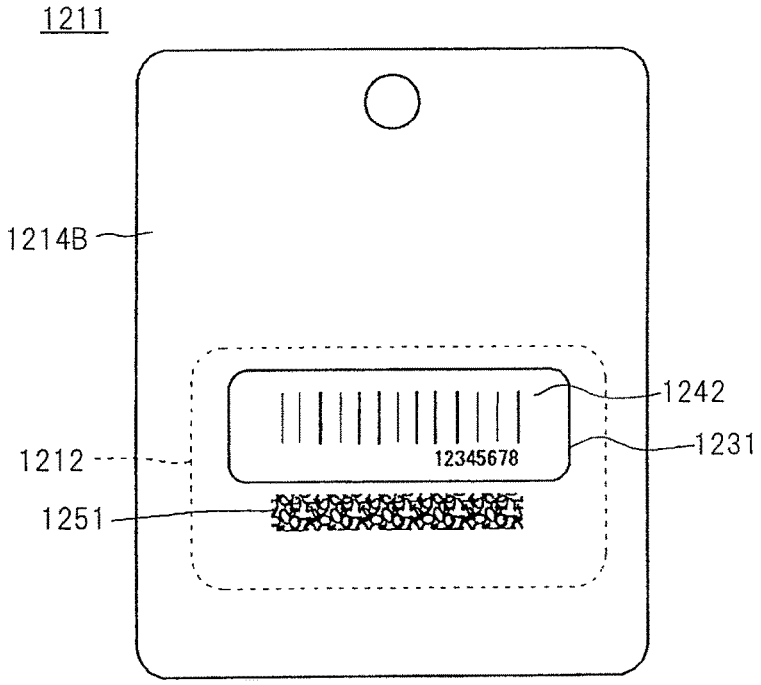
Figure 34A:
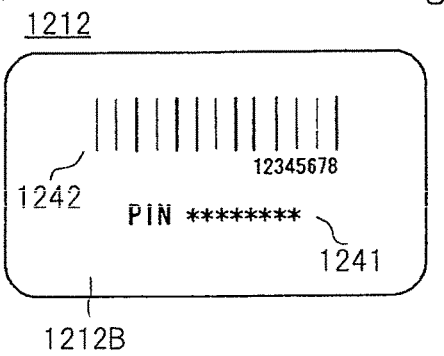
Figure 34B:
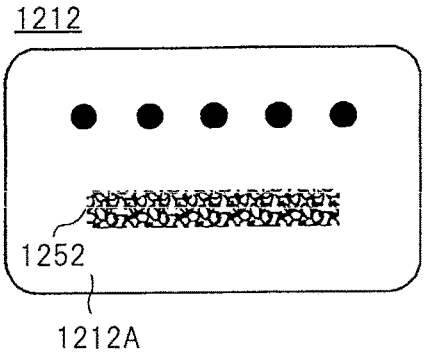
Figure 35A:
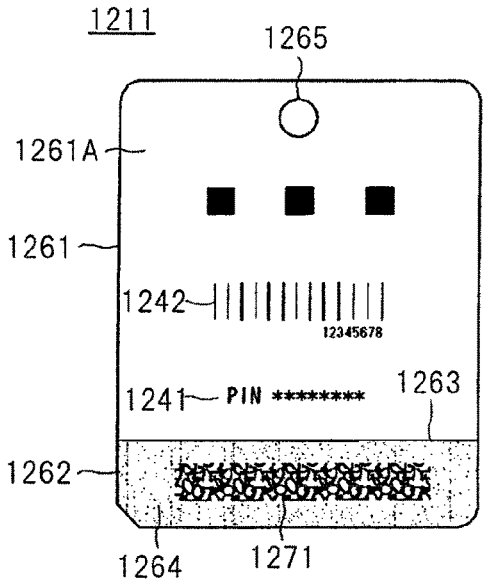
Figure 35B:
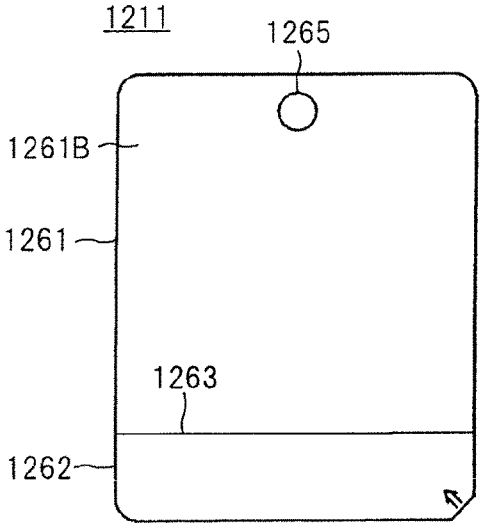
Figure 35C:
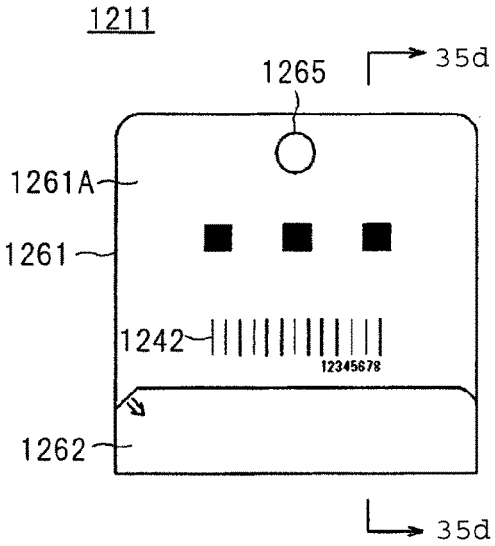
Figure 35D:
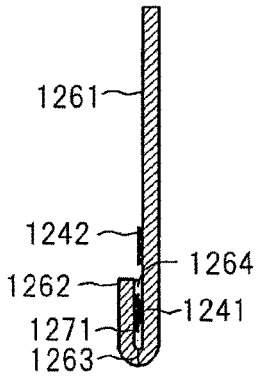

FIG. 32 is a schematic diagram describing that the information concealment sheet shown in FIG. 30*a* and FIG. 30*b* prevents a PIN code from becoming visible;

FIG. 33*a* is a schematic diagram showing another example of the structure of the rear surface of the sheet of the thirteenth embodiment of the present invention;

FIG. 33*b* is a schematic diagram showing another example of the structure of the rear surface of the information concealment sheet according to the thirteenth embodiment of the present invention;

FIG. 34*a* is a schematic diagram showing another example of the structure of the rear surface of the sheet of the thirteenth embodiment of the present invention;

FIG. 34*b* is a schematic diagram showing another example of the structure of a front surface of the sheet of the thirteenth embodiment of the present invention;

FIG. 35*a* is a schematic diagram showing an example of the structure of a front surface of a fourteenth embodiment of the present invention;

FIG. 35*b* is a schematic diagram showing an example of the structure of a rear surface of the fourteenth embodiment of the present invention;

FIG. 35*c* is a schematic diagram showing that the information concealment sheet shown in FIG. 35*a* has been folded;

FIG. 35*d* is a sectional view taken along line 35*d*-35*d* of FIG. 35*c;*

Figure 36A:
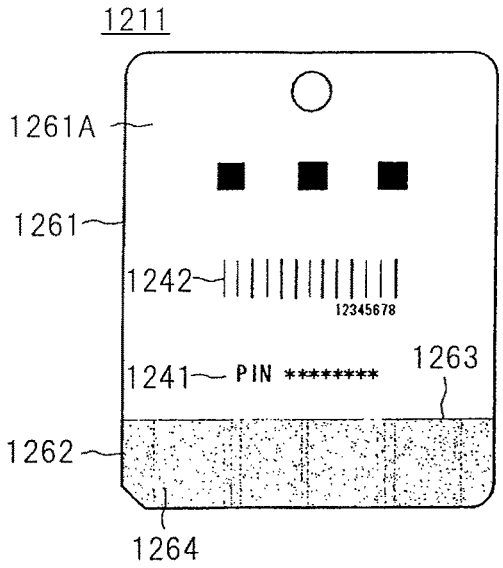
Figure 36B:
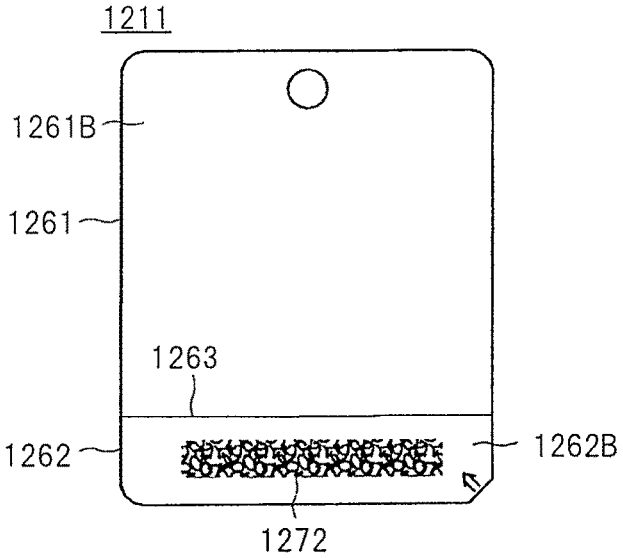
Figure 36C:
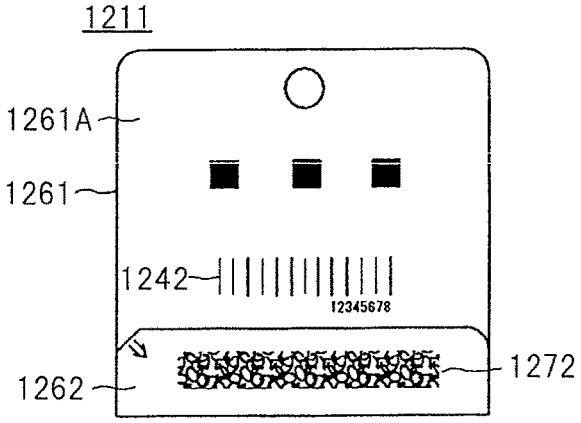
Figure 37A:
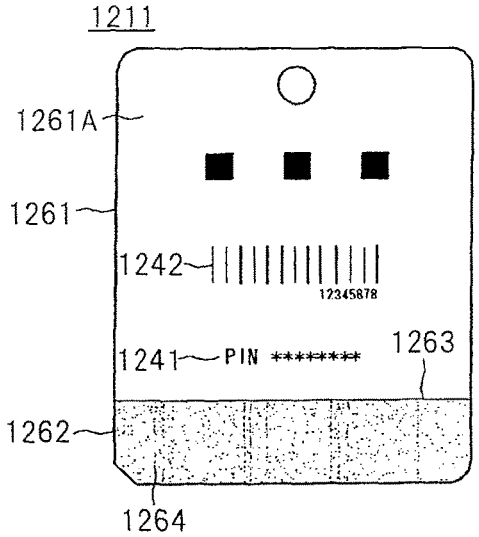
Figure 37B:
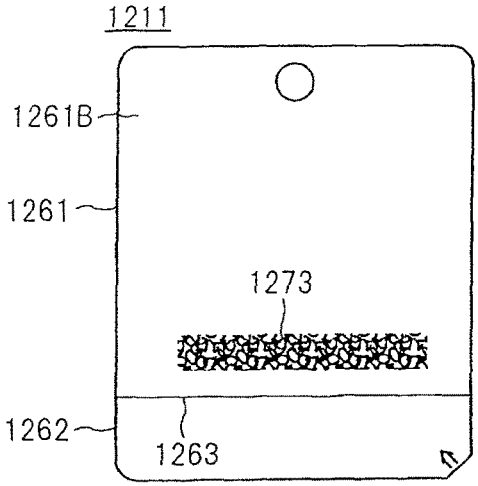
Figure 37C:
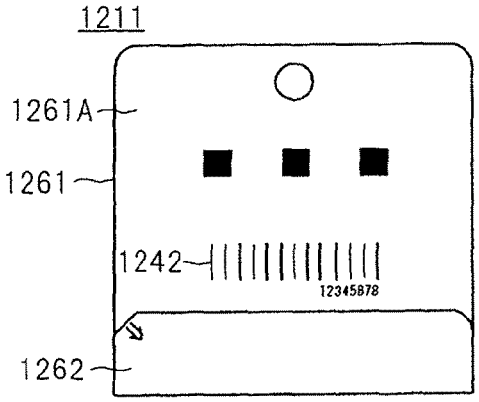
Figure 37D:
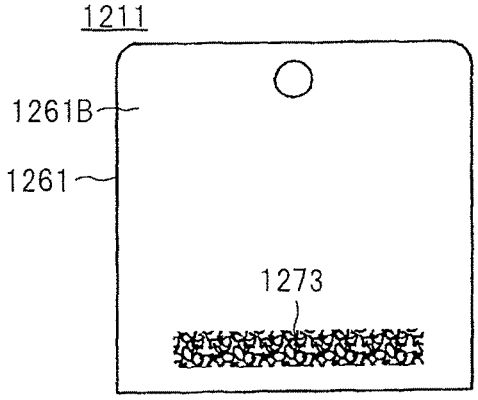

FIG. 36*a* is a schematic diagram showing another example of the structure of the front surface of the fourteenth embodiment of the present invention;

FIG. 36*b* is a schematic diagram showing another example of the structure of the rear surface of the fourteenth embodiment of the present invention;

FIG. 36*c* is a schematic diagram showing that the information concealment sheet shown in FIG. 36*b* has been folded;

FIG. 37*a* is a schematic diagram showing another example of the structure of the front surface of the fourteenth embodiment of the present invention;

FIG. 37*b* is a schematic diagram showing another example of the structure of the rear surface of the fourteenth embodiment of the present invention;

FIG. 37*c* is a front view showing that the information concealment sheet shown in FIG. 37*a* has been folded; and FIG. 37*d* is a rear view showing that the information concealment sheet shown in FIG. 37*b* has been folded.

DETAILED DESCRIPTION OF THE PREFERRED EMBODIMENTS

Next, with reference to the accompanying drawings, embodiments of the present invention will be described.

(First Embodiment)

Figure 1A:
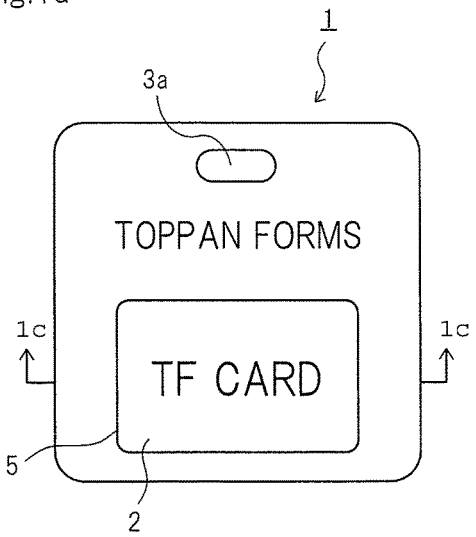
FIG. 1*a* is a front view showing a first embodiment of the present invention.
Figure 1B:
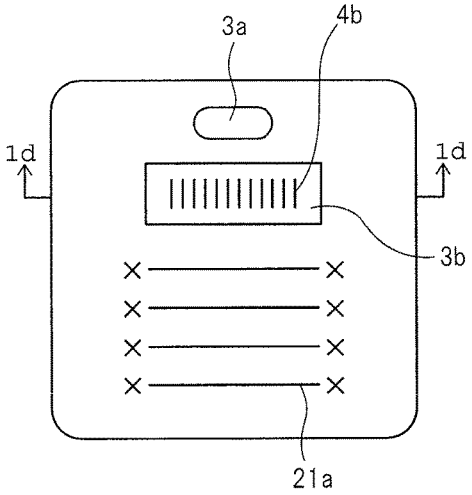
FIG. 1*b* is a rear view showing the first embodiment of the present invention.
Figure 1C:
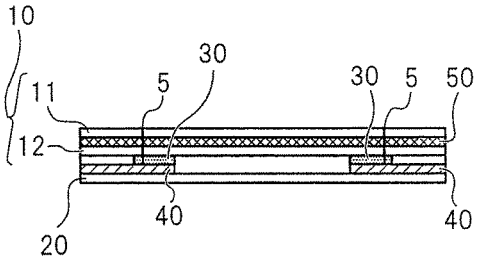
FIG. 1*c* is a sectional view taken along line 1*c*-1*c* of FIG. 1*a;*
Figure 1D:
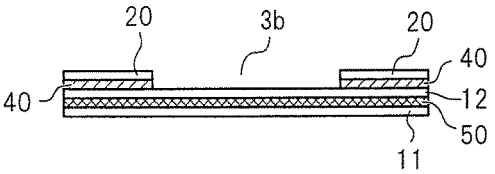
FIG. 1*d* is a sectional view taken along line 1*d*-1*d* of FIG. 1*b;*
Figure 1E:
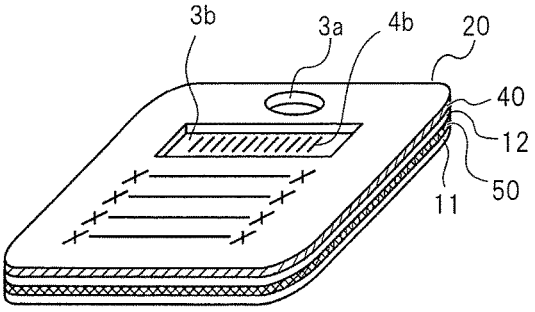
FIG. 1*e* is a perspective view showing that the first embodiment of the present invention is viewed from the rear side.

FIG. 1*a* is a front view showing a first embodiment of the present invention; FIG. 1*b* is a rear view showing the first embodiment of the present invention; FIG. 1*c* is a sectional view taken along line 1*c*-1*c* of FIG. 1*a*; FIG. 1*d* is a sectional view taken along line 1*d*-1*d* of FIG. 1*b*; and FIG. 1*e* is a perspective view showing that the first embodiment of the present invention is viewed from the rear side.

As shown in FIG. 1*a* to FIG. 1*e*, card enclosed unit 1 according to the first embodiment of the present invention has upper paper 11, lower paper 12, and support mount paper 20 that have the same outer shape and round corners and that are adhered to each other. Support mount paper 20 is a second sheet. Hole 3*a* that pierces through card enclosed unit 1 is formed at a part thereof. Upper paper 11 and lower paper 12 are adhered to each other with adhesive agent 50. Lower paper 12 and support mount paper 20 are peelably adhered to each other with pseudo adhesive agent 40 and release varnish 30. Upper paper 11 and lower paper 12 compose card mount paper 10 that is a first sheet.

Slit 5 is formed in card mount paper 10 such that card 2 is separably enclosed in card mount paper 10 along slit 5. Hole 3*b* that pierces through support mount paper 20 is formed such that POS code 4*b* that is indicated on lower paper 12 is exposed and becomes visible through hole 3*b*. In addition, notification information 21*a* is indicated on support mount paper 20.

Next, the detailed structures of upper paper 11, lower paper 12, and support mount paper 20 and their adhesive structures will be described.

Figure 2A:
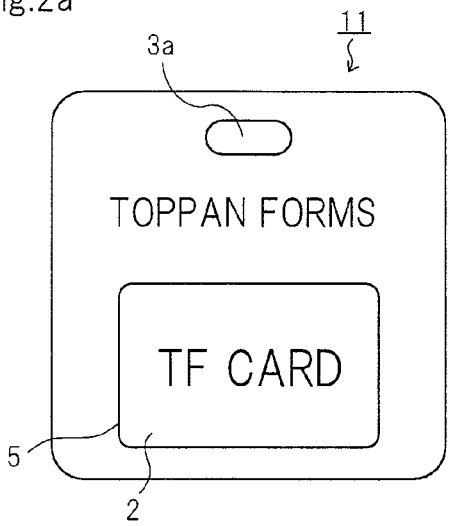
FIG. 2*a* is a front view showing an upper paper of the card enclosed unit shown in FIG. 1*a* to FIG. 1*e;*
Figure 2B:
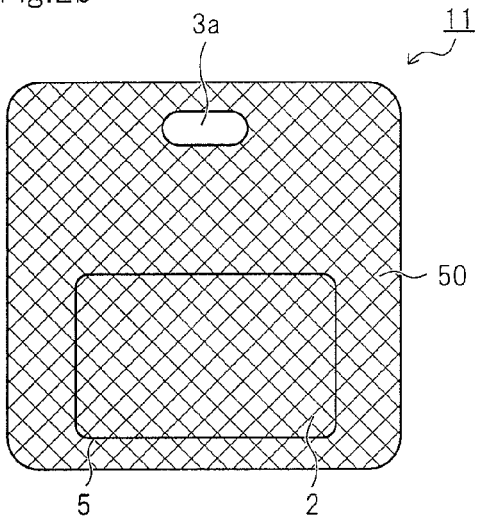
FIG. 2*b* is a rear view showing the upper paper of the card enclosed unit shown in FIG. 1*a* to FIG. 1*e;*
Figure 2C:
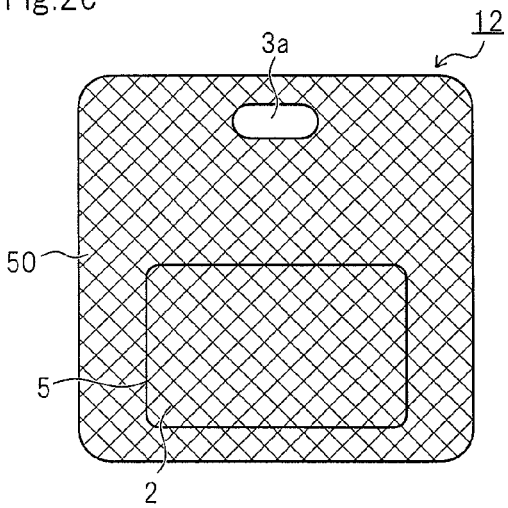
FIG. 2*c* is a front view showing a lower paper of the card enclosed unit shown in FIG. 1*a* to FIG. 1*e;*
Figure 2D:
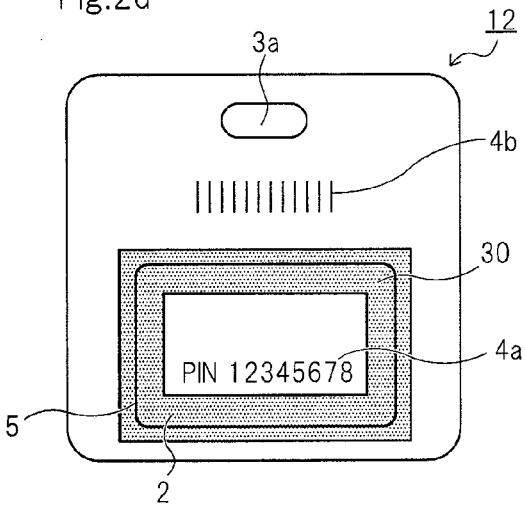
FIG. 2*d* is a rear view showing the lower paper of the card enclosed unit shown in FIG. 1*a* to FIG. 1*e;*
Figure 2E:
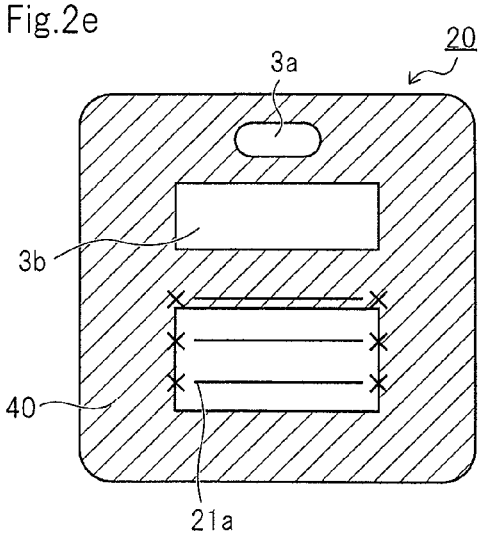
FIG. 2*e* is a front view showing a support mount paper of the card enclosed unit shown in FIG. 1*a* to FIG. 1*e;*
Figure 2F:
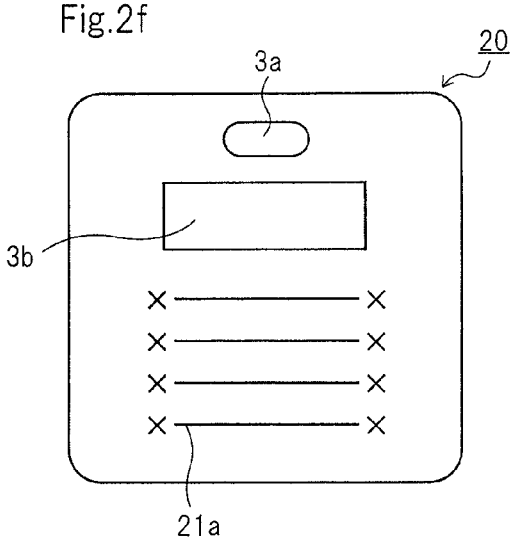
FIG. 2*f* is a rear view showing the support mount paper of the card enclosed unit shown in FIG. 1*a* to FIG. 1*e;*

FIG. 2*a* is a front view showing upper paper 11 of card enclosed unit 1 shown in FIG. 1*a* to FIG. 1*e*; FIG. 2*b* is a rear view showing upper paper 11 of card enclosed unit 1 shown in FIG. 1*a* to FIG. 1*e*; FIG. 2*c* is a front view showing lower paper 12 of card enclosed unit 1 shown in FIG. 1*a* to FIG. 1*e*; FIG. 2*d* is a rear view showing lower paper 12 of card enclosed unit 1 shown in FIG. 1*a* to FIG. 1*e*; FIG. 2*e* is a front view showing support mount paper 20 of card enclosed unit 1 shown in FIG. 1*a* to FIG. 1*e*; and FIG. 2*f* is a rear view showing support mount paper 20 of card enclosed unit 1 shown in FIG. 1*a* to FIG. 1*e*.

As shown in FIG. 2*a* to FIG. 2*d*, slit 5 is formed in card mount paper 10 composed of upper paper 11 and lower paper 12 such that card 2 is separably enclosed in card mount paper 10 along list 5.

As shown in FIG. 2*b*, the rear surface of upper paper 11, namely the lower paper 12 side adhesion surface of upper paper 11, is fully coated with adhesive agent 50. In addition, as shown in FIG. 2*c*, the front surface of lower paper 12, namely the upper paper 11 side adhesion surface of lower paper 12, is fully coated with adhesive agent 50. As a result, upper paper 11 and lower paper 12 are adhered to each other with adhesive agent 50.

As shown in FIG. 2*d*, PIN code 4*a* that is a first code and POS code 4*b* that is a second code are indicated on the rear surface of lower paper 12, namely the support mount paper 20 side adhesion surface of lower paper 12. As will be described later, PIN code 4*a* and POS code 4*b* have been correlated with each other. PIN code 4*a* is indicated on the support mount paper 20 side adhesion surface of card 2. POS code 4*b* is indicated as a bar code on the support mount paper 20 side adhesion surface of the non-card region. The card region and the non-card region of support mount paper 20 side adhesion surface of lower paper 12 are coated with release varnish 30 having a predetermined width along slit 5. It is preferred that the region surrounded by release varnish 30 be wider than at least the region on which PIN code 4*a* is printed such that after the rear surface of lower paper 12 is coated with release varnish 30, PIN code 4*a* can be printed.

As shown in FIG. 2*e* and FIG. 2*f*, hole 3*b* that pierces through support mount paper 20 is formed therein. Hole 3*b* is formed such that when support mount paper 20 is adhered to lower paper 12, hole 3*b* is opposite to POS code 4*b*. As shown in FIG. 2*e*, notification information 21*b* is indicated on the lower paper 12 side adhesion surface of support mount paper 20 such that when support mount paper 20 is adhered to lower paper 12, notification information 21*b* is opposite to card 2. The front surface of support mount paper 20 except for the region opposite to the region surrounded by release varnish 30 on lower paper 12 is fully coated with pseudo adhesive agent 40. Notification information 21*a* is indicated on the rear surface of support mount paper 20.

Next, a manufacturing method for card enclosed unit 1 having the foregoing structure will be described.

Figure 3:
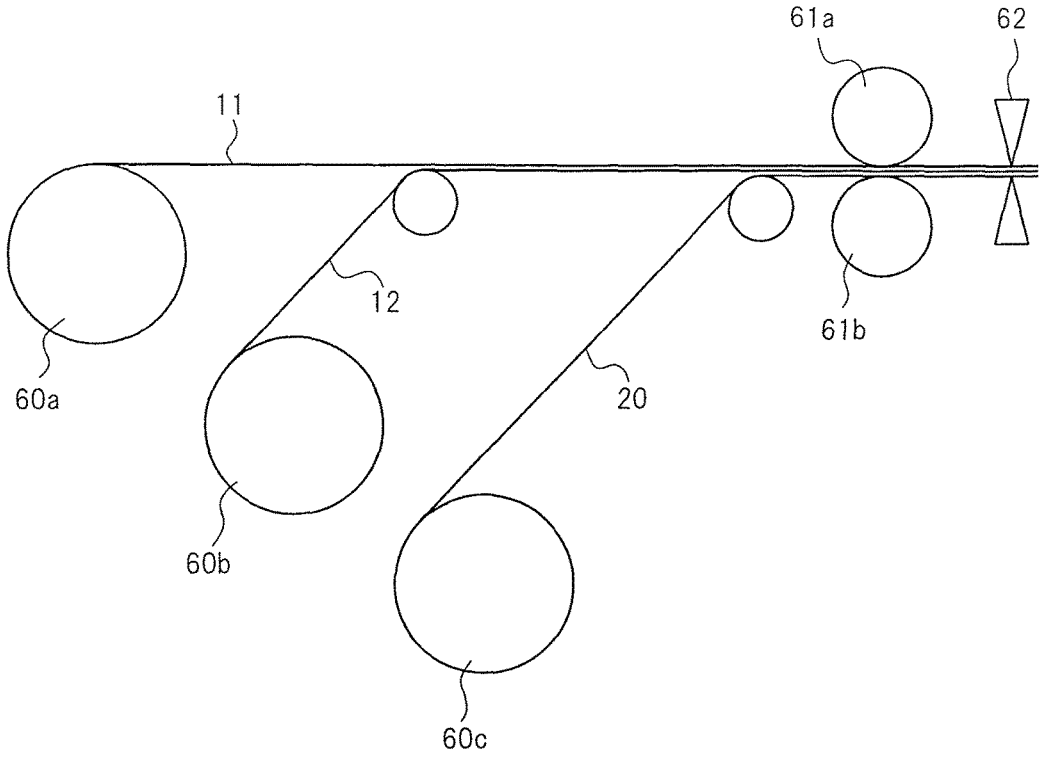
FIG. 3 is a schematic diagram describing a manufacturing method for the card enclosed unit shown in FIG. 1*a* to FIG. 1*e* and FIG. 2*a* to FIG. 2*f;*

FIG. 3 is a schematic diagram describing the manufacturing method for card enclosed unit 1 shown in FIG. 1*a* to FIG. 1*e* and FIG. 2*a* to FIG. 2*f*.

As shown in FIG. 3, card enclosed unit 1 shown in FIG. 1*a* to FIG. 1*e* and FIG. 2*a* to FIG. 2*f* is manufactured in such a manner that upper paper 11, lower paper 12, and support mount paper 20 are successively supplied, adhered to each other, and then cut in pieces.

As shown in FIG. 3, upper paper 11, lower paper 12, and support mount paper 20 are successively pulled out of rollers 60*a* to 60*c* and then PIN code 4*a*, POS code 4*b*, and notification information 21*a* and 21*b* are printed thereon. Thereafter, the lower paper 12 side adhesion surface of upper paper 11 is coated with adhesive agent 50. The upper paper 11 side adhesion surface of lower paper 12 is coated with adhesive agent 50. The support mount paper 20 side adhesion surface of lower paper 12 is coated with release varnish 30. The lower paper 12 side adhesion surface of support mount paper 20 is coated with pseudo adhesive agent 40. The resultant laminate is conveyed to a region where a pair of rollers 61*a* and 61*b* are opposite to each other.

At this point, although PIN code 4*a* and POS code 4*b* have been correlated with each other, since they are simultaneously printed on the support mount paper 20 side adhesion surface of lower paper 12, they are prevented from becoming incompatible.

When information is printed on card 2, card mount paper 10 is conveyed in a curved path of a printer. Thus, if card mount paper 10 is thick, it may not be easily conveyed in the printer. As a result, it is likely that information is not accurately printed on card 2. However, card 2 needs to have a sufficient thickness. To solve this problem, card mount paper 10 is separated into upper paper 11 and lower paper 12. After information is printed on upper paper 11 and lower paper 12, they are adhered to each other so as to form card mount paper 10. As a result, while information can be accurately printed on card 2, it has a sufficient thickness.

When upper paper 11, lower paper 12, and support mount paper 20 are conveyed to the region where a pair of rollers 61*a* and 61*b* are opposite to each other, upper paper 11, lower paper 12, and support mount paper 20 are conveyed while they are pressed by the pair of rollers 61*a* and 61*b*. As a result, upper paper 11, lower paper 12, and support mount paper 20 are adhered to each other.

Thereafter, cutting section 62 cuts a lamination of upper paper 11, lower paper 12, and support mount paper 20 that have been adhered to each other into pieces. At this point, holes 3*a* and 3*b* and slit 5 are simultaneously formed.

The outer shapes of card mount paper 10 and support mount paper 20 of card enclosed unit 1 that has been cut into a piece are the same. When card 2 has not been separated from card mount paper 10, the structure that causes POS code 4*b* to be visible is hole 3*b* that is formed in support mount paper 20. Thus, the overall flatness of card enclosed unit 1 is not affected. This, even if card enclosed units 1 are stacked as pieces into which the laminate is cut and stocked, they will not become unstable. Even when card enclosed units 1 are not stacked, when the units are transported, since the concealment label that conceals PIN code 4*a* will not be caught by a hand or the like, it will not peel off. The flatness of card enclosed unit 1 into which the laminate is cut may be maintained even if the outer shapes of card mount paper 10 and support mount paper 20 are not completely the same, but they may slightly differ from each other.

Next, usage for card enclosed unit 1 will be described.

Figure 4:
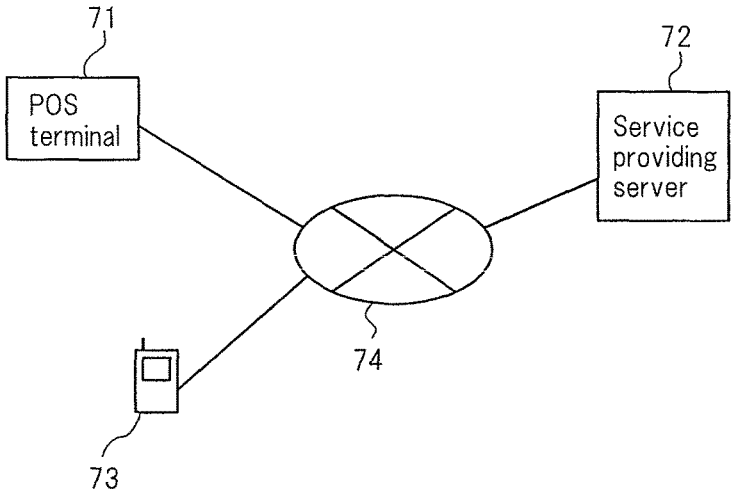
FIG. 4 is a schematic diagram showing the environment where the card enclosed unit shown in FIG. 1*a* to FIG. 1*e* and FIG. 2*a* to FIG. 2*f* is used.
Figure 5:
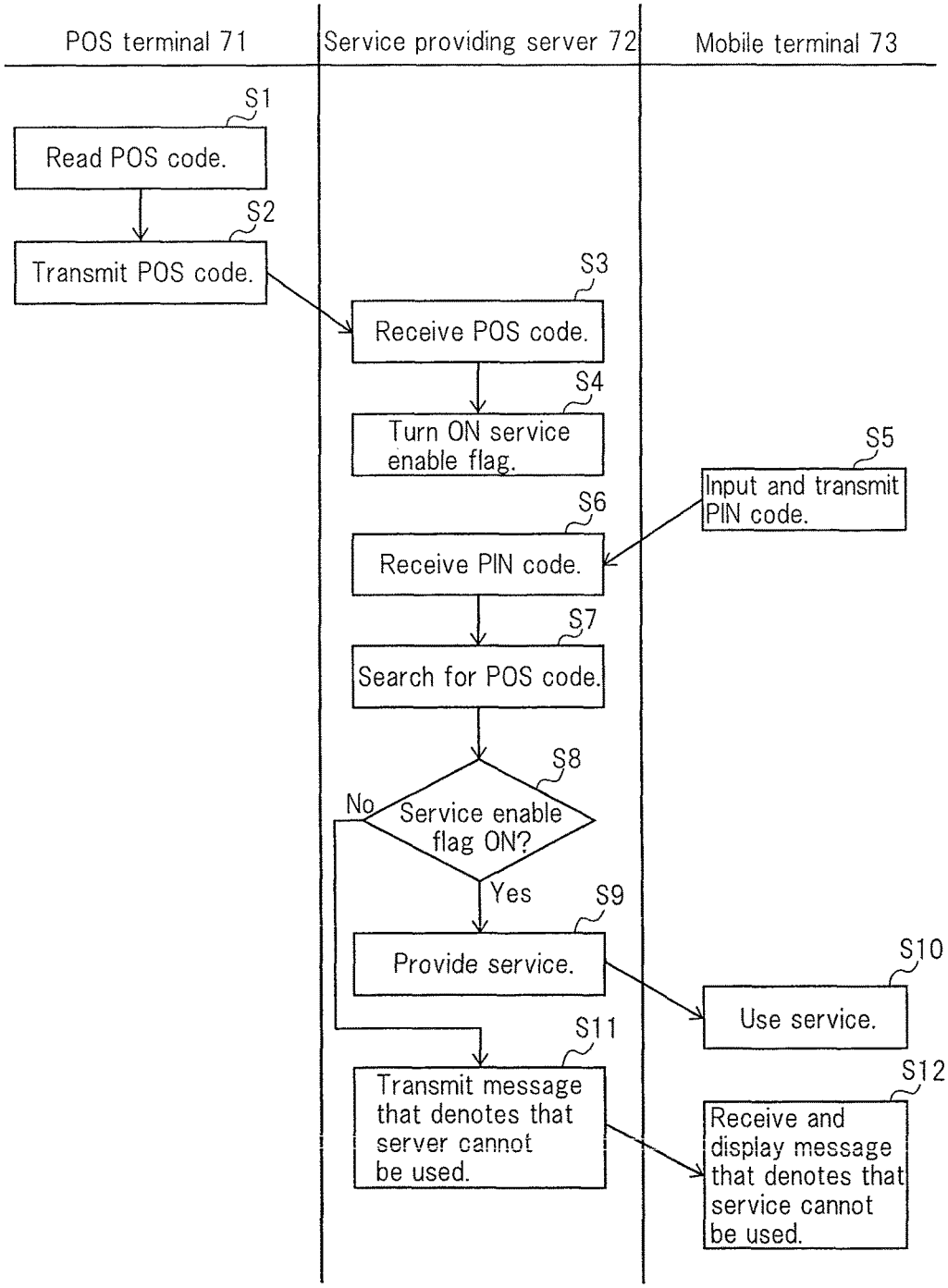
FIG. 5 is a flow chart describing usage for the card enclosed unit shown in FIG. 1*a* to FIG. 1*e* and FIG. 2*a* to FIG. 2*f* in the environment shown in FIG. 4.

FIG. 4 is a schematic diagram showing an environment where card enclosed unit 1 shown in FIG. 1*a* to FIG. 1*e* and FIG. 2*a* to FIG. 2*f* is used; and FIG. 5 is a flow chart describing usage for card enclosed unit 1 shown in FIG. 1*a* to FIG. 1*e* and FIG. 2*a* to FIG. 2*f* in the environment shown in FIG. 4.

As shown in FIG. 4, card enclosed unit 1 shown in FIG. 1*a* to FIG. 1*e* and FIG. 2*a* to FIG. 2*f* is used in an environment where service providing server 72 provides a service using card 2; POS terminal 71 and mobile terminal 73 are connectable to service providing server 72 through communication line 74.

The user purchases card enclosed unit 1 at a store. Thereafter, POS terminal 71 installed at the store reads POS code 4*b* from card enclosed unit 1 (at step 1). As described above, before card 2 is separated from card mount paper 10, since POS code 4*b* is exposed and visible through hole 3*b* that is formed in support mount paper 20, POS terminal 71 can read POS code 4*b*. In addition, before card 2 is separated from card mount paper 10, support mount paper 20 causes PIN code 4*a* to be invisible. Card enclosed unit 1 is displayed at a store in such a manner that card enclosed unit 1 is hung through hole 3*a* that pierces through card enclosed unit 1.

POS code 4*b* that is read from card enclosed unit 1 is transmitted from POS terminal 71 (at step 2) and then received by service providing server 72 through communication line 74 (at step 3).

Service providing server 72 has correlatively managed POS code 4*b* and PIN code 4*a* that are indicated on card mount paper 10 of each card enclosed unit 1. When service providing server 72 receives POS code 4*b*, service providing server 72 sets a service enable flag of POS code 4*b* to "1" that denotes that card enclosed unit 1 can be used and thereby it becomes the ON state (at step 4).

Thereafter, the user who purchased card enclosed unit 1 accesses service providing server 72 with mobile terminal 73 and inputs PIN code 4*a* that is indicated on card 2 of card enclosed unit 1 to mobile terminal 73. Thereafter, mobile terminal 73 transmits PIN code 4*a* to service providing server 72 (at step 5). Thereafter, service providing server 72 receives PIN code 4*a* through communication line 74 (at step 6).

Figure 6A:
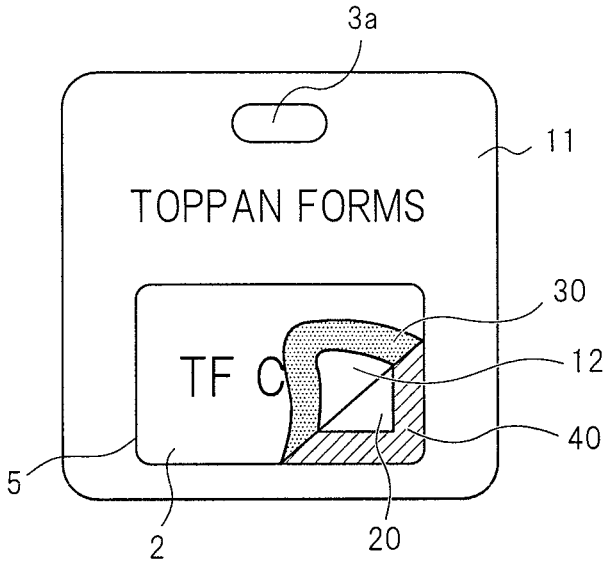
FIG. 6*a* is a schematic diagram showing usage for the card enclosed unit shown in FIG. 1*a* to FIG. 1*e* and FIG. 2*a* to FIG. 2*f;*
Figure 6B:
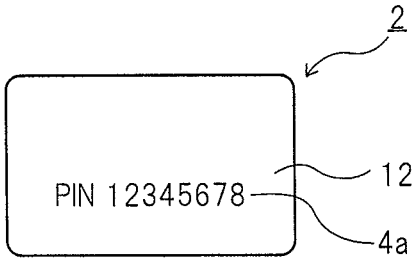
FIG. 6*b* is a schematic diagram showing usage for the card enclosed unit shown in FIG. 1*a* to FIG. 1*e* and FIG. 2*a* to FIG. 2*f;*
Figure 6C:
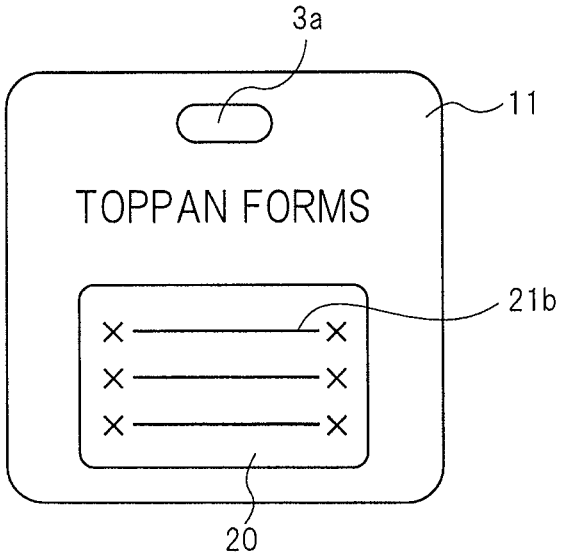
FIG. 6*c* is a schematic diagram showing usage for the card enclosed unit shown in FIG. 1*a* to FIG. 1*e* and FIG. 2*a* to FIG. 2*f;*

FIG. 6*a* to FIG. 6*c* are schematic diagrams showing usage for card enclosed unit 1 shown in FIG. 1*a* to FIG. 1*e* and FIG. 2*a* to FIG. 2*f*.

In card enclosed unit 1 shown in FIG. 1*a* to FIG. 1*e* and FIG. 2*a* to FIG. 2*f*, card 2 is separably enclosed in card mound paper 10 along slit 5 and is peelable from support mount paper 20 by release varnish 30 and pseudo adhesive agent 40. Thus, as shown in FIG. 6*a*, the user who purchased card enclosed unit 1 can separate card 2 from card mount paper 10.

Consequently, as shown in FIG. 6*b*, PIN code 4*a* that is indicated on the support mount paper 20 side adhesion surface of card 2 becomes visible. As a result, the user can input PIN code 4*a* to mobile terminal 73.

When card 2 is separated from card mount paper 10, as shown in FIG. 6*c*, notification information 21*b* that is indicated on the card mount paper 10 side adhesion surface of support mount paper 20 becomes visible.

When service providing server 72 receives PIN code 4*a* from mobile terminal 73, service providing server 72 searches for a POS code correlated with PIN code 4*a* (at step 7). As described above, since service providing server 72 has correlatively managed POS code 4*b* and PIN code 4*a* that are indicated on card mount paper 10 of each card enclosed unit 1, service providing server 72 can search for the POS code correlated with PIN code 4*a* that has been received.

Thereafter, service providing server 72 determines that the service enable flag of the retrieved POS code has been set to "1" and thereby card enclosed unit 1 has been turned ON (at step 8). After card enclosed unit 1 is purchased as described above, POS code 4*b* that is indicated on card mount paper 10 of card enclosed unit 1 is read by POS terminal 71 and the service enable flag of POS code 4*b* is set to "1" and thereby card enclosed unit 1 is turned on by service providing server 72. Thus, when the service enable flag of POS code 4*b* has been set to "1" and thereby card enclosed unit 1 has been turned ON, since it has been legally purchased, service providing server 72 provides a service to mobile terminal 73 (at step 9). Thus, the user can use the service on mobile terminal 73 (at step 10).

If the service enable flag of the retrieved POS code has not been set to "1" and thereby card enclosed unit 1 has not been turned ON, since it has not been legally purchased, service providing server 72 transmits a message that denotes that the service cannot be used to mobile terminal 73 (at step 11).

The message that denotes that the service cannot be used is transmitted from service providing server 72 and then received by mobile terminal 73 through communication line 74. The message is output and displayed on mobile terminal 73 (at step 12).

The foregoing procedure is an example of usage for card enclosed unit 1. Thus, it should be noted that usage for card enclosed unit 1 is not limited to the foregoing.

(Second Embodiment)

Figure 7A:
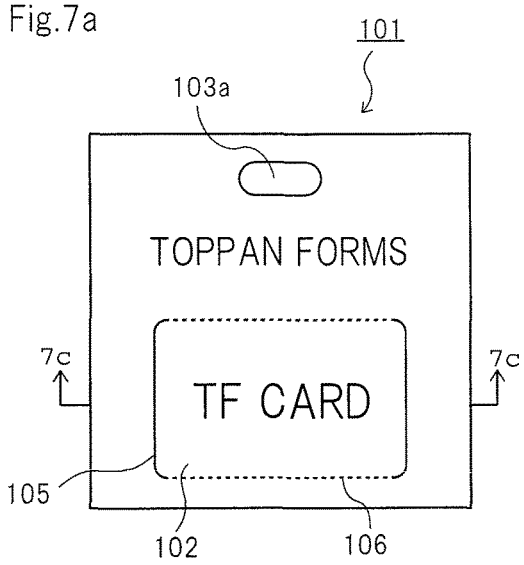
FIG. 7*a* is a front view showing a second embodiment of the present invention.
Figure 7B:
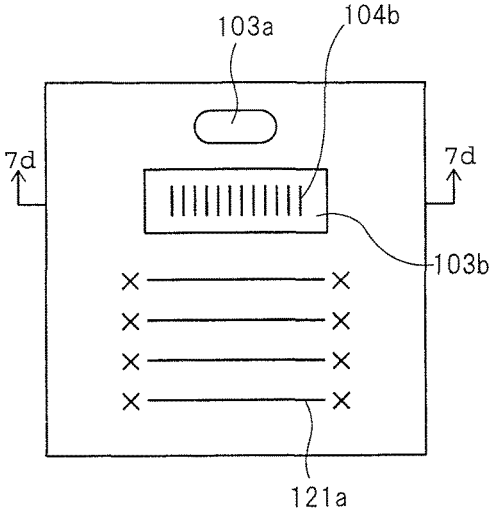
FIG. 7*b* is a rear view showing the second embodiment of the present invention.
Figure 7C:
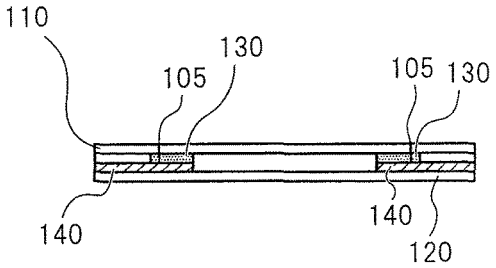
FIG. 7*c* is a sectional view taken along line 7*c*-7*c* of FIG. 7*a;*
Figure 7D:
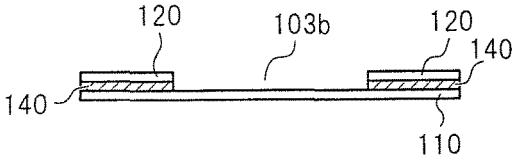
FIG. 7*d* is a sectional view taken along line 7*d*-7*d* of FIG. 7*b;*
Figure 7E:
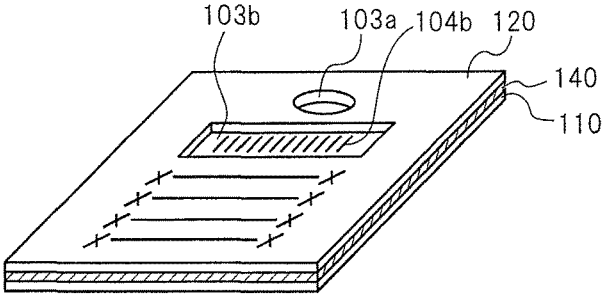
FIG. 7*e* is a perspective view showing that the second embodiment of the present invention is viewed from the rear side.
Figure 8A:
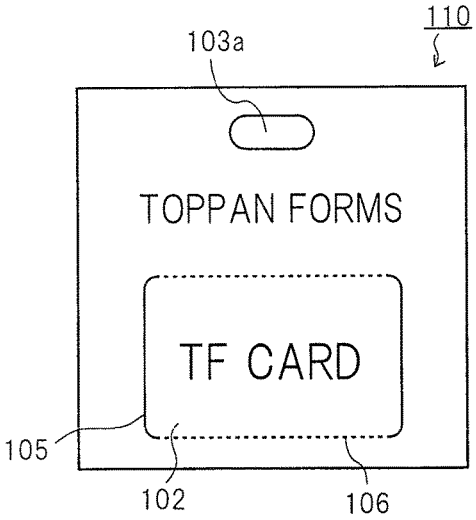
FIG. 8*a* is a front view showing a card mount paper of the card enclosed unit shown in FIG. 7*a* to FIG. 7*e;*
Figure 8B:
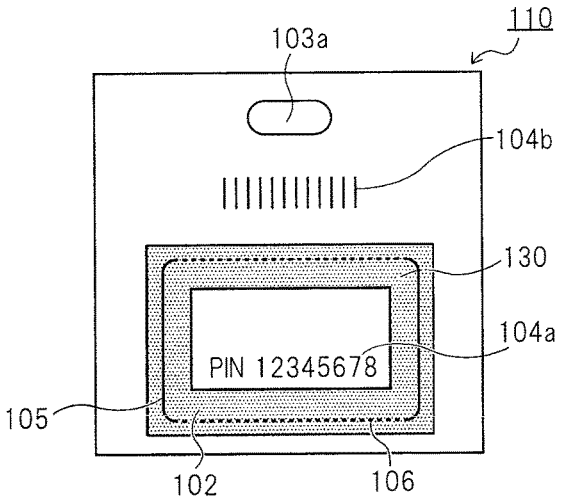
FIG. 8*b* is a rear view showing the card mount paper of the card enclosed unit shown in FIG. 7*a* to FIG. 7*e;*
Figure 8C:
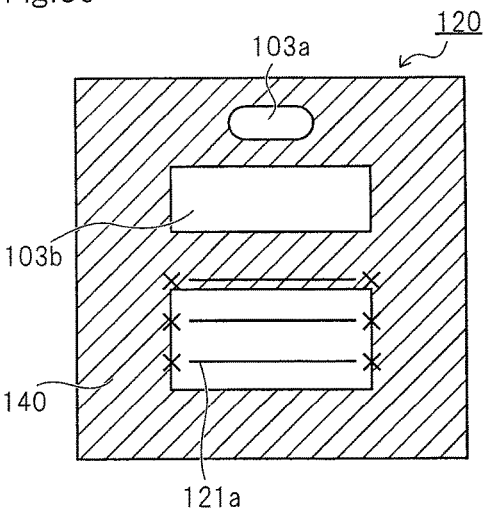
FIG. 8*c* is a front view showing a support mount paper of the card enclosed unit shown in FIG. 7*a* to FIG. 7*e;*
Figure 8D:
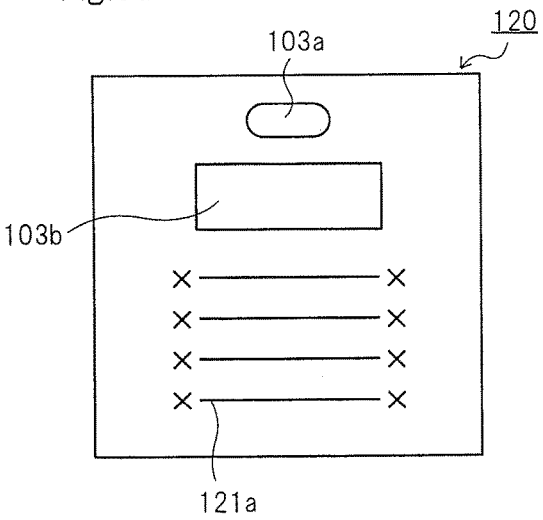
FIG. 8*d* is a rear view showing the support mount paper of the card enclosed unit shown in FIG. 7*a* to FIG. 7*e;*

FIG. 7*a* is a front view showing a second embodiment of the present invention; FIG. 7*b* is a rear view showing the second embodiment of the present invention; FIG. 7*c* is a sectional view taken along line 7*c*-7*c* of FIG. 7*a*; FIG. 7*d* is a sectional view taken along line 7*d*-7*d* of FIG. 7*b*; and FIG. 7*e* is a perspective view showing that the second embodiment of the present invention is viewed from the rear side. FIG. 8*a* is a front view showing card mount paper 110 of card enclosed unit 101 shown in FIG. 7*a* to FIG. 7*e*; FIG. 8*b* is a rear view showing card mount paper 110 of card enclosed unit 101 shown in FIG. 7*a* to FIG. 7*e*; FIG. 8*c* is a front view showing support mount paper 120 of card enclosed unit 101 shown in FIG. 7*a* to FIG. 7*e*; and FIG. 8*d* is a rear view showing support mount paper 120 of card enclosed unit 101 shown in FIG. 7*a* to FIG. 7*e*.

As shown in FIG. 7*a* to FIG. 7*e* and FIG. 8*a* to FIG. 8*d*, card enclosed unit 101 according to the second embodiment is different from card enclosed unit 1 according to the first embodiment in that card mount paper 110 is composed of one sheet, the corners of card mount paper 110 and support mount paper 120 are not round, slit 105 is formed on one opposite sides of four sides of card 102, and micro perforation 106 is formed on the other opposite sides of four sides of card 102.

Card enclosed unit 101 according to the second embodiment is used in the same environment as the first embodiment.

Figure 9A:
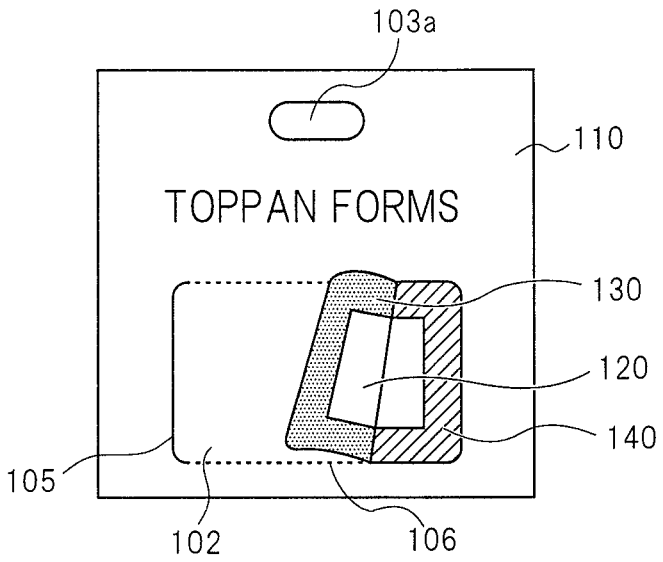
FIG. 9*a* is a schematic diagram showing usage for the card enclosed unit shown in FIG. 7*a* to FIG. 7*e* and FIG. 8*a* to FIG. 8*d;*
Figure 9B:
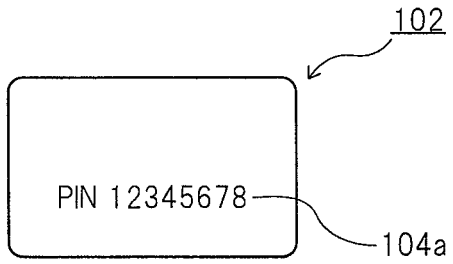
FIG. 9*b* is a schematic diagram showing usage for the card enclosed unit shown in FIG. 7*a* to FIG. 7*e* and FIG. 8*a* to FIG. 8*d;*
Figure 9C:
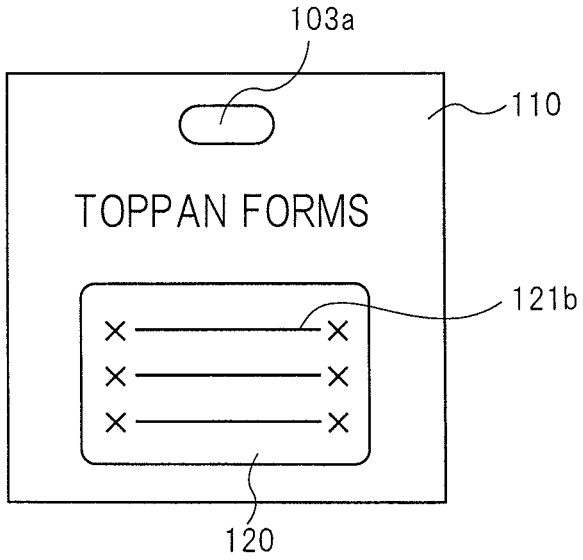
FIG. 9*c* is a schematic diagram showing usage for the card enclosed unit shown in FIG. 7*a* to FIG. 7*e* and FIG. 8*a* to FIG. 8*d;*

FIG. 9*a* to FIG. 9*c* are schematic diagrams showing usage for card enclosed unit 101 shown in FIG. 7*a* to FIG. 7*e* and FIG. 8*a* to FIG. 8*d*.

In card enclosed unit 101 shown in FIG. 7*a* to FIG. 7*e* and FIG. 8*a* to FIG. 8*d*, card 102 is separably enclosed in card mount paper 110 along slit 105 and micro perforation 106 and is peelable from support mount paper 120 by release varnish 130 and pseudo adhesive agent 140. Thus, as shown in FIG. 9*a*, the user who purchased card enclosed unit 101 can break micro perforation 106 from the sides of slit 105 and separate card 102 from card mount paper 110. According to this embodiment, since slit 105 is formed on opposite sides of four sides of card 102 and micro perforation 106 is formed on the other opposite sides of four sides of card 102, card 102 can be prevented from being accidentally separated from card mount paper 110 compared with the structure in which slit 105 is formed on all four sides of card 102.

Consequently, as shown in FIG. 9*b*, PIN code 104*a* that is indicated on the support mount paper 120 side adhesion surface of card 102 becomes visible. In addition, as shown in FIG. 9*c*, notification information 21*b* that is indicated on the card mount paper 110 side adhesion surface of support mount paper 120 becomes visible.

When the user inputs PIN code 104*a* that becomes visible to mobile terminal 73 and transmits PIN code 104*a* to service providing server 72, he or she can use a service that service providing server 72 provides.

(Third Embodiment)

Figure 10A:
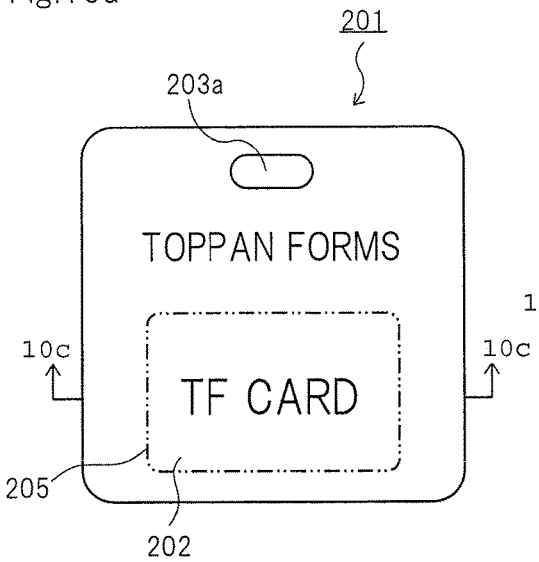
FIG. 10*a* is a front view showing a third embodiment of the present invention.
Figure 10B:
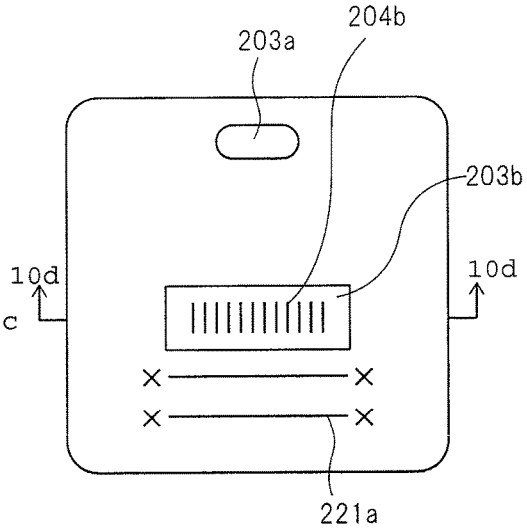
FIG. 10*b* is a rear view showing the third embodiment of the present invention.
Figure 10C:
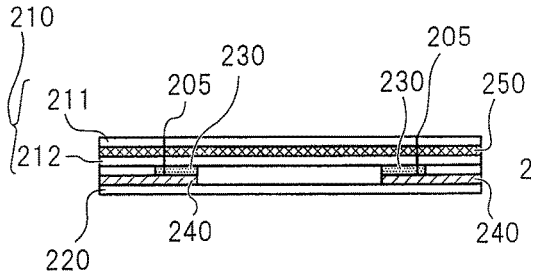
FIG. 10*c* is a sectional view taken along line 10*c*-10*c* of FIG. 10*a;*
Figure 10D:
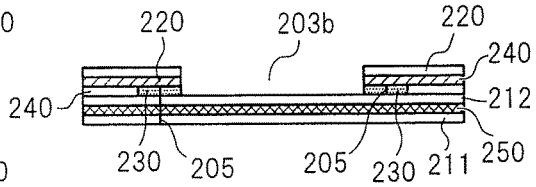
FIG. 10*d* is a sectional view taken along line 10*d*-10*d* of FIG. 10*b;*
Figure 10E:
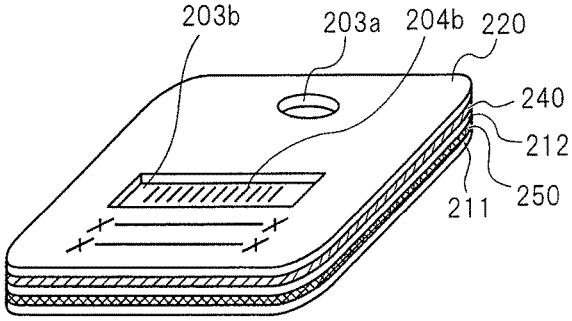
FIG. 10*e* is a perspective view showing that the third embodiment of the present invention is viewed from the rear side.
Figure 11A:
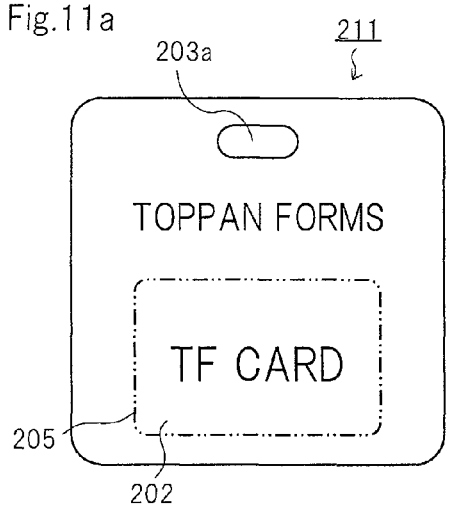
FIG. 11*a* is a front view showing an upper paper of the card enclosed unit shown in FIG. 10*a* to FIG. 10*e;*
Figure 11B:
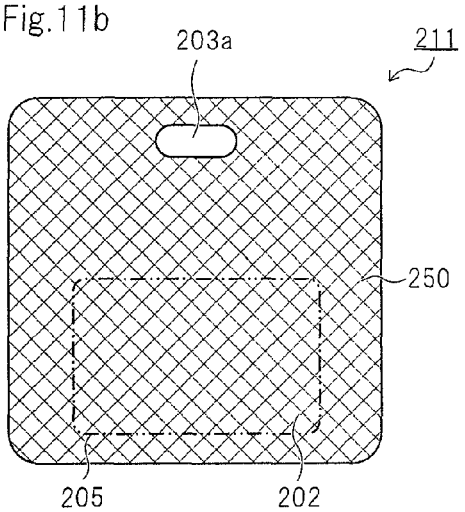
FIG. 11*b* is a rear view showing the upper paper of the card enclosed unit shown in FIG. 10*a* to FIG. 10*e;*
Figure 11C:
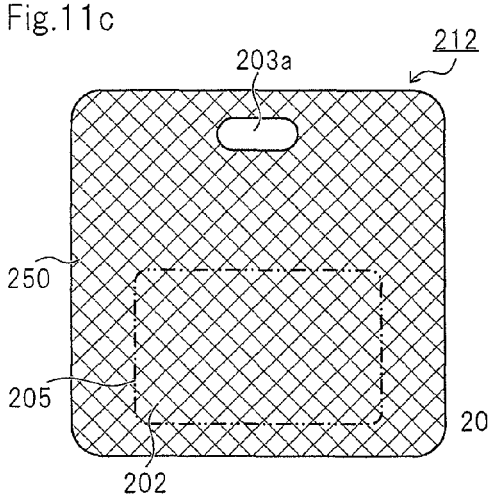
FIG. 11*c* is a front view showing a lower paper of the card enclosed unit shown in FIG. 10*a* to FIG. 10*e;*
Figure 11D:
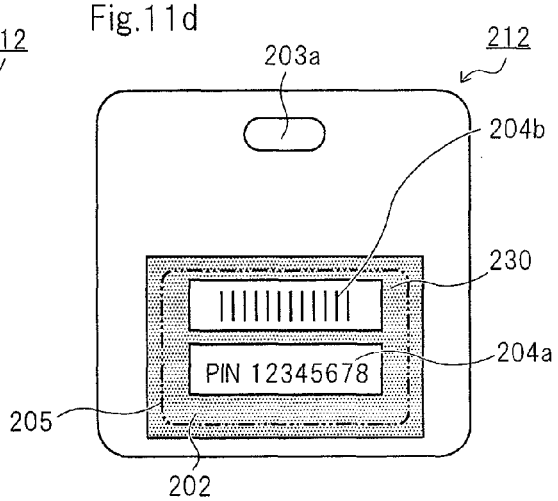
FIG. 11*d* is a rear view showing the lower paper of the card enclosed unit shown in FIG. 10*a* to FIG. 10*e;*
Figure 11E:
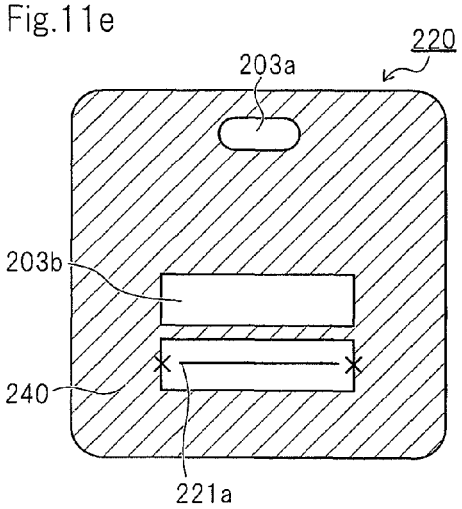
FIG. 11*e* is a front view showing a support mount paper of the card enclosed unit shown in FIG. 10*a* to FIG. 10*e;*
Figure 11F:
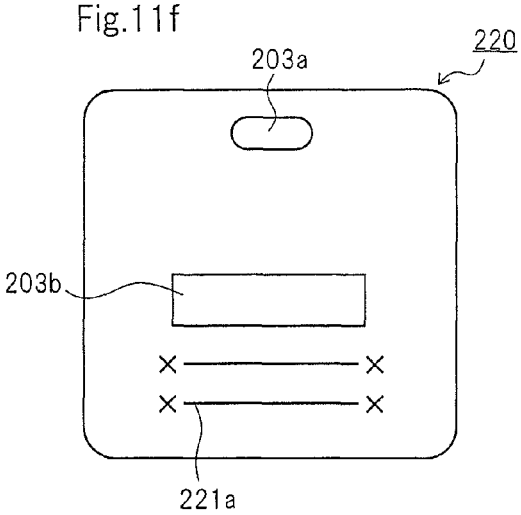
FIG. 11*f* is a rear view showing the support mount paper of the card enclosed unit shown in FIG. 10*a* to FIG. 10*e;*

FIG. 10*a* is a front view showing a third embodiment of the present invention; FIG. 10*b* is a rear view showing the third embodiment of the present invention; FIG. 10*c* is a sectional view taken along line 10*c*-10*c* of FIG. 10*a*; FIG. 10*d* is a sectional view taken along line 10*d*-10*d* of FIG. 10*b*; and FIG. 10*e* is a perspective view showing that the third embodiment of the present invention is viewed from the rear side. FIG. 11*a* is a front view showing upper paper 211 of card enclosed unit 201 shown in FIG. 10*a* to FIG. 10*e*; FIG. 11*b* is a rear view showing upper paper 211 of card enclosed unit 201 shown in FIG. 10*a* to FIG. 10*e*; FIG. 11*c* is a front view showing lower paper 212 of card enclosed unit 201 shown in FIG. 10*a* to FIG. 10*e*; FIG. 11*d* is a rear view showing lower paper 212 of card enclosed unit 201 shown in FIG. 10*a* to FIG. 10*e*; FIG. 11*e* is a front view showing support mount paper 220 of card enclosed unit 201 shown in FIG. 10*a* to FIG. 10*e*; and FIG. 11*f* is a rear view showing support mount paper 220 of card enclosed unit 201 shown in FIG. 10*a* to FIG. 10*e*.

As shown in FIG. 10*a* to FIG. 10*e* and FIG. 11*a* to FIG. 11*f*, card enclosed unit 201 according to the third embodiment is different from card enclosed unit 1 according to the first embodiment in that POS code 204*b* is indicated on card 202, hole 203*b* is formed in support mount paper 220 such that hole 203*b* is opposite to POS code 204*b*, perforation 205 having a tie portion is formed instead of slit 5 in upper paper 211, a region between POS code 204*b* and PIN code 204*a* on lower paper 212 is coated with release varnish 230, and release varnish 230 is also applied to a region of support mount paper 220 such that the region is opposite to the release varnish 230 region on lower paper 213.

Card enclosed unit 201 according to the third embodiment is used in the same environment as the first embodiment.

Figure 12A:
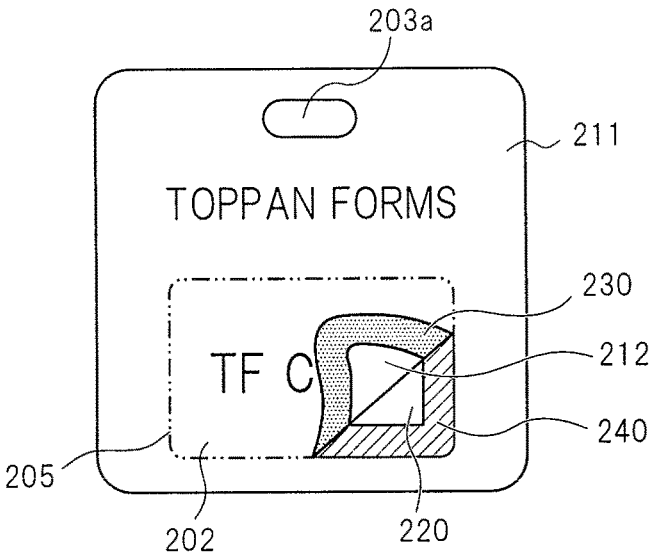
FIG. 12*a* is a schematic diagram showing usage for the card enclosed unit shown in FIG. 10*a* to FIG. 10*e* and FIG. 11*a* to FIG. 11*f;*
Figure 12B:
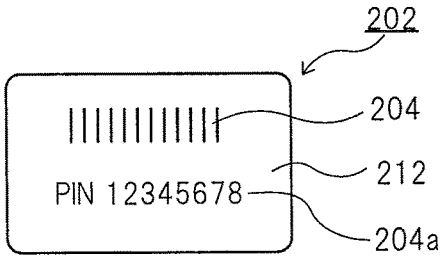
FIG. 12*b* is a schematic diagram showing usage for the card enclosed unit shown in FIG. 10*a* to FIG. 10*e* and FIG. 11*a* to FIG. 11*f;*
Figure 12C:
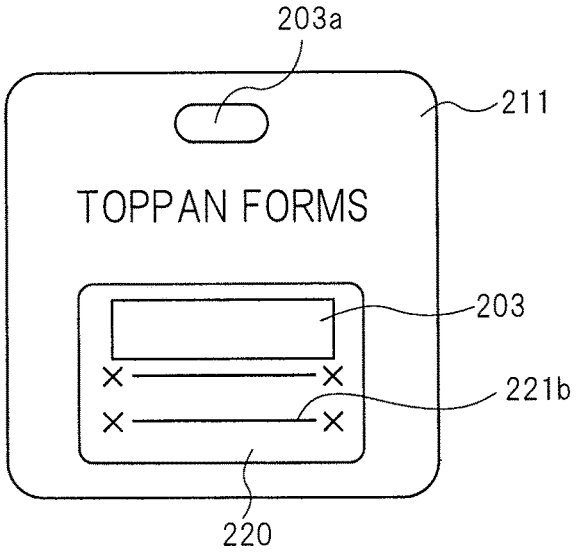
FIG. 12*c* is a schematic diagram showing usage for the card enclosed unit shown in FIG. 10*a* to FIG. 10*e* and FIG. 11*a* to FIG. 11*f;*

FIG. 12*a* to FIG. 12*c* are schematic diagrams showing usage for card enclosed unit 201 shown in FIG. 10*a* to FIG. 10*e* and FIG. 11*a* to FIG. 11*f*.

In card enclosed unit 201 shown in FIG. 10*a* to FIG. 10*e* and FIG. 11*a* to FIG. 11*f*, card 202 is separably enclosed in card mount paper 210 along perforation 205 and is peelable from support mount paper 220 by release varnish 230 and pseudo adhesive agent 240. Thus, as shown in FIG. 12*a*, the user who purchased card enclosed unit 201 can break perforation 205 and separate card 202 from card mount paper 210. Before card 202 is separated from card mount paper 210, POS code 204*b* that is indicated on the support mount paper 220 side adhesion surface of card 202 is exposed and is visible through hole 203*b* formed in support mount paper 220. Like the first embodiment, when card enclosed unit 201 is purchased, POS code 204*b* can be read by POS terminal 71. According to this embodiment, since card 202 is separated from card mount paper 210 by perforation 205 instead of a slit and since card mount paper 210 and support mount paper 220 are peelably adhered in the region between POS code 204*b* and PIN code 204*a* on lower paper 212 with pseudo adhesive agent 240 and release varnish 230, card 202 can be prevented from being accidentally separated from card mount paper 210.

When card 202 is separated from card mount paper 210, as shown in FIG. 12*b*, PIN code 204*a* that is indicated on the support mount paper 220 side adhesion surface of card 202 becomes visible. In addition, as shown in FIG. 12*c*, notification information 221*b* that is indicated on the card mount paper 210 side adhesion surface of support mount paper 220 becomes visible.

When the user inputs PIN code 204*a* that becomes visible to mobile terminal 73 and transmits PIN code 204*a* to service providing server 72, he or she can use a service that service providing server 72 provides.

(Fourth Embodiment)

Figure 13A:
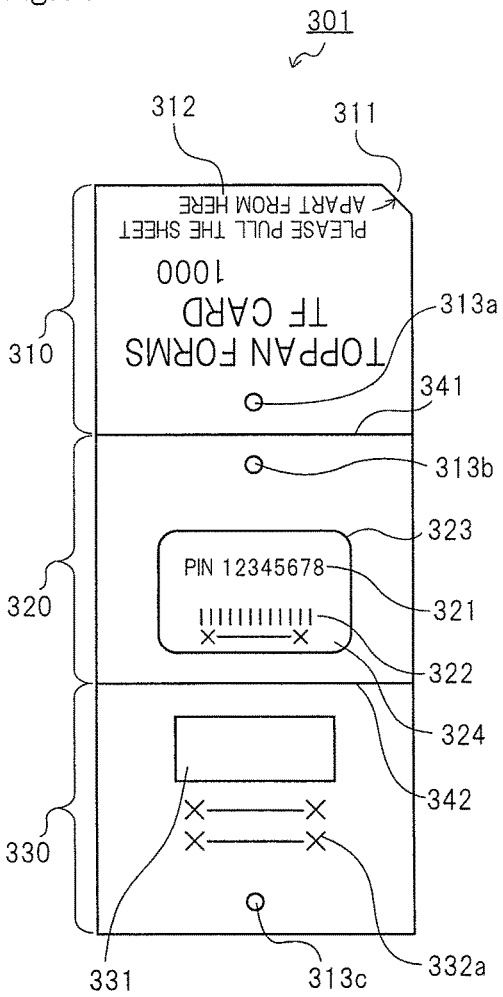
FIG. 13*a* is a front view showing that a fourth embodiment of the present invention has been unfolded.
Figure 13B:
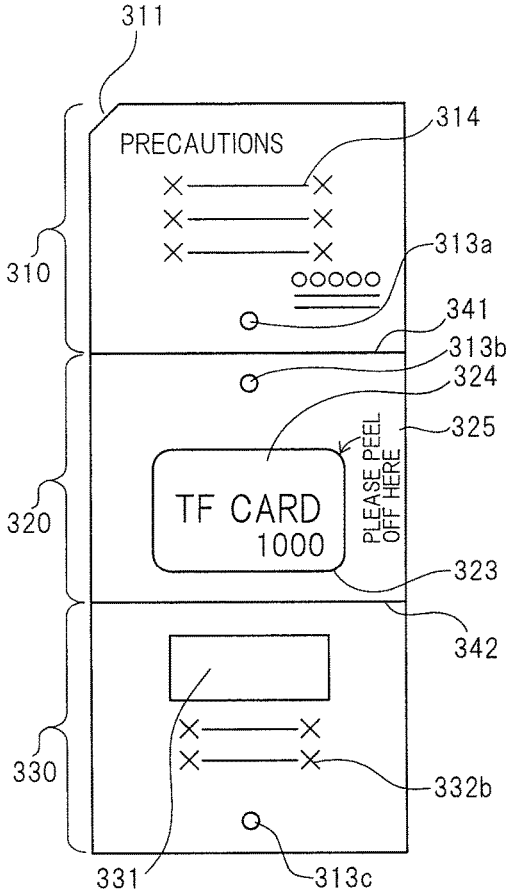
FIG. 13*b* is a rear view showing that the fourth embodiment of the present invention has been unfolded.
Figure 13C:
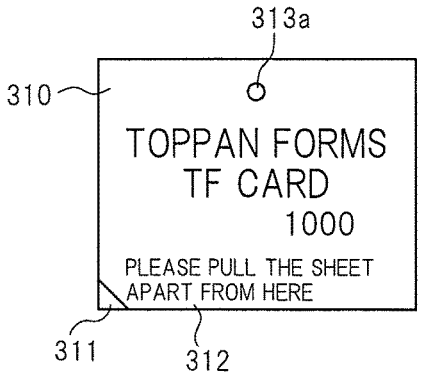
FIG. 13*c* is a front view showing that the fourth embodiment of the present invention has been folded.
Figure 13D:
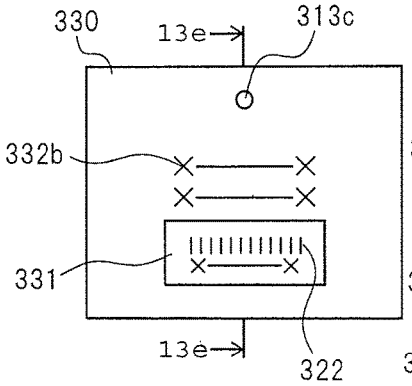
FIG. 13*d* is a rear view showing that the fourth embodiment of the present invention has been folded.
Figure 13E:
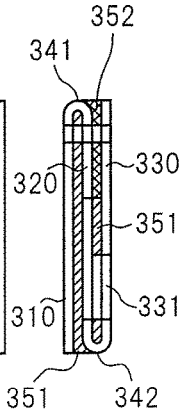
FIG. 13*e* is a sectional view taken along line 13*e*-13*e* of FIG. 13*d;*

FIG. 13*a* is a front view showing that a fourth embodiment of the present invention has been unfolded; FIG. 13*b* is a rear view showing that the fourth embodiment of the present invention has been unfolded; FIG. 13*c* is a front view showing that the fourth embodiment of the present invention has been folded; FIG. 13*d* is a rear view showing that the fourth embodiment of the present invention has been folded; and FIG. 13*e* is a sectional view taken along line 13*e*-13*e* of FIG. 13*d*.

As shown in FIG. 13*a* to FIG. 13*d*, card enclosed unit 301 according to the fourth embodiment has first sheet 310, second sheet 320, and third sheet 330 that are successively folded along folds 341 and 342. The shapes of three sheets 310, 320, and 330 are the same.

Hole 313*a* that pierces through sheet 310 is formed in a region along fold 341. Notch 311 is formed at a corner opposite to fold 341 of sheet 310. Notification information 312 that denotes that sheet 310 can be peeled off from sheet 320 at notch 311 after card enclosed unit 301 is folded and after sheet 310 is adhered to sheet 320 is indicated on the front surface of sheet 310. In addition, notification information 314 is indicated on the rear surface of sheet 310.

Slit 323 is formed in sheet 320 such that card 324 is separably enclosed in sheet 320 along slit 323. Hole 313*b* that pierces through sheet 320 is formed such that hole 313*b* is opposite to hole 313*a* formed in sheet 310 when sheets 310 and 320 are folded along fold 341. PIN code 321 that is a first code and POS code 322 that is a second code are indicated on the front surface of the region of card 324 enclosed in sheet 320. As will be described later, PIN code 321 and POS code 322 have been correlated with each other. In addition, notification information 325 that represents a peel-off position at which card 324 can be peeled off from sheet 330 after card enclosed unit 301 is folded and after sheet 320 is adhered to third sheet 330 is indicated in the non-card region of the rear surface of sheet 320.

Hole 313*c* that pierces through sheet 330 is formed such that hole 313*c* is opposite to holes 313*a* and 313*b* formed in sheets 310 and 320, respectively when sheets 310, 320, and 330 are folded along folds 341 and 342. In addition, hole 331 that pierces through sheet 330 is formed such that hole 331 is opposite to POS code 322 when sheets 320 and 330 are folded along fold 342. In addition, notification information 332*a* and 332*b* are indicated on the front surface and the rear surface of sheet 330, respectively.

Sheets 310, 320, and 330 are folded along folds 341 and 342 in a Z shape in such a manner that the surface on which notification information 314 is indicated of sheet 310 is opposite to sheet 320 and that the surface on which PIN code 321 and POS code 322 are indicated of sheet 320 is opposite to sheet 330. Thereafter, sheets 310, 320, and 330 are adhered to each other with pseudo adhesive agent 351 and adhesive agent 352. The opposite surfaces of sheet 310 and sheet 320 are fully coated with pseudo adhesive agent 351. Thus, sheet 310 and sheet 320 are fully peelably coated with pseudo adhesive agent 351. On the other hand, the opposite surfaces of card 324 and sheet 330 of the opposite surface of sheet 320 and sheet 330 are peelably adhered to each other with pseudo adhesive agent 351. As a result, sheet 330 and card 324 enclosed in sheet 320 are peelably adhered to each other with pseudo adhesive agent 351. In other words, card 324 is separable from sheets 320 and 330 by both slit 323 formed in sheet 320 and pseudo adhesive agent 351. Pseudo adhesive agent 351 may be applied before or after information including PIN code 321 and POS code 322 is printed. The opposite surfaces other than the region of card 324 enclosed in sheet 320 and sheet 330 are coated with adhesive agent 352. As a result, sheet 320 and sheet 330 are adhered to each other with adhesive agent 352 such that they are not easily peeled off except for the region of card 324. The post-adhesion peel-off difficulty state denotes that sheet 320 and sheet 330 are strongly adhered to each other such that when they are manually peeled off, sheet 320 and sheet 330 may tear or break in the thickness direction. In this folded state, since sheet 330 covers PIN code 321, it becomes invisible. In contrast, POS code 322 becomes visible through hole 331 formed in sheet 330.

Next, usage for card enclosed unit 301 having the foregoing structure will be described. Card enclosed unit 301 according to the fourth embodiment is used in the same environment as the first embodiment.

Figure 14:
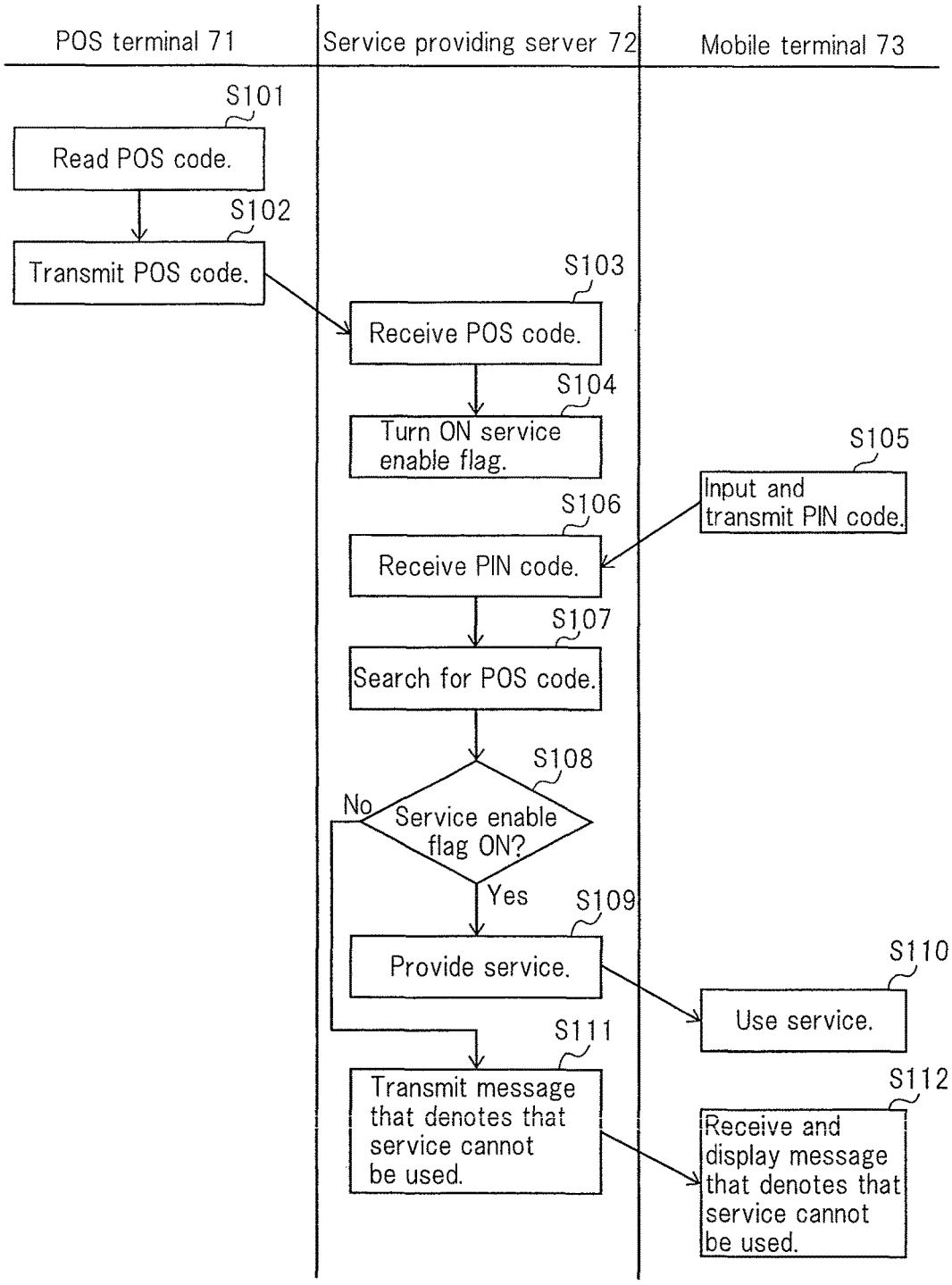
FIG. 14 is a flow chart describing usage for the card enclosed unit shown in FIG. 13*a* to FIG. 13*e* in the environment shown in FIG. 4.

FIG. 14 is a flow chart describing for card enclosed unit 301 shown in FIG. 13*a* to FIG. 13*e* in the environment shown in FIG. 4.

The user purchases card enclosed unit 301 at a store. Thereafter, POS terminal 71 installed at the store reads POS code 322 from card enclosed unit 301 (at step 101). Although card enclosed unit 301 is sold in the folded state as shown in FIG. 13*c* and FIG. 13*d* as described above, when card enclosed unit 301 has been folded, since POS code 322 is visible through hole 331 formed in sheet 330, POS terminal 71 can read POS code 322. In addition, when card enclosed unit 301 has been folded, since sheet 330 covers PIN code 321, it becomes invisible.

Card enclosed unit 301 is displayed at a store in such a manner that card enclosed unit 301 is hung through holes 313*a*, 313*b*, and 313*c* that pierce through sheets 310, 320, and 330, respectively. In this state, since sheet 310 and sheet 330 are adhered to the front and rear surfaces of sheet 320 enclosing card 324, it is difficult to illegally separate card 324 from sheet 320.

POS code 322 that is read from card enclosed unit 301 is transmitted from POS terminal 71 (at step 102) and then is received by service providing server 72 through communication line 74 (at step 103).

Service providing server 72 has correlatively managed PIN code 321 and POS code 322 that are indicated on card 324 of each card enclosed unit 301. When service providing server 72 receives POS code 322, service providing server 72 sets a service enable flag of POS code 322 to "1" that denotes that card enclosed unit 301 can be used and thereby it becomes the ON state (at step 104).

Thereafter, the user who purchased card enclosed unit 301 accesses service providing server 72 with mobile terminal 73 and inputs PIN code 321 that is indicated on card 324 of card enclosed unit 301 to mobile terminal 73. Thereafter, mobile terminal 73 transmits PIN code 321 to service providing server 72 (at step 105). Thereafter, service providing server 72 receives PIN code 321 through communication line 74 (at step 106).

FIG. 15*a* to FIG. 15*e* are schematic diagrams showing usage for card enclosed unit 301 shown in FIG. 13*a* to FIG. 13*e*.

Figure 15A:
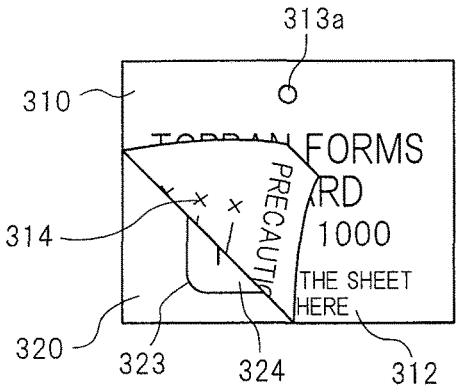
FIG. 15*a* is a schematic diagram showing usage for the card enclosed unit shown in FIG. 13*a* to FIG. 13*e;*
Figure 15B:
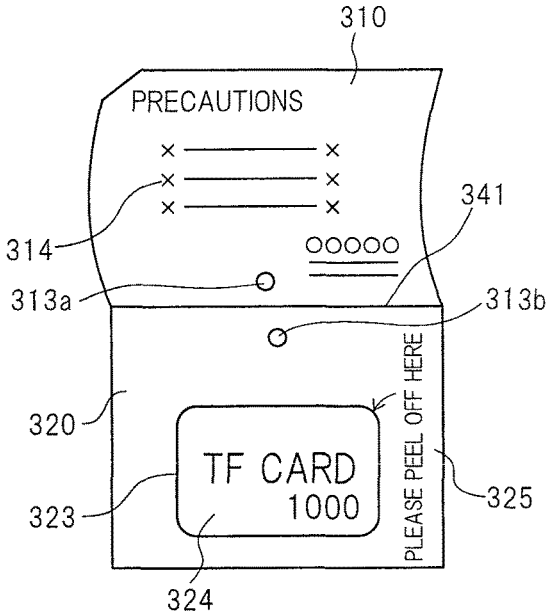
FIG. 15*b* is a schematic diagram showing usage for the card enclosed unit shown in FIG. 13*a* to FIG. 13*e;*
Figure 15C:
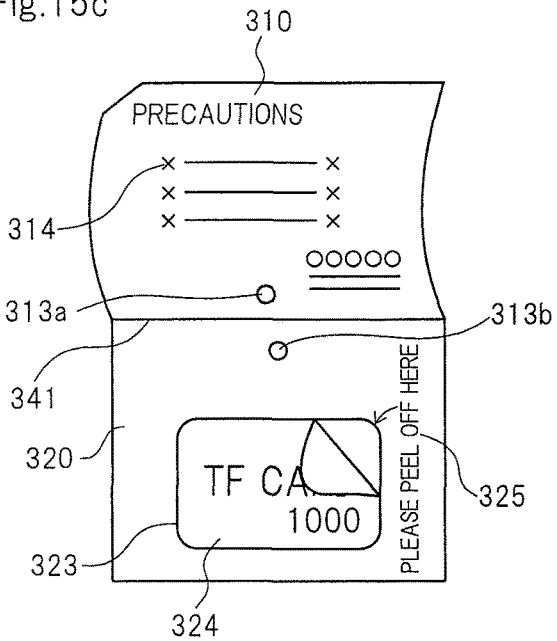
FIG. 15*c* is a schematic diagram showing usage for the card enclosed unit shown in FIG. 13*a* to FIG. 13*e;*
Figure 15D:
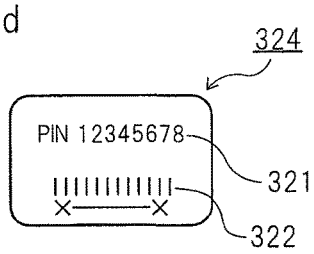
FIG. 15*d* is a schematic diagram showing usage for the card enclosed unit shown in FIG. 13*a* to FIG. 13*e;*

In card enclosed unit 301 shown in FIG. 13*a* to FIG. 13*e*, since sheet 320 enclosing card 324 is peelably adhered to sheet 310, when the user who purchased card enclosed unit 301 peels off sheet 310 from sheet 320 as shown in FIG. 15*a*, he or she can unseal card enclosed unit 301 and cause card 324 to be exposed as shown in FIG. 15*b*. At this point, the user peels off sheet 310 from sheet 320 using notch 311 as the peel start edge according to notification information 312 that is indicated on sheet 310. In other words, the unsealing structure according to this embodiment is realized in such a manner that sheets 310 and 320 are peelably adhered to each other with pseudo adhesive agent 351.

When sheet 310 is peeled off from sheet 320, card 324 is exposed and notification information 314 that is indicated on the rear surface of sheet 310 becomes visible.

In card enclosed unit 301 shown in FIG. 13*a* to FIG. 13*e*, card 324 is separably enclosed in sheet 320 along slit 323 and is peelable from sheet 330 by pseudo adhesive agent 351. Thus, when the user who purchased card enclosed unit 301 unseals card enclosed unit 301 and causes card 324 to be exposed, as shown in FIG. 13*c*, he or she can separate card 324 from sheet 320. At this point, the user peels off card 324 from sheet 330 and separates card 324 from sheet 320 according to notification information 325 that is indicated on sheet 310. Alternatively, release varnish may be applied to at least the region on which PIN code 321 and POS code 322 are not indicated on the sheet 330 side adhesion surface of card 324 such that only card 324 enclosed in sheet 320 is peelable from sheet 330.

Consequently, as shown in FIG. 13*d*, PIN code 321 that is indicated on the sheet 330 side adhesion surface of card 324 becomes visible. As a result, the user can input PIN code 321 to mobile terminal 73.

Figure 15E:
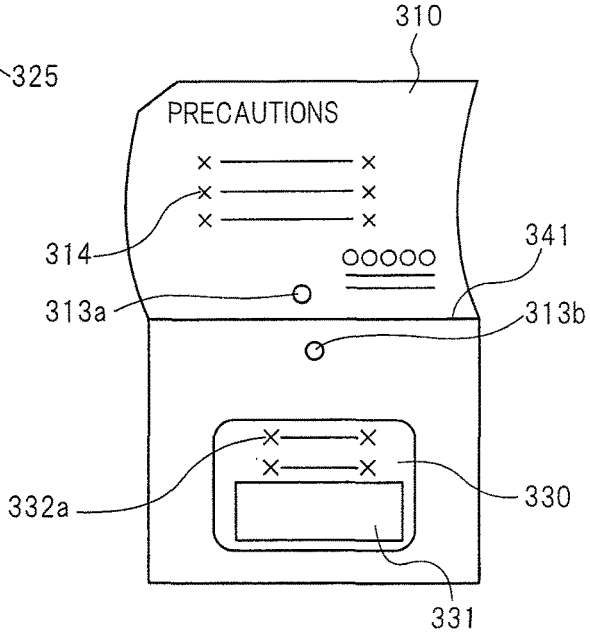
FIG. 15*e* is a schematic diagram showing usage for the card enclosed unit shown in FIG. 13*a* to FIG. 13*e;*

When card 324 is separated from sheet 320, as shown in FIG. 15*e*, notification information 332*a* that is indicated on the sheet 320 side adhesion surface of sheet 330 becomes visible.

When service providing server 72 receives PIN code 321 from mobile terminal 73, service providing server 72 searches for a POS code correlated with PIN code 321 (at step 107). Since service providing server 72 has correlatively managed PIN code 321 and POS code 322 that are indicated on card 324 of each card enclosed unit 301, service providing server 72 can search for the POS code correlated with PIN code 321 that has been received.

Thereafter, service providing server 72 determines that the service enable flag of the retrieved POS code has been set to "1" and thereby card enclosed unit 301 has been turned ON (at step 108). When card enclosed unit 301 is purchased, POS code 322 that is indicated on card 324 of card enclosed unit 301 is read by POS terminal 71 and the service enable flag of POS code 322 is set to "1" and thereby card enclosed unit 301 is turned ON by service providing server 72. Thus, when the service enable flag of POS code 322 has been set to "1" and thereby card enclosed unit 301 has been turned ON, since card enclosed unit 301 has been legally purchased, service providing server 72 provides a service to mobile terminal 73 (at step 109). Thus, the user can use the service on mobile terminal 73 (at step 110).

If the service enable flag of the retrieved POS code has not been set to "1" and thereby card enclosed unit 301 has not been turned ON, since the card enclosed unit 301 has not been legally purchased, service providing server 72 transmits a message that denotes that the service cannot be used to mobile terminal 73 (at step 111).

The message that denotes that the service cannot be used is transmitted from service providing server 72 and then received by mobile terminal 73 through communication line 74. The message is output and displayed on mobile terminal 73 (at step 112).

As described above, since both POS code 322 that allows card 324 to be used and PIN code 321 that is designated when the service is used with card 324 are indicated on sheet 320, POS code 322 and PIN code 321 can be simultaneously printed and thereby they can be prevented from becoming incompatible. In this structure, before card 324 is separated from card enclosed unit 301, POS code 322 is visible, but PIN code 321 is invisible.

According to this embodiment, sheet 310 and sheet 320 are fully peelably adhered to each other with pseudo adhesive agent 351. When sheet 310 is peeled off from sheet 320, card 324 is exposed. Thereafter, card 324 is peeled off from sheet 330 and separated therefrom. Alternatively, sheet 320 and sheet 330 may be fully peelably adhered to each other. Thereafter, sheet 330 may be peeled off from sheet 320 so as to expose card 324. Thereafter, card 324 may be peeled off from sheet 310 and separated from sheet 320. In this case, the unsealing structure is realized in such a manner that sheets 320 and 330 are peelably adhered to each other.

According to this embodiment, the shapes of three sheets 310, 320, and 330 are the same. Alternatively, the shapes and sizes of sheets 310, 320, and 330 may be different from each other. The shape (a shape, a size) can be designed suitably so that required regions that conceal PIN code 321 and form hole 331 and so forth are secured.

(Fifth Embodiment)

Figures 16A, 16B, 16C, 16D, 16E:
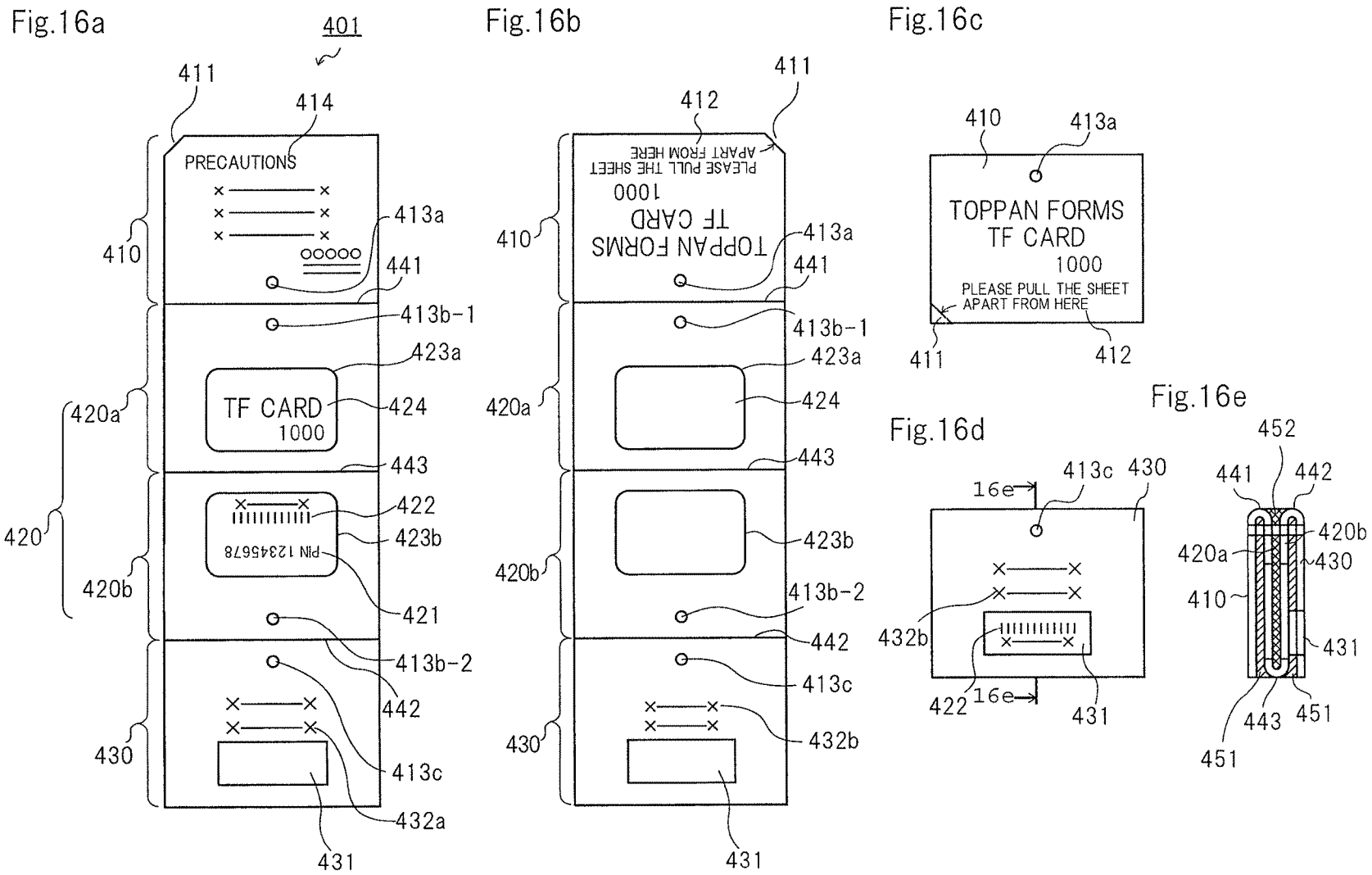
FIG. 16*a* is a front view showing that a fifth embodiment of the present invention has been fully unfolded.
FIG. 16*b* is a rear view showing that the fifth embodiment of the present invention has been fully unfolded.
FIG. 16*c* is a front view showing that the fifth embodiment of the present invention has been fully folded.
FIG. 16*d* is a rear view showing that the fifth embodiment of the present invention has been fully folded.
FIG. 16*e* is a sectional view taken along line 16*e*-16*e* of FIG. 16*d;*

FIG. 16*a* is a front view showing that a fifth embodiment of the present invention has been fully unfolded; FIG. 16*b* is a rear view showing that the fifth embodiment of the present invention has been fully unfolded; FIG. 16*c* is a front view showing that the fifth embodiment of the present invention has been fully folded; FIG. 16*d* is a rear view showing that fifth embodiment of the present invention has been fully folded; and FIG. 16*e* is a sectional view taken along line 16*e*-16*e* of FIG. 16*d*.

As shown in FIG. 16*a* to FIG. 16*e*, card enclosed unit 401 according to the fifth embodiment is different from card enclosed unit 301 according to the fourth embodiment in that sheet 420 has a two-sheet structure composed of front piece 420*a* and rear piece 420*b* that are adhered to each other with adhesive agent 452.

Front piece 420*a* and rear piece 420*b* are connected through fold 443. In addition, holes 413*b*-1 and 413*b*-2 and slits 423*a* and 423*b* are formed such that when front piece 420*a* and rear piece 420*b* are folded along fold 443, holes 413*b*-1 and 413*b*-2 are opposite to each other and slits 423*a* and 423*b* are opposite to each other. Front piece 420*a* and rear piece 420*b* are folded along fold 443 such that the surface on which PIN code 421 and POS code 422 are indicated faces outside. Front piece 420*a* and rear piece 420*b* are adhered to each other with adhesive agent 452 and thereby sheet 420 is formed.

Three sheets 410, 420, and 430 are unfoldably folded along folds 441 and 442 such that the surface on which notification information 414 is indicated on sheet 410 is opposite to sheet 420 and the surface on which PIN code 421 and POS code 422 are indicated of sheet 420 is opposite to sheet 430. Thereafter, sheets 410, 420, and 430 are adhered to each other with pseudo adhesive agent 451 and adhesive agent 452.

Card enclosed unit 401 according to the fifth embodiment is used in the same manner as card enclosed unit 301 according to the fourth embodiment. In other words, card enclosed unit 401 according to the fifth embodiment is the same as card enclosed unit 301 according to the fourth embodiment except that sheet 420 has the two-sheet structure composed of front piece 420*a* and rear piece 420*b*.

According to this embodiment, the shapes of two sheets 410 and 430 and sheet 420 composed of front piece 420*a* and rear piece 420*b* that are folded are the same. Alternatively, the shapes and sizes of sheets 410, 420, and 430 may be different from each other. The shape (a shape, a size) can be designed suitably so that required regions that conceal PIN code 421 and form hole 431 and so forth are secured.

(Sixth Embodiment)

Figures 17A, 17B, 17C, 17D, 17E:
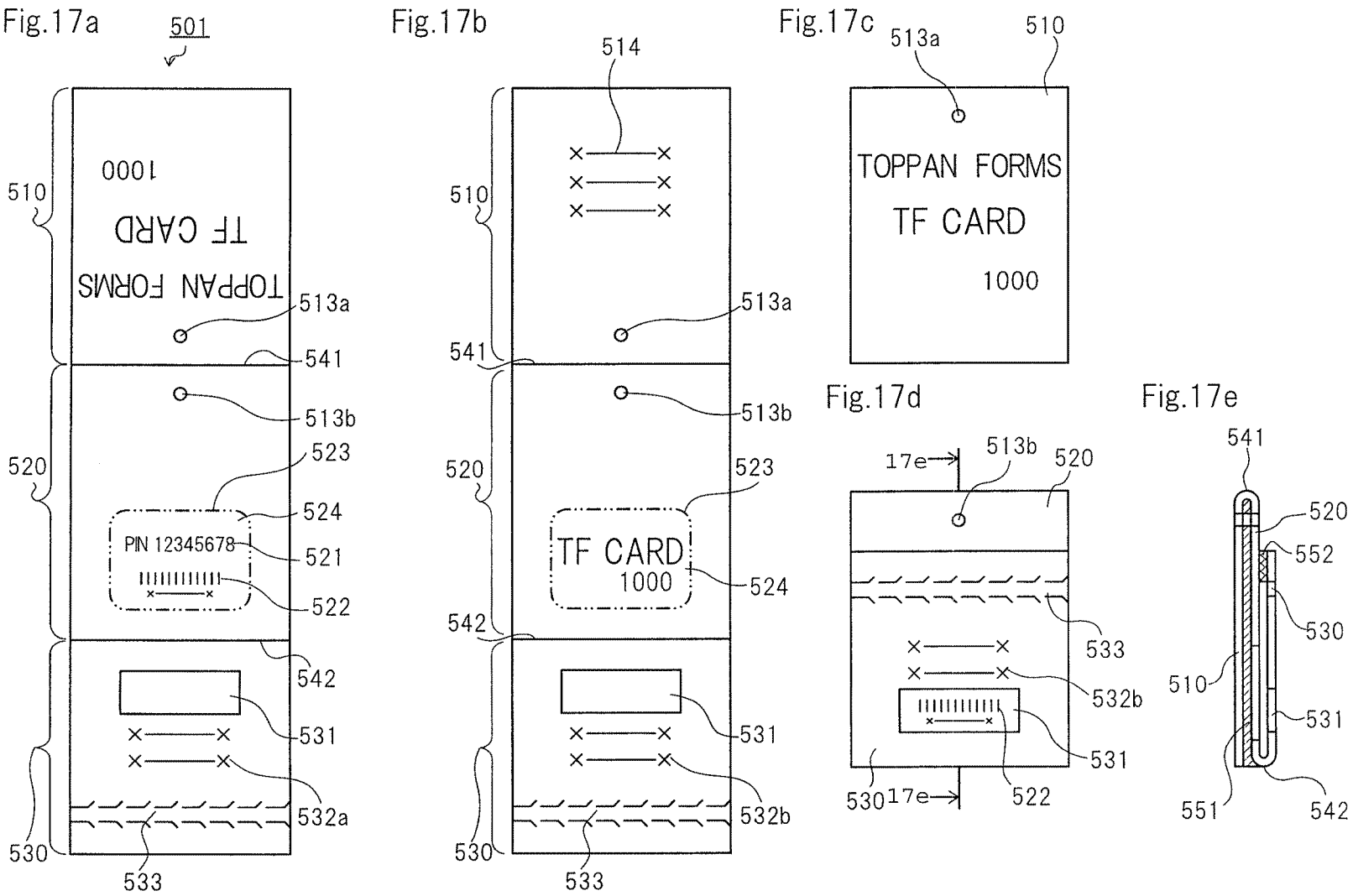
FIG. 17*a* is a front view showing that a sixth embodiment of the present invention has been unfolded.
FIG. 17*b* is a rear view showing that the sixth embodiment of the present invention has been unfolded.
FIG. 17*c* is a front view showing that the sixth embodiment of the present invention has been folded.
FIG. 17*d* is a rear view showing that the sixth embodiment of the present invention has been folded.
FIG. 17*e* is a sectional view taken along line 17*e*-17*e* of FIG. 17*d;*

FIG. 17*a* is a front view showing that a sixth embodiment of the present invention has been unfolded; FIG. 17*b* is a rear view showing that the sixth embodiment of the present invention has been unfolded; FIG. 17*c* is a front view showing that the sixth embodiment of the present invention has been folded; FIG. 17*d* is a rear view showing that the sixth embodiment of the present invention has been folded; and FIG. 17*e* is a sectional view taken along line 17*e*-17*e* of FIG. 17*d*.

As shown in FIG. 17*a* to FIG. 17*e*, card enclosed unit 501 according to the sixth embodiment is different from card enclosed unit 301 according to the fourth embodiment in that the length of sheet 530 in the connection direction of sheet 530 and sheet 520 is shorter than that of sheet 510 and sheet 520 and that zipper 533 that is a separation line is formed in sheet 530 as an unsealing structure that causes card 524 to be exposed. In addition, according to this embodiment, card 524 is separably enclosed in sheet 520 along separation line 523 composed of a slit and a tie portion.

Zipper 533 is formed in sheet 530 such that zipper 533 is along the opposite side to fold 542.

Like the fourth embodiment, in card enclosed unit 501 according to this embodiment, three sheets 510, 520, and 530 are folded along folds 541 and 542 in a Z shape in such a manner that the surface on which notification information 514 is indicated of sheet 510 is opposite to sheet 520 and that the surface on which PIN code 521 and POS code 522 are indicated of sheet 520 is opposite to sheet 530. Although sheets 510 and 520 are fully peelably adhered to each other with pseudo adhesive agent 551, sheets 520 and 530 are adhered with adhesive agent 552 at only the region opposite to fold 542 by zipper 533, namely, the region along the opposite side to fold 542 of sheet 530 such that sheets 520 and 530 are not easily peeled off.

Card enclosed unit 501 according to the sixth embodiment is used in the same environment as the fourth embodiment.

FIG. 18*a* to FIG. 18*e* are schematic diagrams showing usage for card enclosed unit 501 shown in FIG. 17*a* to FIG. 17*e*.

When the user purchases card enclosed unit 501 shown in FIG. 17*a* to FIG. 17*e* at a store, as shown in FIG. 17*d*, since sheet 530 covers PIN code 521, it becomes invisible. In contrast, POS code 522 is visible through hole 531 formed in sheet 530.

Figure 18A:
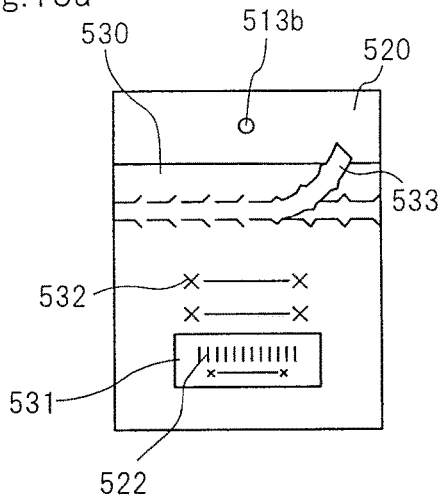
FIG. 18*a* is a schematic diagram showing usage for the card enclosed unit shown in FIG. 17*a* to FIG. 17*e;*
Figure 18B:
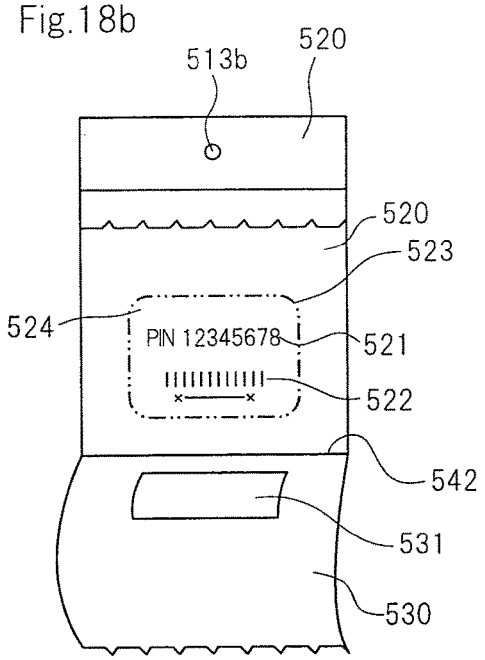
FIG. 18*b* is a schematic diagram showing usage for the card enclosed unit shown in FIG. 17*a* to FIG. 17*e;*

When the user who purchased card enclosed unit 501 breaks zipper 533, he or she can unseal card enclosed unit 501 as shown in FIG. 18*a* and cause card 524 to be exposed as shown in FIG. 18*b*. Since sheet 520 and sheet 530 are adhered to each other at only the region opposite to fold 542 by zipper, when zipper 533 is broken, sheet 520 and sheet 530 can be unfolded along fold 542 and thereby card 524 can be exposed. The unsealing structure according to this embodiment is accomplished by zipper 533.

Figure 18C:
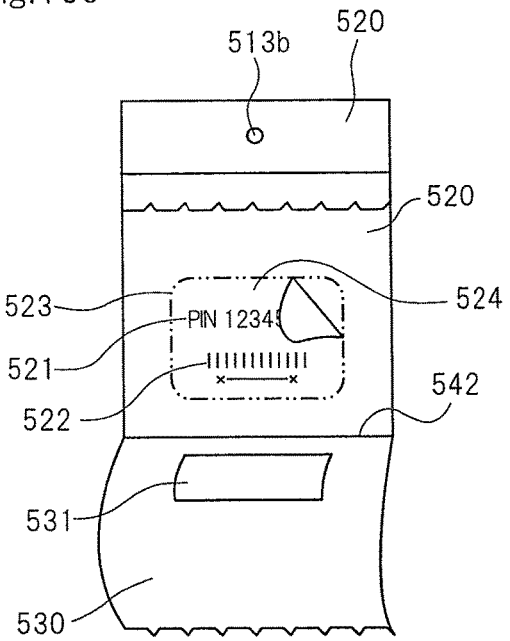
FIG. 18*c* is a schematic diagram showing usage for the card enclosed unit shown in FIG. 17*a* to FIG. 17*e;*

In card enclosed unit 501, card 524 is separably enclosed in sheet 520 along separation line 523 and is peelable from sheet 530 adhered thereto by pseudo adhesive agent 551. Thus, when the user who purchased card enclosed unit 501 unseals card enclosed unit 501 and causes card 524 to be exposed, as shown in FIG. 18*c*, he or she can break separation line 523, separate card 524 from sheet 520, and peel off card 524 from sheet 530.

Figure 18E:
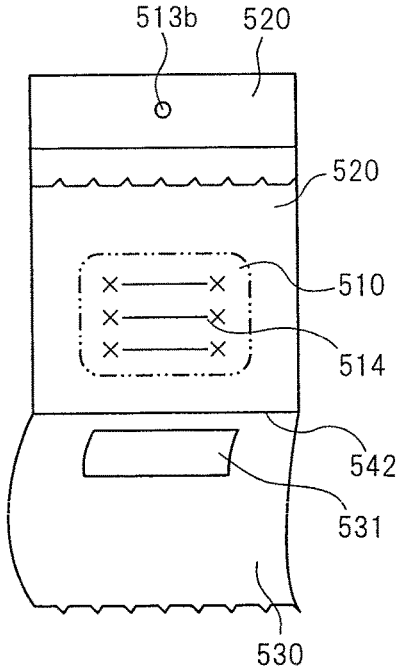
FIG. 18*e* is a schematic diagram showing usage for the card enclosed unit shown in FIG. 17*a* to FIG. 17*e;*
Figure 18D:
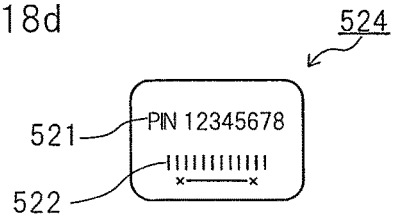
FIG. 18*d* is a schematic diagram showing usage for the card enclosed unit shown in FIG. 17*a* to FIG. 17*e;*

Consequently, as shown in FIG. 18*d*, since card 524 is separated from card enclosed unit 501, the user can input PIN code 521 that is indicated on card 524 to mobile terminal 73.

When card 524 is separated from sheet 520, as shown in FIG. 18*e*, notification information 332*a* that is indicated on the sheet 520 side adhesion surface of sheet 510 becomes visible.

According to this embodiment, zipper 533 formed in sheet 530 is broken so as to expose card 524. Thereafter, card 524 is separated from sheet 520 and then peeled off from sheet 510. Alternatively, a zipper may be formed in sheet 510. The zipper may be broken so as to expose card 524. In this case, at least card 524 enclosed in sheet 520 and sheet 530 need to be peelably adhered to each other.

The separation line that composes the unsealing structure may be a perforation rather than zipper 533 as long as sheet 530 can be broken.

According to this embodiment, the shapes of two sheets 510 and 520 are the same. Alternatively, the shapes and sizes of sheets 510 and 520 may be different from each other. The shape (a shape, a size) can be designed suitably so that required regions that conceal PIN code 521 and form hole 531 and so forth are secured.

(Seventh Embodiment)

Figure 19A:
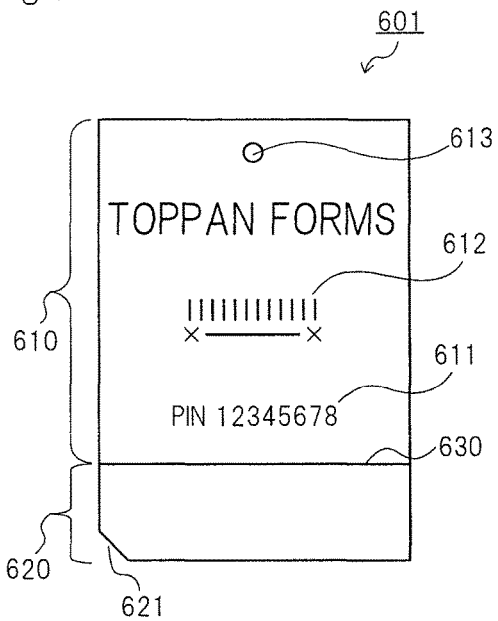
FIG. 19*a* is a front view showing that a seventh embodiment of the present invention has been unfolded.
Figure 19B:
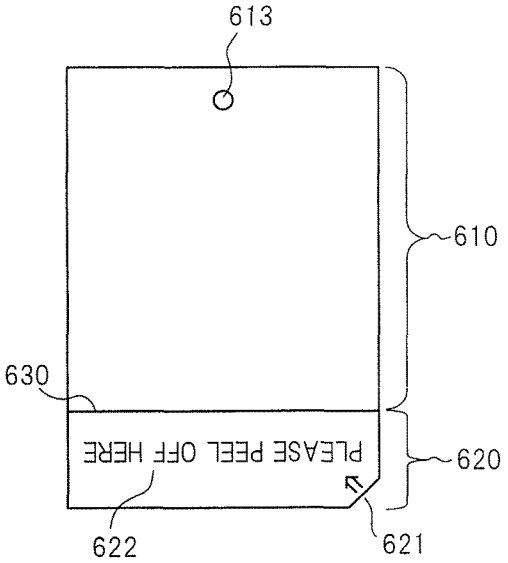
FIG. 19*b* is a rear view showing that the seventh embodiment of the present invention has been unfolded.
Figure 19C:
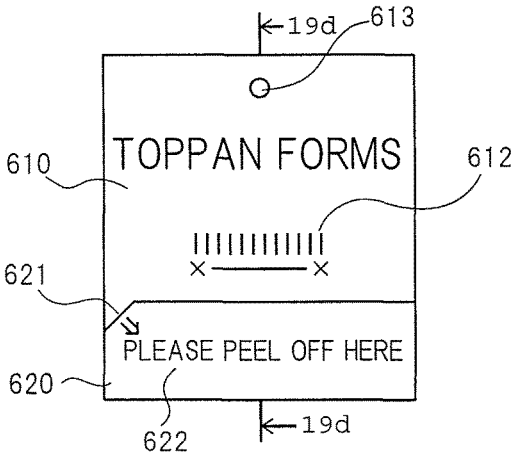
FIG. 19*c* is a front view showing that the seventh embodiment of the present invention has been folded.
Figure 19D:
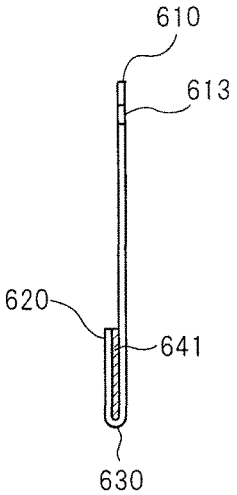
FIG. 19*d* is a sectional view taken along line 19*d*-19*d* of FIG. 19*c;*

FIG. 19*a* is a front view showing that a seventh embodiment of the present invention has been unfolded; FIG. 19*b* is a rear view showing that the seventh embodiment of the present invention has been unfolded; FIG. 19*c* is a front view showing that the seventh embodiment of the present invention has been folded; and FIG. 19*d* is a sectional view taken along line 19*d*-19*d* of FIG. 19*c*.

As shown in FIG. 19*a* to FIG. 19*d*, service providing sheet 601 according to the seventh embodiment has first sheet 610 and second sheet 620 that are foldably connected through fold 630 that becomes a connection side of first sheet 610 and second sheet 620.

Hole 613 that pierces through sheet 610 is formed in region along the opposite side to fold 630 of sheet 610. PIN code 611 that is a first code and POS code 612 that is a second code are indicated on the front surface of sheet 610 such that PIN code 611 is indicated on the fold 630 side. As will be described later, PIN code 611 and POS code 612 have been correlated with each other.

The length of sheet 620 in the connection direction of sheet 610 and sheet 620 is shorter than that of sheet 610. Notch 621 is formed at one corner of sheet 620. Notification information 622 that denotes that sheet 610 can be peeled off from sheet 620 at notch 621 after sheet 610 and sheet 620 are folded and adhered to each other is indicated on the rear surface of sheet 620.

Sheet 610 and sheet 620 are folded along fold 630 such that their front surfaces face inside and they are peelably adhered to each other by pseudo adhesive agent 641. Pseudo adhesive agent 641 is applied to the front surface of sheet 620 and at least the opposite region to sheet 620 of the front surface of sheet 610 when service providing sheet 601 has been folded. Pseudo adhesive agent 641 may be applied before or after information including PIN code 611 and POS code 612 is printed. The length of sheet 620 in the connection direction of sheet 610 and sheet 620 is shorter than that of sheet 610. PIN code 611 and POS code 612 are indicated on sheet 610 such that PIN code 611 is indicated on the fold 630 side. Thus, when service providing sheet 601 has been folded, since sheet 620 covers PIN code 611, not POS code 612, PIN code 611 becomes invisible and POS code 612 becomes visible. In other words, when service providing sheet 601 has been folded, PIN code 611 is overlaid with sheet 620, but POS code 612 is not overlaid.

Next, usage for service providing sheet 601 having the foregoing structure will be described. Service providing sheet 601 according to the seventh embodiment is used in the same environment as the first embodiment.

Figure 20:
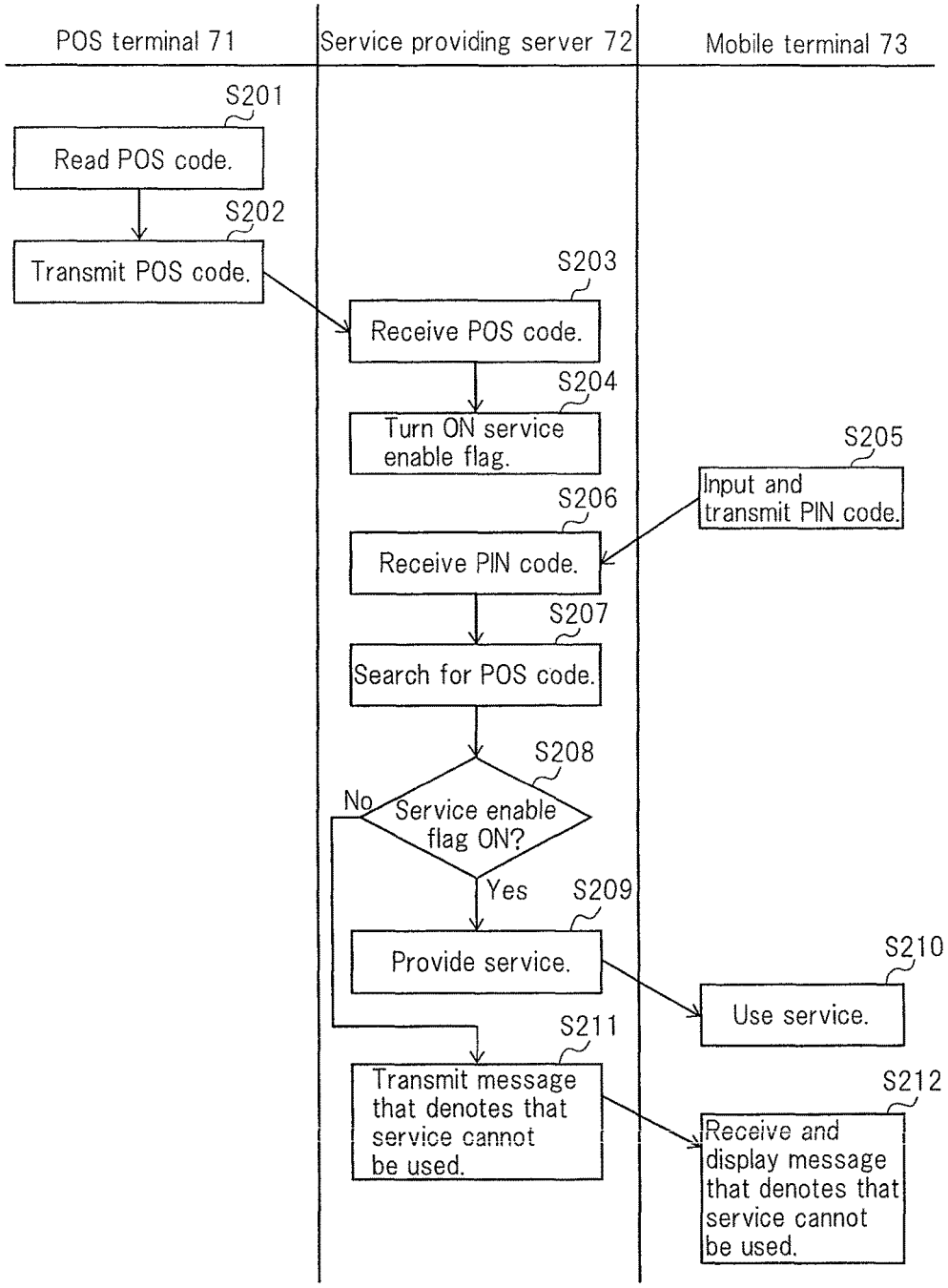
FIG. 20 is a flow chart describing usage for the service providing sheet shown in FIG. 19*a* to FIG. 19*d* in the environment shown in FIG. 4.

FIG. 20 is a flow chart describing usage for service providing sheet 601 shown in FIG. 19*a* to FIG. 19*d* in the environment shown in FIG. 4.

The user purchases service providing sheet 601 at a store. Thereafter, POS terminal 71 installed at the store reads POS code 612 from service providing sheet 601 (at step 201). Although service providing sheet 601 is sold in the folded state as shown in FIG. 19*c*, when service providing sheet 601 has been folded it become visible since sheet 620 does not cover POS code 612 as described above. Thus, POS terminal 71 can read POS code 612. When service providing sheet 601 has been folded, since sheet 620 covers PIN code 611, it becomes invisible. Service providing sheet 601 is displayed at a store in such a manner that service providing sheet 601 is hung through hole 613 that pierces through sheet 610.

POS code 612 that is read from service providing sheet 601 is transmitted from POS terminal 71 (at step 202) and then received by service providing server 72 through communication line 74 (at step 203).

Service providing server 72 has correlatively managed PIN code 611 and POS code 612 that are indicated on sheet 610 of each service providing sheet 601 that is sold. When service providing server 72 receives POS code 612, service providing server 72 sets a service enable flag of POS code 612 to "1" that denotes that service providing sheet 601 can be used and thereby service providing sheet 601 enters the ON state (at step 204).

Thereafter, the user who purchased service providing sheet 601 accesses service providing server 72 with mobile terminal 73 and inputs PIN code 611 that is indicated on sheet 610 of service providing sheet 601 to mobile terminal 73. Thereafter, mobile terminal transmits PIN code 611 to service providing server 72 (at step 205). Thereafter, service providing server 72 receives PIN code 611 through communication line 74 (at step 206).

Figure 21A:
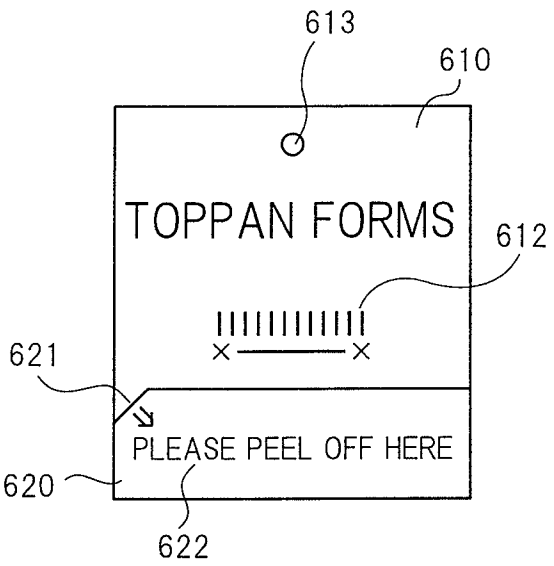
FIG. 21*a* is a schematic diagram showing usage for the service providing sheet shown in FIG. 19*a* to FIG. 19*d;*
Figure 21B:
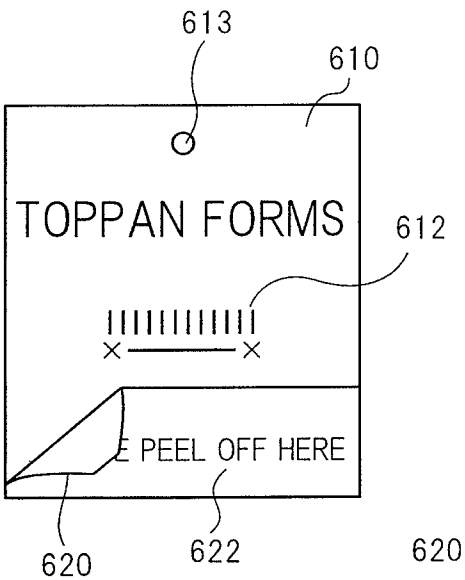
FIG. 21*b* is a schematic diagram showing usage for the service providing sheet shown in FIG. 19*a* to FIG. 19*d;*
Figure 21C:
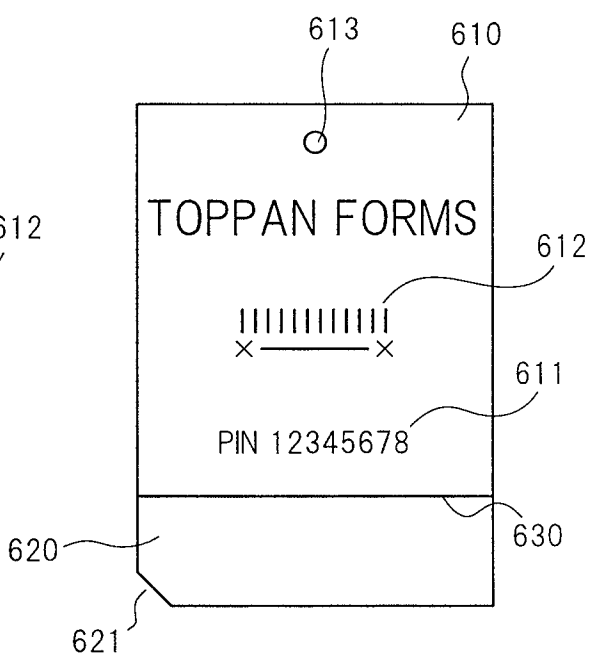
FIG. 21*c* is a schematic diagram showing usage for the service providing sheet shown in FIG. 19*a* to FIG. 19*d;*

FIG. 21*a* to FIG. 21*c* are schematic diagrams showing usage for service providing sheet 601 shown in FIG. 19*a* to FIG. 19*d*.

In service providing sheet 601 shown in FIG. 19*a* to FIG. 19*d*, when the user purchases it at a store, as shown in FIG. 21*a*, since sheet 620 covers PIN code 611, not POS code 612, PIN code 611 is invisible and POS code 612 is visible.

After the user purchases service providing sheet 601, as shown in FIG. 21*b*, he or she peels off sheet 620 from sheet 610. Since sheets 610 and sheet 620 have been peelably adhered to each other with pseudo adhesive agent 641, the user who purchased service providing sheet 601 can peel off sheet 610 from sheet 620. At this point, the user peels off sheet 620 from sheet 610 using notch 621 as the peel start edge according to notification information 622 that is indicated on sheet 620.

When sheet 620 is peeled off from first sheet 610 and thereby service providing sheet 601 is unfolded, as shown in FIG. 21*c*, PIN code 611 that is indicated on sheet 610 becomes visible. As a result, the user can input PIN code 611 to mobile terminal 73.

When service providing server 72 receives PIN code 611 from mobile terminal 73, service providing server 72 searches for a POS code correlated with PIN code 611 (at step 207). Since service providing server 72 has correlatively managed PIN code 611 and POS code 612 that are indicated on sheet 610 of each service providing sheet 601 as described above, service providing server 72 can search for the POS code correlated with PIN code 611 that has been received.

Thereafter, service providing server 72 determines that the service enable flag of the retrieved POS code has been set to "1" and thereby service providing sheet 601 has been turned ON (at step 208). When service providing sheet 601 is purchased, POS code 612 that is indicated on sheet 610 of service providing sheet 601 is read by POS terminal 71 and the service enable flag of POS code 612 is set to "1" and thereby service providing sheet 601 is turned ON by service providing server 72. Thus, when the service enable flag of POS code 612 has been set to "1" and thereby service providing sheet 601 has been turned ON, since service providing sheet 601 has been legally purchased, service providing server 72 provides a service to mobile terminal 73 (at step 209). Thus, the user can use the service on mobile terminal 73 (at step 210).

If the service enable flag of the retrieved POS code has not been set to "1" and thereby service providing sheet 601 has not been turned ON, since the service providing sheet 601 has not been legally purchased, service providing server 72 transmits a message that denotes that the service cannot be used to mobile terminal 73 (at step 211).

The message that denotes that the service cannot be used is transmitted from service providing server 72 and then received by mobile terminal 73 through communication line 74. The message is output and displayed on mobile terminal 73 (at step 212).

As described above, since both POS code 612 that allows service providing sheet 601 to be used and PIN code 611 that is designated when the service is used with service providing sheet 601 are indicated on sheet 610, POS code 612 and PIN code 611 can be simultaneously printed and thereby they can be prevented from becoming inconsistent. In this structure, before service providing sheet 601 is used, POS code 612 is visible, but PIN code 611 is invisible.

(Eighth Embodiment)

Figure 22A:
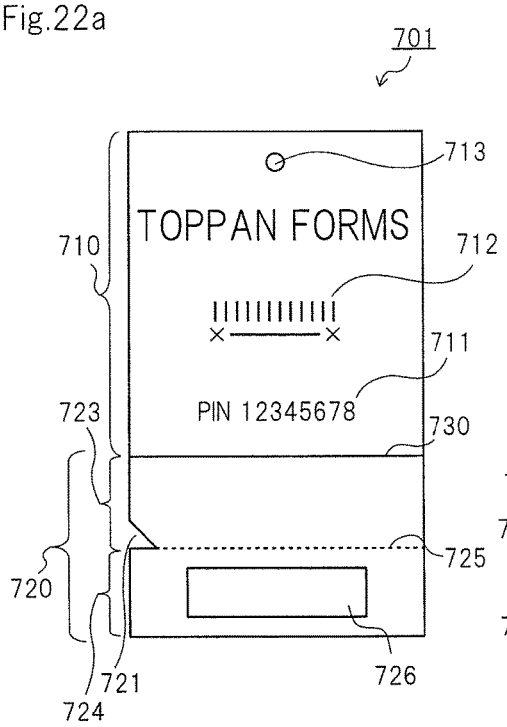
FIG. 22*a* is a front view showing that an eighth embodiment of the present invention has been unfolded.
Figure 22B:
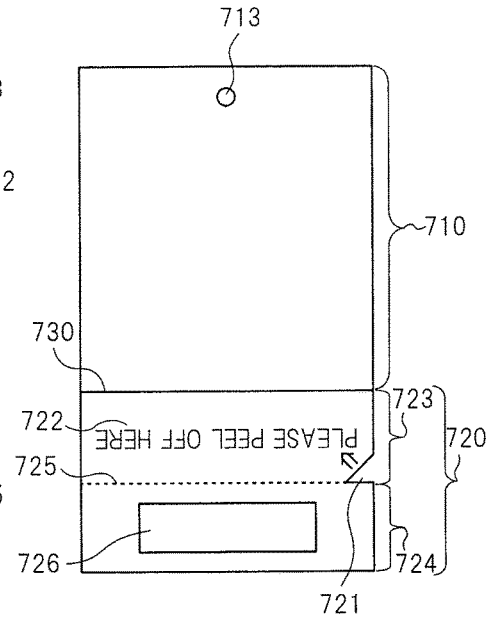
FIG. 22*b* is a rear view showing that the eighth embodiment of the present invention has been unfolded.
Figure 22C:
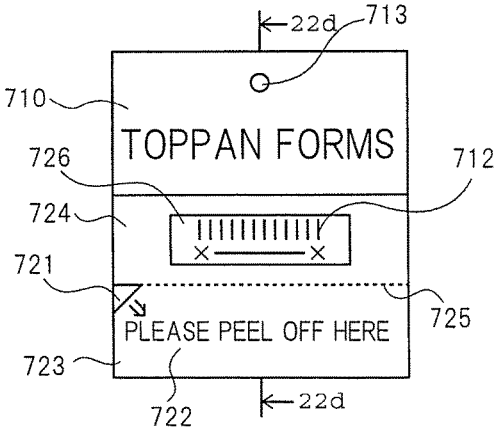
FIG. 22*c* is a front view showing that the eighth embodiment of the present invention has been folded.
Figure 22D:
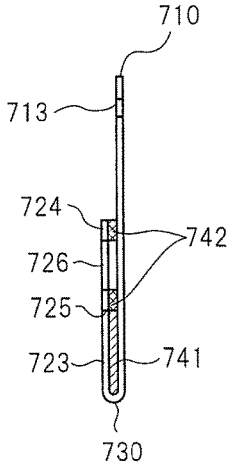
FIG. 22*d* is a sectional view taken along line 22*d*-22*d* of FIG. 22*c;*

FIG. 22*a* is a front view showing that an eighth embodiment of the present invention has been unfolded; FIG. 22*b* is a rear view showing that the eighth embodiment of the present invention has been unfolded; FIG. 22*c* is a front view showing that the eighth embodiment of the present invention has been folded; and FIG. 22*d* is a sectional view taken along line 22*d*-22*d* of FIG. 22*c*.

As shown in FIG. 22*a* to FIG. 22*d*, service providing sheet 701 according to the eighth embodiment is different from service providing sheet 601 according to the seventh embodiment in that second sheet 720 is composed of cover 723 and cover 724 that become a second region connected to each other in the connection direction of first sheet 710 and second sheet 720. In service providing sheet 701, sheet 720 is composed of two covers 723 and 724 such that the length in the connection direction of sheet 710 and sheet 720 is shorter than that of sheet 710.

Sheet 720 is composed of two covers 723 and 724 that are separably connected along micro perforation 725 such that cover 723 is adjacent to fold 730. Hole 726 that pierces through cover 724 is formed therein.

Sheets 710 and 720 are folded along fold 730 such that their front surfaces face inside. Sheet 710 and cover 723 are peelably adhered to each other with pseudo adhesive agent 741. Sheet 710 and cover 724 are adhered to each other with adhesive agent 742 in the post-adhesion peel-off difficulty state at around a first region of hole 726. The post-adhesion peel-off difficulty state denotes that sheet 710 and cover 724 are strongly adhered to each other such that when they are manually peeled off, sheet 710 and cover 724 may tear or break in the thickness direction. When service providing sheet 701 has been folded, since cover 723 covers PIN code 711, it becomes invisible. When service providing sheet 701 has been folded, although cover 724 covers POS code 712, POS code 712 becomes visible through hole 726 because hole 726 is formed in the region opposite to cover 724.

Service providing sheet 701 according to the eighth embodiment is used in the same environment as the seventh embodiment.

Figure 23A:
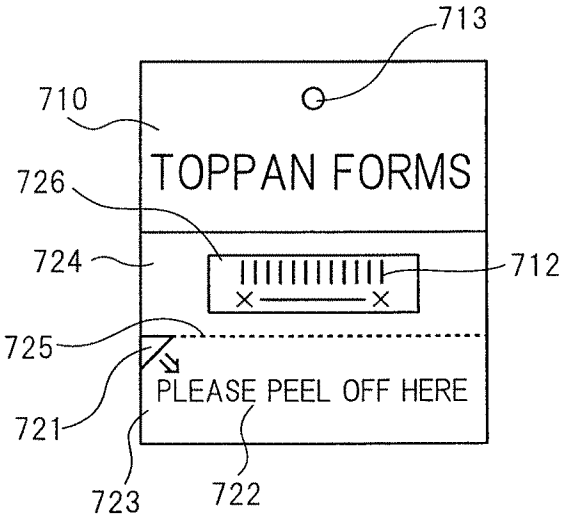
FIG. 23*a* is a schematic diagram showing usage for the service providing sheet shown in FIG. 22*a* to FIG. 22*d;*
Figure 23B:
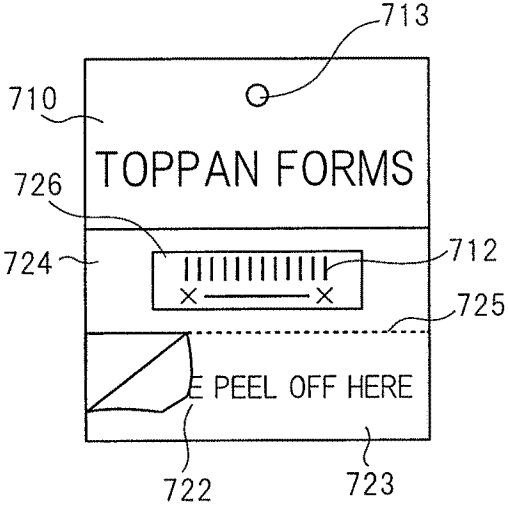
FIG. 23*b* is a schematic diagram showing usage for the service providing sheet shown in FIG. 22*a* to FIG. 22*d;*
Figure 23C:
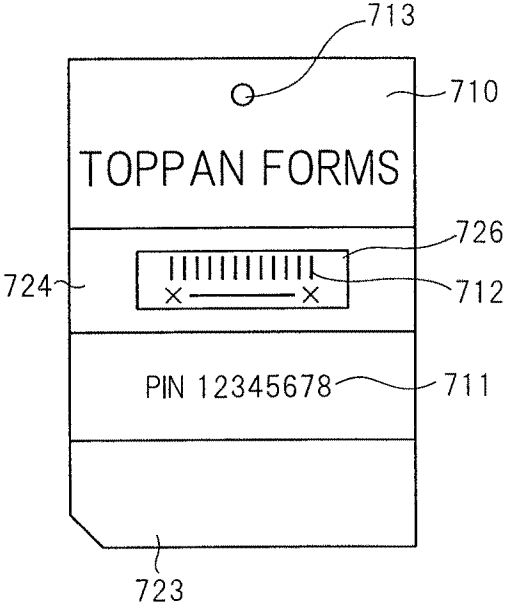
FIG. 23*c* is a schematic diagram showing usage for the service providing sheet shown in FIG. 22*a* to FIG. 22*d;*

FIG. 23*a* to FIG. 23*c* are schematic diagrams showing usage for service providing sheet 701 shown in FIG. 22*a* to FIG. 22*d*.

In service providing sheet 701 shown in FIG. 22*a* to FIG. 22*d*, when the user purchases it at a store, as shown in FIG. 23*a*, since cover 723 covers PIN code 711, it is invisible. In contrast, POS code 712 is visible through hole 726 formed in cover 724.

After the user purchases service providing sheet 701, as shown in FIG. 23*b*, he or she breaks micro perforation 725 and peels off cover 723 from sheet 710. Since sheet 710 and cover 723 have been peelably adhered to each other with pseudo adhesive agent 741, the user who purchased service providing sheet 701 can peel off cover 723 from sheet 710. At this point, the user breaks micro perforation 725 and peels off cover 723 from sheet 710 using notch 721 as the peel start edge according to notification information 722 that is indicated on cover 723.

When cover 723 is peeled off from sheet 710 and thereby service providing sheet 701 is unfolded, as shown in FIG. 23*c*, PIN code 711 that is indicated on sheet 710 becomes visible. As a result, the user can input PIN code 711 to mobile terminal 73.

According to this embodiment, when micro perforation 725 is broken, PIN code 711 becomes visible. Thus, if PIN code 711 is caused to be become illegally visible, a fraud alert still can be seen.

(Ninth Embodiment)

Figure 24A:
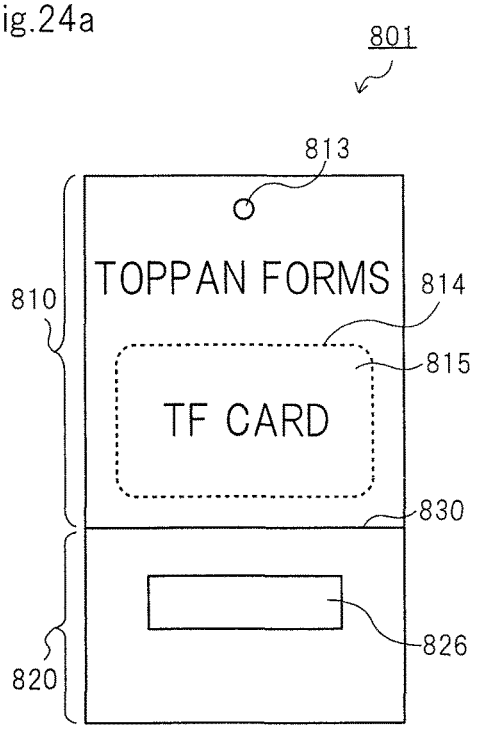
FIG. 24*a* is a front view showing that a ninth embodiment of the present invention has been unfolded.
Figure 24B:
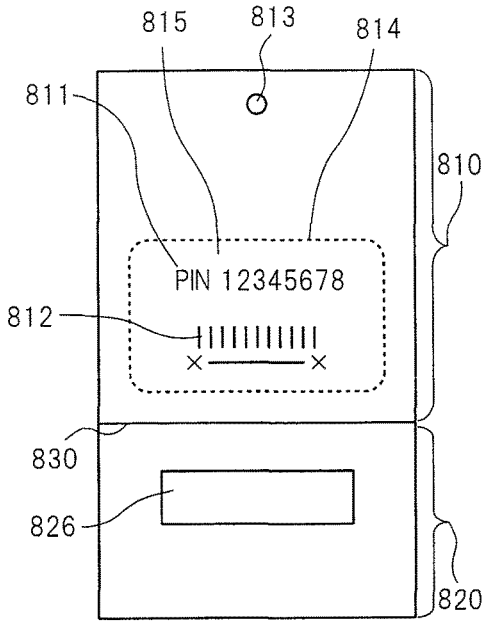
FIG. 24*b* is a rear view showing that the ninth embodiment of the present invention has been unfolded.
Figure 24C:
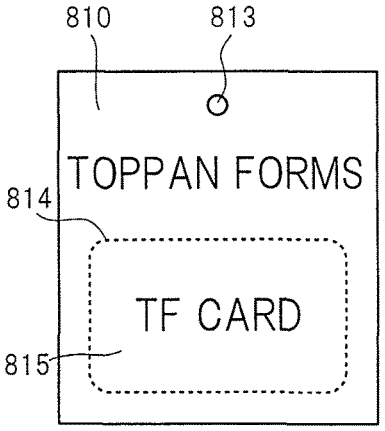
FIG. 24*c* is a front view showing that the ninth embodiment of the present invention has been folded.
Figure 24D:
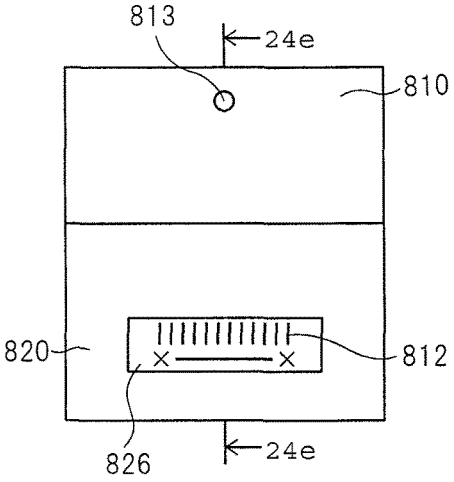
FIG. 24*d* is a rear view showing that the ninth embodiment of the present invention has been folded.
Figure 24E:
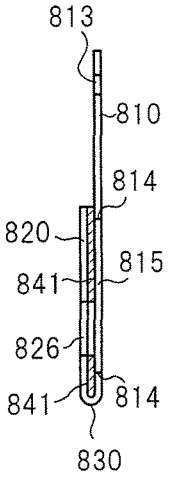
FIG. 24*e* is a sectional view taken along line 24*e*-24*e* of FIG. 24*d;*

FIG. 24*a* is a front view showing that a ninth embodiment of the present invention has been unfolded; FIG. 24*b* is a rear view showing that the ninth embodiment of the present invention has been unfolded; FIG. 24*c* is a front view showing that the ninth embodiment of the present invention has been folded; FIG. 24*d* is a rear view showing that the ninth embodiment of the present invention has been folded; and FIG. 24*e* is a sectional view taken along line 24*e*-24*e* of FIG. 24*d*.

As shown in FIG. 24*a* to FIG. 24*e*, service providing sheet 801 according to the ninth embodiment has first sheet 810 and second sheet 820 that are foldably connected through fold 830 that becomes a connection side of first sheet 810 and second sheet 820.

Card 815 is separable from sheet 810 along micro perforation 814. Hole 813 that pierces through sheet 810 is formed in the region along the side opposite to fold 830 of sheet 810. PIN code 811 that is a first code and POS code 812 that is a second code are indicated on the rear surface of card 815 enclosed in sheet 810 such that POS code 812 is adjacent to fold 830. Like the seventh embodiment, PIN code 811 and POS code 812 have been correlated with each other.

The length of sheet 820 in the connection direction of sheet 810 and sheet 820 is shorter than that of sheet 810. Hole 826 that pierces through sheet 820 is formed therein.

Sheets 810 and 820 are folded along fold 830 such that their rear surfaces face inside and they are peelably adhered to each other with pseudo adhesive agent 841. Pseudo adhesive agent 841 is applied to the rear surface of sheet 820 and at least the region opposite to sheet 820 of the rear surface of sheet 810 in state that service providing sheet 801 is folded. Pseudo adhesive agent 841 may be applied before or after information including PIN code 811 and POS code 812 is printed. When service providing sheet 801 has been folded, since sheet 820 covers PIN code 811, it becomes invisible. When service providing sheet 801 has been folded, although sheet 820 covers POS code 812, it become visible through hole 826, because hole 826 is formed in the region opposite to POS code 812.

Service providing sheet 601 according to the ninth embodiment is used in the same environment as the seventh embodiment.

Figure 25A:
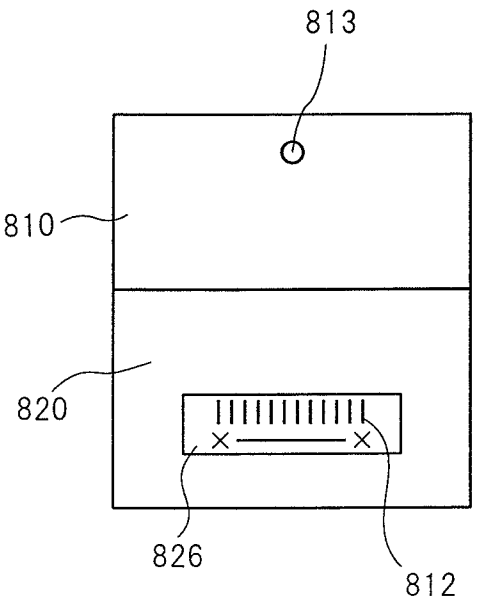
FIG. 25*a* is a schematic diagram showing usage for the service providing sheet shown in FIG. 24*a* to FIG. 24*e;*
Figure 25B:
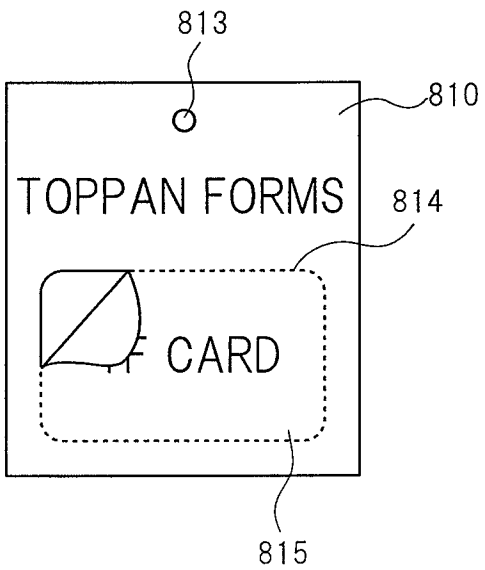
FIG. 25*b* is a schematic diagram showing usage for the service providing sheet shown in FIG. 24*a* to FIG. 24*e;*
Figure 25C:
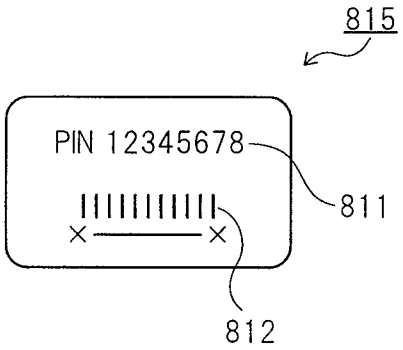
FIG. 25*c* is a schematic diagram showing usage for the service providing sheet shown in FIG. 24*a* to FIG. 24*e;*

FIG. 25*a* to FIG. 25*c* are schematic diagrams showing usage for service providing sheet 801 shown in FIG. 24*a* to FIG. 24*e*.

In service providing sheet 801 shown in FIG. 24*a* to FIG. 24*e*, when the user purchases it at a store, as shown in FIG. 25*a*, since sheet 820 covers PIN code 811, it is invisible. In contrast, POS code 812 is visible through hole 826 formed in sheet 820.

After the user purchases service providing sheet 801, as shown in FIG. 25*b*, he or she peels off card 815 enclosed in sheet 810 from sheet 820. Since sheets 810 and sheet 820 have been peelably adhered to each other with pseudo adhesive agent 841 as described above, the user who purchased service providing sheet 801 can break micro perforation 814, separate card 815 from sheet 810, and peel card 815 from sheet 820. Alternatively, at least a region where PIN code 811 and POS code 812 are not indicated in sheet 820 side adhesion surface of card 815 may be coated with a release varnish. Further alternatively, the sheet 820 side adhesion surface of card 815 may not be coated with pseudo adhesive agent 841.

Consequently, as shown in FIG. 25*c*, PIN code 811 that is indicated on the sheet 820 side adhesion surface of card 815 becomes visible. As a result, the user can input PIN code 811 to mobile terminal 73.

Thus, according to this embodiment, the user uses the service with card 815 separated from sheet 810.

(Tenth Embodiment)

Figure 26A:
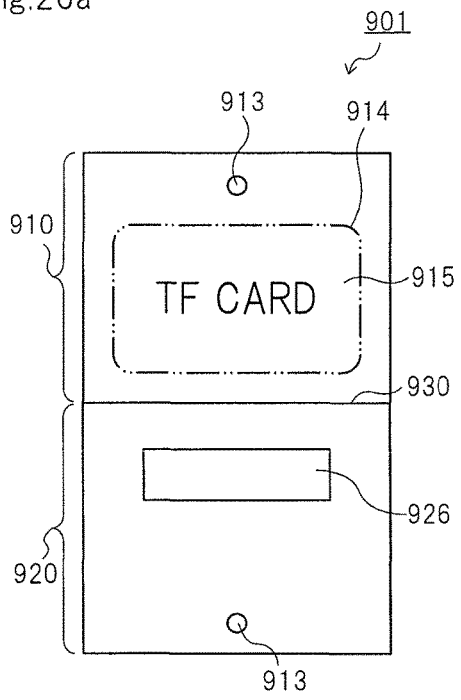
FIG. 26*a* is a front view showing that a tenth embodiment of the present invention has been unfolded.
Figure 26B:
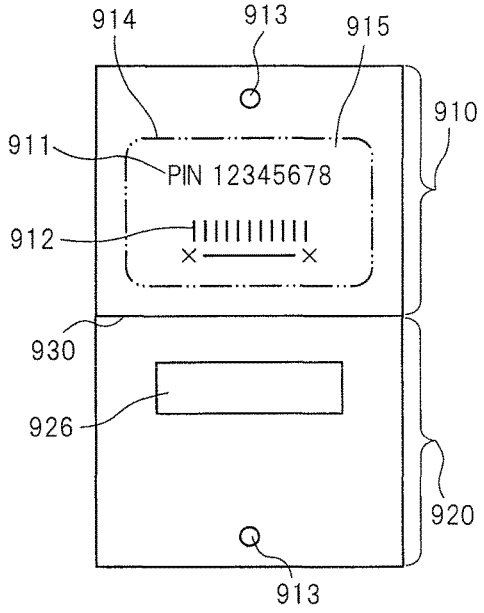
FIG. 26*b* is a rear view showing that the tenth embodiment of the present invention has been unfolded.
Figure 26C:
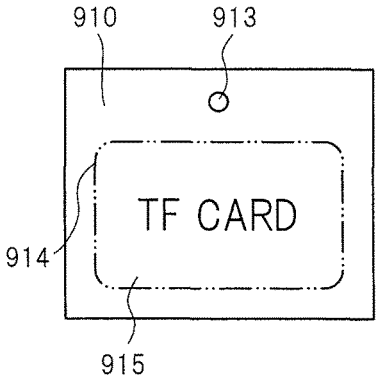
FIG. 26*c* is a front view showing that the tenth embodiment of the present invention has been folded.
Figure 26D:
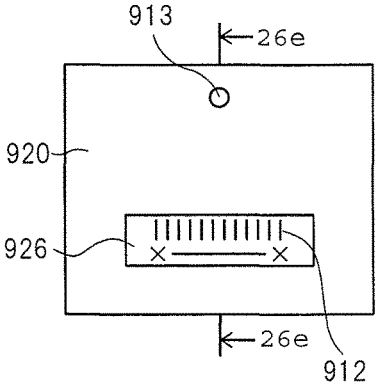
FIG. 26*d* is a rear view showing that the tenth embodiment of the present invention has been folded.
Figure 26E:
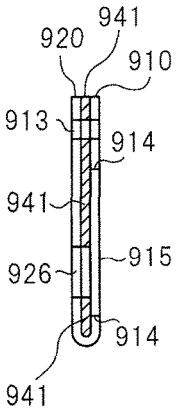
FIG. 26*e* is a sectional view taken along line 26*e*-26*e* of FIG. 26*d;*

FIG. 26*a* is a front view showing that a tenth embodiment of the present invention has been unfolded; FIG. 26*b* is a rear view showing that the tenth embodiment of the present invention has been unfolded; FIG. 26*c* is a front view showing that the tenth embodiment of the present invention has been folded; FIG. 26*d* is a rear view showing that the tenth embodiment of the present invention has been folded; and FIG. 26*e* is a sectional view taken along line 26*e*-26*e* of FIG. 26*d*.

As shown in FIG. 26*a* to FIG. 26*e*, service providing sheet 901 according to the tenth embodiment is different from service providing sheet 801 according to the ninth embodiment in that the length of sheet 910 in the connection direction of sheet 910 and sheet 920 is equal to that of sheet 920 and that card 915 separably enclosed in sheet 910 along separation line 914 composed of a slit and a tie portion.

Service providing sheet 901 according to the tenth embodiment is used in the same environment as the ninth embodiment.

(Eleventh Embodiment)

Figures 27A, 27B, 27C, 27D, 27E, 27F, 27G, 27H:
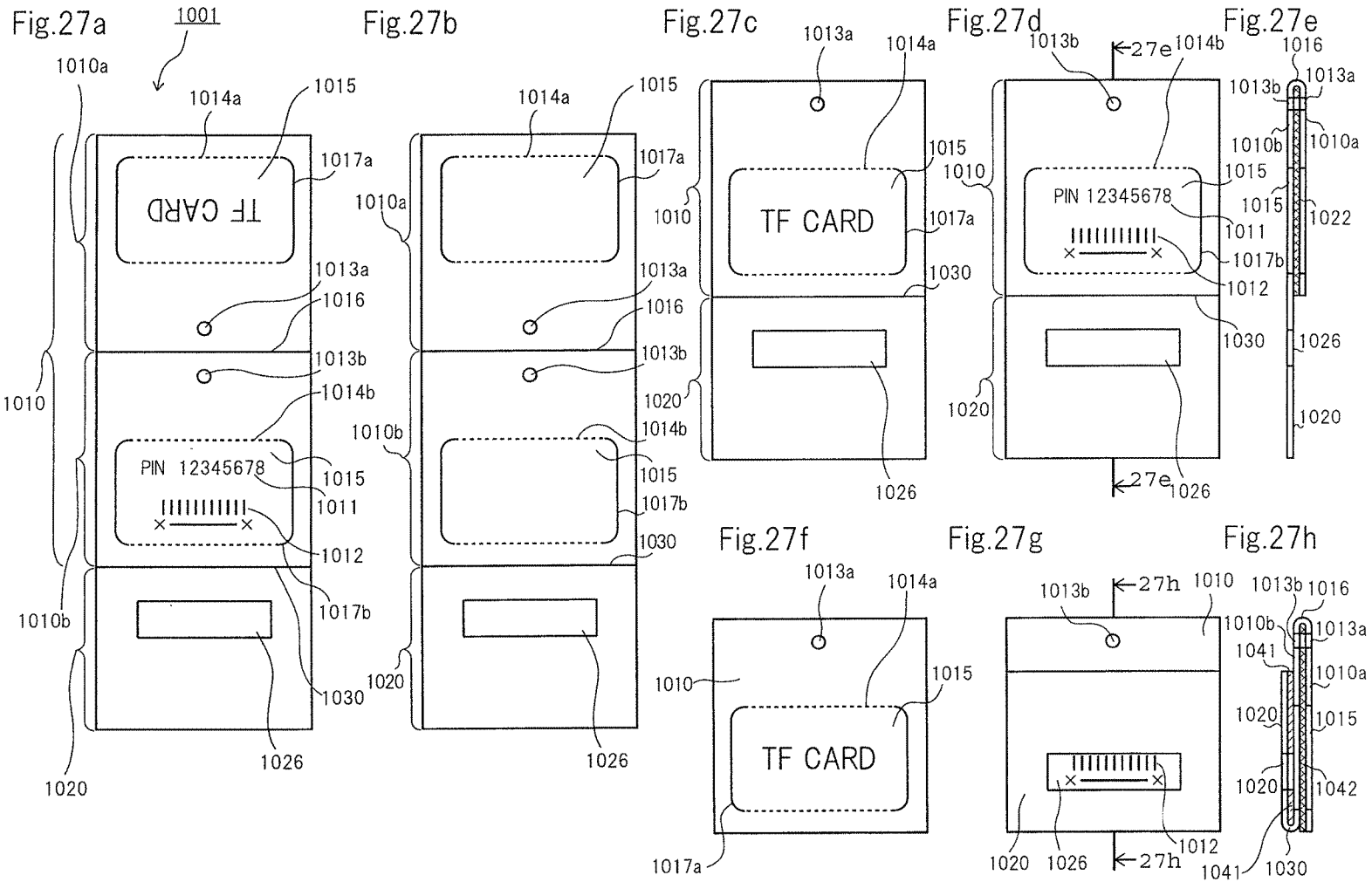
FIG. 27*a* is a front view showing that an eleventh embodiment of the present invention has been fully unfolded.
FIG. 27*b* is a rear view showing that the eleventh embodiment of the present invention has been fully unfolded.
FIG. 27*c* is a front view showing that a first sheet shown in FIG. 27*a* and FIG. 27*b* has been folded.
FIG. 27*d* is a rear view showing that the first sheet shown in FIG. 27*a* and FIG. 27*b* has been folded.
FIG. 27*e* is a sectional view taken along line 27*e*-27*e* of FIG. 27*d;*
FIG. 27*f* is a front view showing that the eleventh embodiment of the present invention has been fully folded.
FIG. 27*g* is a rear view showing that the eleventh embodiment of the present invention has been fully folded.
FIG. 27*h* is a sectional view taken along line 27*h*-27*h* of FIG. 27*g;*

FIG. 27*a* is a front view showing that an eleventh embodiment of the present invention has been fully unfolded; FIG. 27*b* is a rear view showing that the eleventh embodiment of the present invention has been fully unfolded; FIG. 27*c* is a front view showing that first sheet 1010 shown in FIG. 27*a* and FIG. 27*b* has been folded; FIG. 27*d* is a rear view showing that first sheet 1010 shown in FIG. 27*a* and FIG. 27*b* has been folded; FIG. 27*e* is a sectional view taken along line 27*e*-27*e* of FIG. 27*d*; FIG. 27*f* is a front view showing that the eleventh embodiment of the present invention has been fully folded; FIG. 27*g* is a rear view showing that the eleventh embodiment of the present invention has been fully folded; and FIG. 27*h* is a sectional view taken along line 27*h*-27*h* of FIG. 27*g*.

As shown in FIG. 27*a* to FIG. 27*h*, service providing sheet 1001 according to the eleventh embodiment is different from service providing sheet 801 according to the ninth embodiment in that sheet 1010 has a two-sheet structure composed of front piece 1010*a* and rear piece 1010*b* that are adhered to each other with adhesive agent 1042, micro perforations 1014*a* and 1014*b* are formed on one opposite sides of four sides of card 1015, and slits 1017*a* and 1017*b* are formed on the other opposite sides of four sides of card 1015.

Front piece 1010*a* and rear piece 1010*b* are connected through fold 1016. In addition, holes 1013*a* and 1013*b*, micro perforations 1014*a* and 1014*b*, and slits 1017*a* and 1017*b* are formed such that when front piece 1010*a* and rear piece 1010*b* are folded along fold 1016, holes 1013*a* and 1013*b* are opposite to each other, micro perforations 1014*a* and 1014*b* are opposite to each other, and slits 1017*a* and 1017*b* are opposite to each other. Front piece 1010*a* and rear piece 1010*b* are folded along fold 1016 such that the surface on which PIN code 1011 and POS code 1012 are indicated faces outside. Front piece 1010*a* and rear piece 1010*b* are adhered to each other with adhesive agent 1042 and thereby sheet 1010 is formed.

Service providing sheet 1001 according to the eleventh embodiment is used in the same manner as service providing sheets 801 and 901 according to the ninth and tenth embodiments.

In service providing sheet 1001 according to the eleventh embodiment, as described above, since sheet 1010 has a two-sheet structure composed of front piece 1010*a* and rear piece 1010*b* that are adhered to each other with adhesive agent 1042, when micro perforation 1014*a* formed in front piece 1010*a* and micro perforation 1014*b* formed in rear piece 1010*b* are broken, card 1015 can be separated from sheet 1010.

(Twelfth Embodiment)

Figures 28A, 28B, 28C, 28D, 28E, 28F, 28G, 28H:
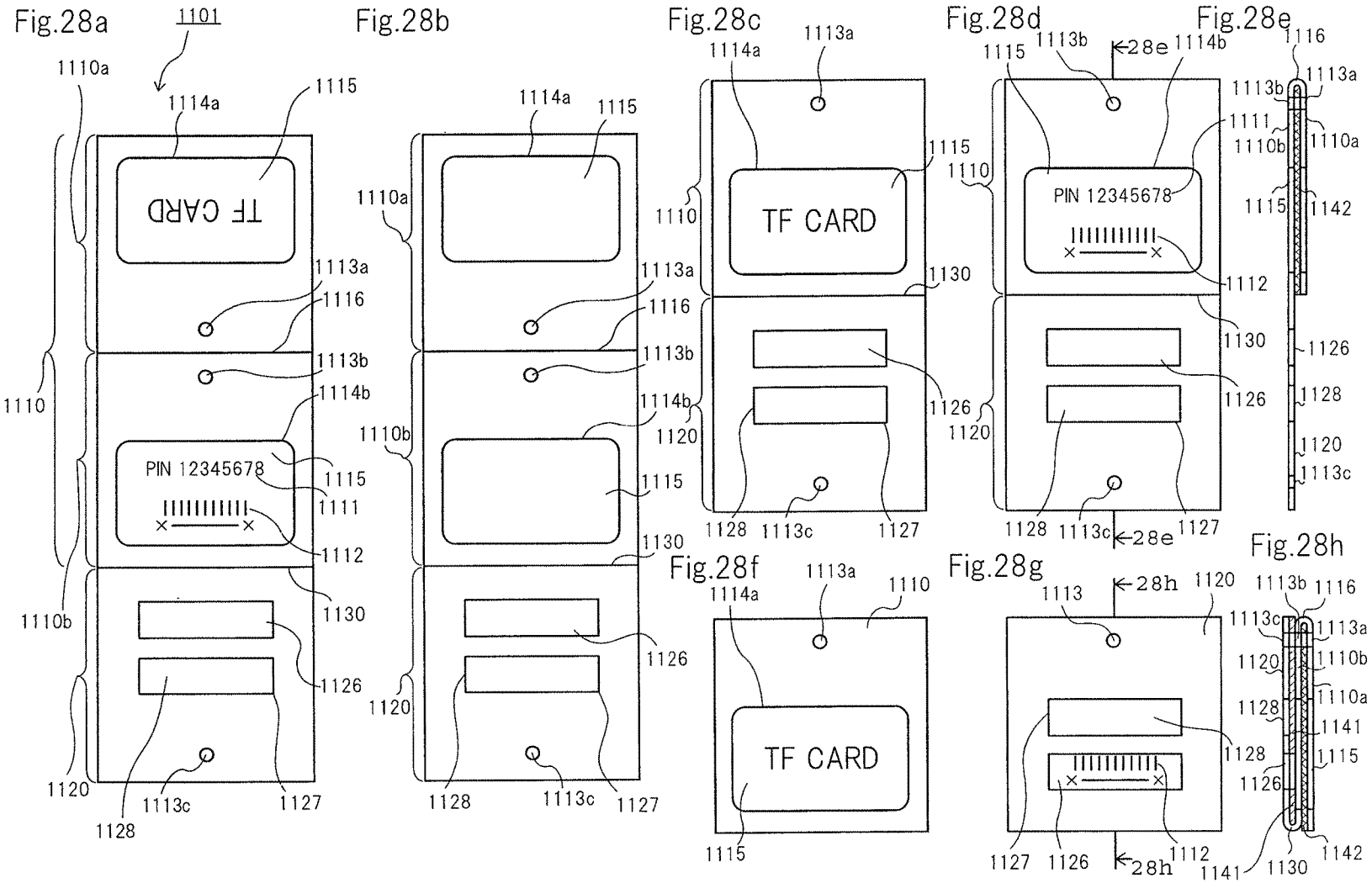
FIG. 28*a* is a front view showing that a twelfth embodiment of the present invention has been fully unfolded.
FIG. 28*b* is a rear view showing that the twelfth embodiment of the present invention has been fully unfolded.
FIG. 28*c* is a front view showing that a first sheet shown in FIG. 28*a* and FIG. 28*b* has been folded.
FIG. 28*d* is a rear view showing that the first sheet shown in FIG. 28*a* and FIG. 28*b* has been folded.
FIG. 28*e* is a sectional view taken along line 28*e*-28*e* of FIG. 28*d;*
FIG. 28*f* is a front view showing that the twelfth embodiment of the present invention has been fully folded.
FIG. 28*g* is a rear view showing that the twelfth embodiment of the present invention has been fully folded.
FIG. 28*h* is a sectional view taken along line 28*h*-28*h* of FIG. 28*g;*

FIG. 28*a* is a front view showing that a twelfth embodiment of the present invention has been fully unfolded; FIG. 28*b* is a rear view showing that the twelfth embodiment of the present invention has been fully unfolded; FIG. 28*c* is a front view showing that first sheet 1110 shown in FIG. 28*a* and FIG. 28*b* has been folded; FIG. 28*d* is a rear view showing that first sheet 1110 shown in FIG. 28*a* and FIG. 28*b* has been folded; FIG. 28*e* is a sectional view taken along line 28*e*-28*e* of FIG. 28*d*; FIG. 28*f* is a front view showing that the twelfth embodiment of the present invention has been fully folded; FIG. 28*g* is a rear view showing that the twelfth embodiment of the present invention has been fully folded; and FIG. 28*h* is a sectional view taken along line 28*h*-28*h* of FIG. 28*g*.

As shown in FIG. 28*a* to FIG. 28*h*, service providing sheet 1101 according to the twelfth embodiment is different from service providing sheet 901 according to the tenth embodiment in that sheet 1110 has a two-sheet structure composed of front piece 1110*a* and rear piece 1110*b* that are adhered to each other with adhesive agent 1142, card 1115 is separably enclosed in sheet 1110 along slits 1114*a* and 1114*b*, slit 1127 is formed in sheet 1120, and label 1128 is separably enclosed in sheet 1120 along slit 1127.

Front piece 1110*a* and rear piece 1110*b* are connected through fold 1116. In addition, holes 1113*a* and 1113*b* and slits 1117*a* and 1117*b* are formed such that when front piece 1110*a* and rear piece 1110*b* are folded along fold 1116, holes 1113*a* and 1113*b* are opposite to each other and slits 1117*a* and 1117*b* are opposite to each other. Front piece 1110*a* and rear piece 1110*b* are folded along fold 1116 such that the surface on which PIN code 1111 and POS code 1112 are indicated faces outside. Front piece 1110*a* and rear piece 1110*b* are adhered to each other with adhesive agent 1142 and thereby sheet 1110 is formed.

Like the tenth embodiment, sheet 1110 and sheet 1120 are folded along fold 1130 such that the surface on which PIN code 1111 and POS code 1112 are indicated faces inside and then peelably adhered to each other with pseudo adhesive agent 1141. In this state, since sheet 1120 covers PIN code 1111, it becomes invisible. In contrast, POS code 1112 becomes visible through hole 1126. When service providing sheet 1101 has been folded, label 1128 is opposite to PIN code 1111.

Service providing sheet 1101 according to the twelfth embodiment is used in the same environment as the seventh embodiment.

FIG. 29*a* to FIG. 29*e* are schematic diagrams showing usage for service providing sheet 1101 shown in FIG. 28*a* to FIG. 28*h*.

Figure 29A:
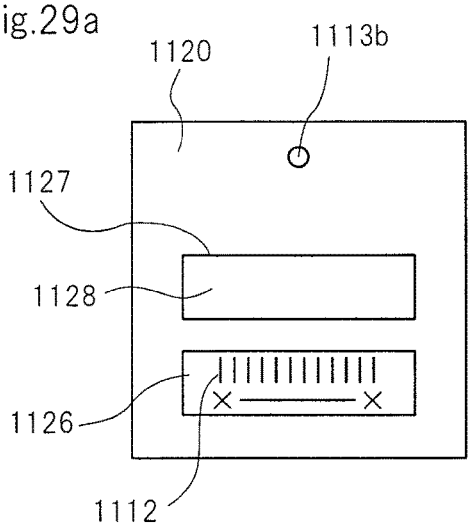
FIG. 29*a* is a schematic diagram showing usage for the service providing sheet shown in FIG. 28*a* to FIG. 28*h;*

In service providing sheet 1101 shown in FIG. 28*a* to FIG. 28*e*, when the user purchases it at a store, as shown in FIG. 29*a*, since sheet 1120 covers PIN code 1111, it is invisible. In contrast, POS code 1112 is visible through hole 1126 formed in sheet 1120.

Figure 29B:
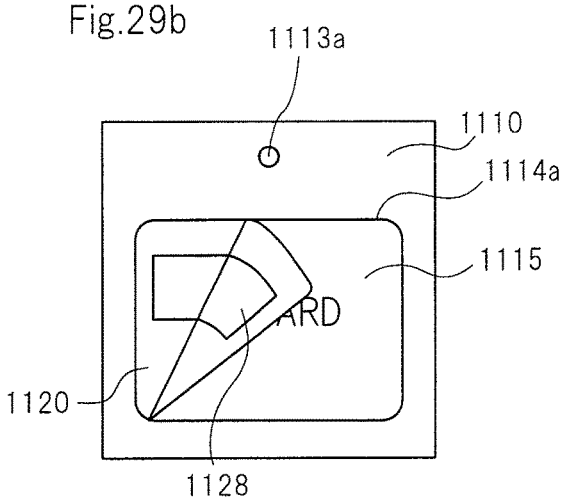
FIG. 29*b* is a schematic diagram showing usage for the service providing sheet shown in FIG. 28*a* to FIG. 28*h;*

After service providing sheet 1101 is purchased, as shown in FIG. 29*b*, the user peels off card 1115 enclosed in sheet 1110 from sheet 1120. In service providing sheet 1101 according to this embodiment, as described above, since sheet 1110 and sheet 1120 have been peelably adhered to each other with pseudo adhesive agent 1141, the user can separate card 1115 from sheet 1110 along slits 1114*a* and 1114*b* and peel off card 1115 from sheet 1120.

Figure 29C:
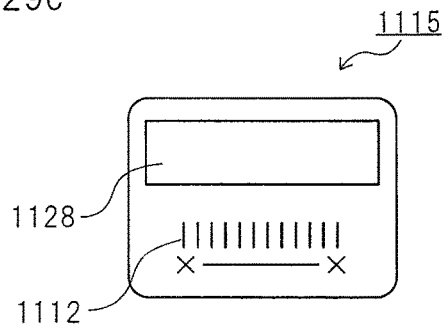
FIG. 29*c* is a schematic diagram showing usage for the service providing sheet shown in FIG. 28*a* to FIG. 28*h;*

At this point, as shown in FIG. 29*c*, label 1128 is separated from sheet 1120 and remains adhered to card 1115. Thus, when card 1115 is separated from sheet 1110 and peeled off from sheet 1120, label 1128 causes PIN code 1111 that is indicated on the sheet 1120 side adhesion surface of card 1115 to be invisible. When card 1115 is separated from sheet 1110, if label 1128 is separated from sheet 1120, but label 1128 remains adhered to card 1115, the adhesive force of pseudo adhesive agent 1141 that adheres label 1128 on sheet 1110 and sheet 1120 may be stronger than the adhesive force of pseudo adhesive agent 1141 that adheres the non-label region on sheet 1110 and sheet 1120. Alternatively, a release varnish may be applied to the non-label region on the sheet 1120 side adhesion surface of card 1115 such that the adhesive force of the adhesive agent that adheres the non-label region of card 1115 and sheet 1120 becomes weaker than the adhesive force of the adhesive agent that adheres card 1115 and sheet 1120.

Figure 29D:
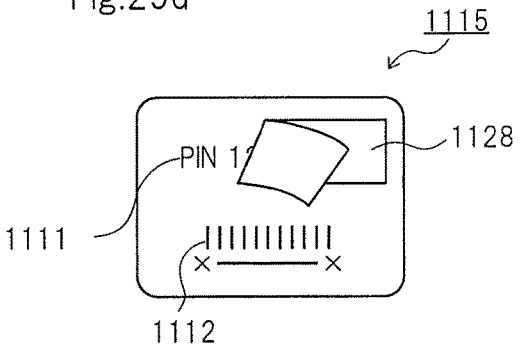
FIG. 29*d* is a schematic diagram showing usage for the service providing sheet shown in FIG. 28*a* to FIG. 28*h;*
Figure 29E:
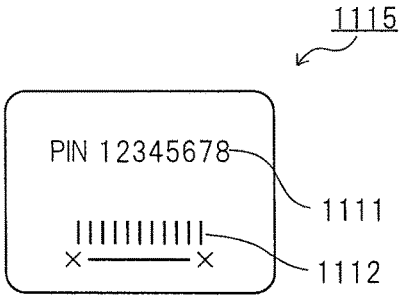
FIG. 29*e* is a schematic diagram showing usage for the service providing sheet shown in FIG. 28*a* to FIG. 28*h;*

Thereafter, when label 1128 is peeled off from card 1115, as shown in FIG. 29*d*, PIN code 1111 that is indicated on the sheet 1120 side adhesion surface of card 1115 becomes visible. As a result, the user can input PIN code 1111 to mobile terminal 73.

Thus, according to this embodiment, when card 1115 is separated from sheet 1110 and then peeled off from sheet 1120, label 1128 is separated from sheet 1120, but remains adhered to card 1115. Thereafter, when label 1128 is peeled off from card 1115, PIN code 1111 becomes visible. Thus, even if card 1115 is placed on sheet 1110 after PIN code 111 is caused to become illegally visible, since label has been separated from sheet 1120, a fraud alert still can be seen. When card 1115 has not been separated from sheet 1120, if only label 1128 is separated from sheet 1120 and peeled off from card 1115, PIN code 111 is caused to become illegally visible. However, since label 1128 is formed together with sheet 1120, after only label 1128 is separated from sheet 1120 and then peeled off from card 1115, it becomes difficult to restore label 1128 to sheet 1120.

(Thirteenth Embodiment)

FIG. 30*a* is a schematic diagram showing the laminated state of a thirteenth embodiment of the present invention; and FIG. 30*b* is an external perspective view showing the thirteenth embodiment of the present invention. FIG. 31*a* is a schematic diagram showing an example of the structure of the rear surface of sheet 1212 shown in FIG. 30*a* and FIG. 30*b*; FIG. 31*b* is a schematic diagram showing an example of the structure of the rear surface of information concealment sheet 1211 shown in FIG. 30*a* and FIG. 30*b*; and FIG. 31*c* is a sectional view taken along line 31*c*-31*c* of FIG. 31*b*. FIG. 32 is a schematic diagram describing that information concealment sheet 1211 shown in FIG. 30*a* and FIG. 30*b* prevents a PIN code from becoming visible.

As shown in FIG. 30*a* and FIG. 30*b*, information concealment sheet 1211 according to the thirteenth embodiment has sheet 1212, protection member 1213, and concealment member 1214.

As shown in FIG. 31*a*, on rear surface 1212B of sheet 1212, PIN code 1241 that is a first code and POS code 1242 that is a second code are formed. PIN code 1241 and POS code 1242 have been correlated with each other, for example, by a management server. At least, PIN code 1241 is made of a carbon toner that is suitable for a PIN code. Alternatively, PIN code 1241 may be made of carbon ink, not carbon toner.

Protection member 1213 is made of paper and has the same thickness as sheet 1212. Protection member 1213 has sheet opening 1221 and hanging hole 1222.

For example, concealment member 1214 is made of paper and has the same thickness as protection member 1213. When sheet 1212 is placed in the region corresponding to sheet opening 1221 formed in protection member 1213, POS code opening 1231 that allows POS code 1242 that is indicated on rear surface 1212B to become visible is formed. In addition, carbon concealment layer 1232 is formed at the position corresponding to PIN code 1241 that is indicated on rear surface 1212B of sheet 1212. In addition, hole 1233 corresponding to hole 1222 formed in protection member 1213 is formed in concealment member 1214.

Carbon concealment layer 1232 is formed for example of the character pattern of an ultraviolet curing ink containing black carbon having a grain diameter that is equal to or greater than that of black carbon contained in the carbon toner of which PIN code 1241 is made. Carbon concealment layer 1232 may be simply painted as a light shading. However, if carbon concealment layer 1232 is thickly painted, its thickness may become uneven. When sheet 1212 is adhered to carbon concealment layer 1232, carbon may be transferred thereto. Thus, although carbon concealment layer 1232 is thinly formed as a character pattern, PIN code 1241 can be effectively prevented from being read by LED light. The character pattern as PIN code 1241 is preferably characters of the same type (including numeric characters and symbols) randomly arranged to hang upside down or to slant.

As shown in FIG. 30*a* and FIG. 31*c*, concealment member 1214 and protection member 1213 are adhered to each other by strong adhesive layer 1234 that is well known at the region other than corresponding region of sheet opening 1221 formed in protection member 1213. In sheet opening 1221 formed in protection member 1213, sheet 1212 is peelably adhered to concealment member 1214 through peelable adhesive layer 1235 that is well known such that rear surface 1212B on which PIN code 1241 and POS code 1242 are formed is opposite to concealment member 1214. As shown in FIG. 30*a*, although strong adhesive layer 1234 and peelable adhesive layer 1235 are formed on concealment member 1214, they may depend on protection member 1213 and sheet 1212. Thus, strong adhesive layer 1234 and peelable adhesive layer 1235 may be adequately adjusted when information concealment sheet 1211 is manufactured.

In other words, when protection member 1213 is adhered to concealment member 1214 and then sheet 1212 is peelably adhered to concealment member 1214, information concealment sheet 1211 shown in FIG. 30*b* can be obtained. As shown in FIG. 31*b* and FIG. 31*c*, on the rear surface of information concealment sheet 1211(rear surface 1214B of concealment member 1214), POS code 1242 that is formed on rear surface 1212B of sheet 1212 becomes visible through POS code opening 1231. On the other hand, PIN code 1241 is overlaid and concealed by carbon concealment layer 1232 such that the position in the overlay direction of PIN code 1241 matches that of carbon concealment layer 1232.

Information concealment sheet 1211 is sold, for example, at kiosk stores. When the user purchases information concealment sheet 1211, POS code 1242 is read by a POS register. Thus, when the user purchases information concealment sheet 1211, PIN code 1241 that has been correlated with POS code 1242 on a management server can be used. In other words, when the purchaser peels off sheet 1212 from information concealment sheet 1211, PIN code 1241 formed on rear surface 1212B becomes visible. As a result, PIN code 1241 can be used over a computer network.

When information concealment sheet 1211 is displayed and sold at a store, as shown in FIG. 32, even if the rear surface of information concealment sheet 1211 is irradiated with LED light 1250 of a mobile phone or a smartphone by a malicious person, the character pattern on carbon concealment layer 1232 prevents irradiation light from being transmitted through PIN code 1241 and prevents PIN code 1241 from becoming visible (if carbon concealment layer 1232 is fully painted, shaded light will not allow PIN code 1241 to become visible). As a result, PIN code 1241 can be prevented from being illegally obtained.

FIG. 33*a* is a schematic diagram showing another example of the structure of the rear surface of sheet 1212 according to the thirteenth embodiment of the present invention; FIG. 33*b* is a schematic diagram showing another example of the structure of the rear surface of information concealment sheet 1211 according to the thirteenth embodiment of the present invention; FIG. 34*a* is a schematic diagram showing another example of the structure of the rear surface of sheet 1212 according to the thirteenth embodiment of the present invention; and FIG. 34*b* is a schematic diagram showing another example of the structure of the front surface of sheet 1212 according to the thirteenth embodiment of the present invention.

Like the structure shown in FIG. 31*a*, on rear surface 1212B of sheet 1212, PIN code 1241 and POS code 1242 are formed as shown in FIG. 33*a*.

As shown in FIG. 33*b*, information concealment sheet 1211 in this example has the same structure as information concealment sheet 1211 shown in FIG. 30*a*, FIG. 30*b*, FIG. 31*a*, and FIG. 31*b*. Carbon concealment layer 1251 is formed on rear surface 1214B of concealment member 1214 such that the position in the overlay direction of PIN code 1241 matches that of carbon concealment layer 1251.

As shown in FIG. 33*b*, on the rear surface of information concealment sheet 1211 (rear surface 1214B of concealment member 1214), POS code 1242 formed on rear surface 1212B of sheet 1212 is visible through POS code opening 1231. On the other hand, PIN code 1241 is overlaid with and concealed by carbon concealment layer 1232 formed on rear surface 1214B of concealment member 1214 such that the position in the overlay direction of PIN code 1241 matches that of carbon concealment layer 1251.

In addition, like sheet 1212 shown in FIG. 31*a*, PIN code 1241 and POS code 1242 are formed on rear surface 1212B of sheet 1212 as shown in FIG. 34*a*. In addition, as shown in FIG. 34*b*, carbon concealment layer 1252 is formed on front surface 1212A of sheet 1212 such that the position in the overlay direction of PIN code 1241 matches that of carbon concealment layer 1252.

In information concealment sheets 1211 that use sheet 1212, carbon concealment layers 1232 (1251) are formed on front surface 1212A of sheet 1212 such that the position in the overlay direction of carbon concealment layer is different from that of carbon concealment layer 1232 (1251). The other structures of the foregoing examples are the same.

Even if carbon concealment layers 1251 and 1252 are formed at different positions, their character patterns prevent irradiation light of an LED light from being transmitted through PIN code 1241 and prevents PIN code 1241 from becoming visible (if they are fully painted, shaded light does not allow PIN code 1241 to become visible). As a result, PIN code 1241 can be prevented from being illegally obtained.

(Fourteenth Embodiment)

FIG. 35*a* is a schematic diagram showing an example of the structure of the front surface of a fourteenth embodiment of the present invention; FIG. 35*b* is a schematic diagram showing an example of the structure of the rear surface of the fourteenth embodiment of the present invention; FIG. 35*c* is a schematic diagram showing that information concealment sheet 1211 shown in FIG. 35*a* has been folded; and FIG. 35*d* is a sectional view taken along line 35*d*-35*d* of FIG. 35*c*.

As shown in FIG. 35*a* and FIG. 35*b*, information concealment sheet 1211 according to the fourteenth embodiment has sheet 1261 and concealment member 1262 that are foldably connected through fold 1263.

PIN code 1241 and POS code 1242 are formed on front surface 1261A of sheet 1261 such that PIN code 1241 is adjacent to fold 1263. Hanging hole 1265 is formed in sheet 1261 such that hanging hole 1265 is opposite to fold 1263.

The length of concealment member 1262 in the connection direction of sheet 1261 and concealment member 1262 is shorter than that of sheet 1261. Thus, when concealment member 1262 is folded on the front surface 1261A side of sheet 1261 along fold 1263, concealment member 1262 covers PIN code 1241, not POS code 1242. In addition, a peeling notch is formed at one corner of concealment member 1262.

Peelable adhesive layer 1264 that is well known is fully formed on the front surface 1261A of sheet 1261 of concealment member 1262. In addition, carbon concealment layer 1271 is formed on concealment member 1262 such that when it is folded on front surface 1261A, carbon concealment layer 1271 is overlaid with PIN code 1241.

As shown in FIG. 35*c* and FIG. 35*d*, when concealment member 1262 is folded on the front surface 1261A side along fold 1263 and they are adhered to each other with peelable adhesive layer 1235, POS code 1242 becomes visible, concealment member 1262 conceals PIN code 1241 through carbon concealment layer 1271, and PIN code 1241 is overlaid with carbon concealment layer 1271. In other words, carbon concealment layer 1271 is formed on the folded surface such that the position in the overlay direction of PIN code 1241 matches that of carbon concealment layer 1271. Alternatively, PIN code 1241 and carbon concealment layer 1271 may be simultaneously formed of the same black carbon material.

Even if the rear side of information concealment sheet 1211 is irradiated with LED light, the character pattern of carbon concealment layer 1211 prevents irradiation light of the LED light from being transmitted through PIN code 1241 and prevents PIN code 1241 from becoming visible (if carbon concealment layer 1271 is fully painted, shaded light does not allow PIN code 1241 to become visible). As a result, PIN code 1241 can be prevented from being illegally obtained. It should be noted that fold 1263 may be a perforation such that concealment member 1262 can be removed later. Concealment member 1262 and sheet 1261 may be separated members such that they are peelably adhered to each other.

FIG. 36*a* is a schematic diagram showing another example of the structure of the front surface of the fourteenth embodiment of the present invention; FIG. 36*b* is a schematic diagram showing another example of the structure of the rear surface of the fourteenth embodiment of the present invention; and FIG. 36*c* is a schematic diagram showing that information concealment sheet 1211 shown in FIG. 36*b* has been folded.

As shown in FIG. 36*a* and FIG. 36*b*, information concealment sheet 1211 according to this example is different from information concealment sheet 1211 shown in FIG. 35*a* as regards their positions in the overlay direction. The other structures are the same.

In other words, as shown in FIG. 36*a* and FIG. 36*b*, in information concealment sheet 1211 of this example, carbon concealment layer 1272 is formed on rear surface 1262B of concealment member 1262 (the opposite surface of the folded surface 1261A side of concealment member 1262 that is folded along fold 1263) such that when concealment member 1262 is folded on front surface 1261A, the position of carbon concealment layer 1272 matches the position of PIN code 1241 formed on front surface 1261A. When concealment member 1262 and front surface 1261A are folded and adhered to each other with peelable adhesive layer 1264, as shown in FIG. 36*c*, concealment member 1262 in which carbon concealment layer 1272 formed on the surface 1261A side conceals PIN code 1241, but POS code 1242 is visible.

FIG. 37*a* is a schematic diagram showing another example of the structure of the front surface of the fourteenth embodiment of the present invention; FIG. 37*b* is a schematic diagram showing another example of the structure of the rear surface of the fourteenth embodiment of the present invention; FIG. 37*c* is a front view showing that information concealment sheet 1211 shown in FIG. 37*a* has been folded; and FIG. 37*d* is a rear view showing that information concealment sheet 1211 shown in FIG. 37*b* has been folded.

As shown in FIG. 37*a* and FIG. 37*b*, in information concealment sheet 1211 of this example, carbon concealment layer 1273 is formed on rear surface 1261B of sheet 1261 (the opposite surface of front surface 1261A on which PIN code 1241 and POS code 1242 are formed) such that the position of carbon concealment layer 1273 matches the position of PIN code 1241. When concealment member 1262 and front surface 1261A of sheet 1261 are folded and adhered to each other with peelable adhesive layer 1264, as shown in FIG. 37*c* and FIG. 37*d*, concealment member 1262 conceals PIN code 1241, but POS code 1242 is visible.

In information concealment sheet 1211 shown in FIG. 36*a* to FIG. 36*c* and FIG. 37*a* to FIG. 37*d*, even if the rear side of information concealment sheet 1211 is irradiated with LED light, the character pattern of carbon concealment layer 1272 and 1273 prevents irradiation light of the LED light from being transmitted through PIN code 1241 and prevents PIN code 1241 from becoming visible (if carbon concealment layer 1272 and 1273 is simply painted, shaded light does not allow PIN code 1241 to become visible). As a result, PIN code 1241 can be prevented from being illegally obtained.

The information concealment sheets according to the foregoing thirteenth and fourteenth embodiments can be used as prepaid cards, member cards, concealed postcards, and so forth that can conceal predetermined information such that it can become visible later.

In addition, although the information concealment sheets according to the thirteenth and fourteenth embodiments are applied to service providing sheets (prepaid cards) for shopping and services that online stores provide over computer networks, it should be noted that the information concealment sheets may be applied as information concealment techniques to mail items, delivery slips, information concealment forms, and so forth.

What is claimed is:

1. A card enclosed unit, comprising a first sheet and a second sheet adhered to each other, on which a first code and a second code are indicated, said first code and said second code having been correlated with each other, said first sheet comprising a card, wherein said first sheet comprises said card separably along a separation line, said first sheet is peelably adhered to said second sheet, said first code is indicated on said second sheet side adhesion surface of said card, said second code is indicated on said second sheet side adhesion surface of said first sheet, and wherein said second sheet has a hole such that said hole is facing said second code.

2. The card enclosed unit according to claim 1, wherein said second code is indicated on said second sheet side adhesion surface of said card.

3. The card enclosed unit according to claim 1, wherein said first sheet whose surface is opposite to said second sheet side adhesion surface is exposed on one surface of said card enclosed unit, and said second sheet whose surface opposite to said first sheet side adhesion surface is exposed on other surface of said card enclosed unit.

4. The card enclosed unit according to claim 1, wherein said first sheet is composed of upper paper and lower paper adhered to each other with an adhesive agent.

5. The card enclosed unit according to claim 1, wherein a card region and a non-card region of said second sheet side adhesion surface of said first sheet are coated with release varnish having a predetermined width along the boundary between said card region and the non-card region.

6. The card enclosed unit according to claim 5, wherein said release varnish is coated on a region on which said first code is not indicated of said second sheet side adhesion surface of said first sheet, and another region that is not opposite to said first code of said first sheet side adhesion surface of said second sheet is coated with a pseudo adhesive agent.

* * * * *